US008109744B2

(12) United States Patent
Kawasaki et al.

(10) Patent No.: US 8,109,744 B2
(45) Date of Patent: Feb. 7, 2012

(54) TURBO VACUUM PUMP

(75) Inventors: Hiroyuki Kawasaki, Tokyo (JP); Hiroaki Ogamino, Tokyo (JP); Hiroshi Sobukawa, Tokyo (JP)

(73) Assignee: Ebara Corporation, Tokyo (JP)

( * ) Notice: Subject to any disclaimer, the term of this patent is extended or adjusted under 35 U.S.C. 154(b) by 498 days.

(21) Appl. No.: 12/410,780

(22) Filed: Mar. 25, 2009

(65) Prior Publication Data

US 2009/0246038 A1 Oct. 1, 2009

(30) Foreign Application Priority Data

Mar. 26, 2008 (JP) ..... 2008-079534
Mar. 26, 2008 (JP) ..... 2008-079535
Apr. 17, 2008 (JP) ..... 2008-107877

(51) Int. Cl.
*F04B 37/14* (2006.01)
*F04B 37/10* (2006.01)

(52) U.S. Cl. ..... 417/423.4; 417/423.1; 415/110; 415/142

(58) Field of Classification Search ..... 417/423.1, 417/423.4, 423.12, 423.14, 423.15; 415/104–107, 415/110–113, 142, 170.1
See application file for complete search history.

(56) References Cited

U.S. PATENT DOCUMENTS 3,399,827 A * 9/1968 Schwartzman ..... 417/406
5,695,316 A * 12/1997 Schutz et al. ..... 415/90
7,338,262 B2 * 3/2008 Gozdawa ..... 417/423.8

FOREIGN PATENT DOCUMENTS

JP 01142594 A * 6/1989
JP 1-142594 U 9/1989
JP 2002-285987 A 10/2002

* cited by examiner

*Primary Examiner* — Joseph L Williams
*Assistant Examiner* — Nathaniel Lee
(74) *Attorney, Agent, or Firm* — Westerman, Hattori, Daniels & Adrian, LLP

(57) ABSTRACT

An oil-free turbo vacuum pump is capable of evacuating gas in a chamber from atmospheric pressure to high vacuum. The turbo vacuum pump includes a pumping section having rotor blades and stator blades which are disposed alternately in a casing, a main shaft for supporting the rotor blades, and a bearing and motor section having a motor for rotating the main shaft and a bearing mechanism for supporting the main shaft rotatably. A gas bearing is used as a bearing for supporting the main shaft in a thrust direction, spiral grooves are formed in both surfaces of a stationary part of the gas bearing, and the stationary part having the spiral grooves is placed between an upper rotating part and a lower rotating part which are fixed to the main shaft.

23 Claims, 28 Drawing Sheets

TURBO VACUUM PUMP

BACKGROUND OF THE INVENTION

1. Field of the Invention

The present invention relates to a turbo vacuum pump, and more particularly to an oil-free turbo vacuum pump which is capable of evacuating gas in a chamber from atmospheric pressure to high vacuum.

2. Description of the Related Art

Conventionally, in a semiconductor fabrication apparatus or the like, turbo vacuum pumps have been used for evacuating gas in a chamber to develop clean high vacuum (or ultra-high vacuum). These turbo vacuum pumps include a type of vacuum pump in which a turbo-molecular pump stage, a thread groove pump stage and a vortex pump stage are disposed in series in a pump casing having an intake port and a discharge port, and a main shaft to which rotor blades of these pump stages are fixed is supported by a hydrostatic gas bearing, a type of vacuum pump in which multiple centrifugal compression pump stages are disposed in a pump casing having an intake port and a discharge port, and a main shaft to which rotor blades of these pump stages are fixed is supported by a radial gas bearing and a thrust gas bearing, and other types of vacuum pumps. In this manner, the main shaft is supported by the gas bearing without using a rolling bearing to construct an oil-free turbo vacuum pump which does not require oil in the entirety of the pump including gas passages and bearing portions.

The turbo vacuum pump in which the turbo-molecular pump stage, the thread groove pump stage and the vortex pump stage are combined with the hydrostatic gas bearings is disclosed in Japanese laid-open patent publication No. 2002-285987. This turbo vacuum pump is capable of compressing gas from ultra-high vacuum to atmospheric pressure. In this turbo vacuum pump, vortex flow blades (circumferential flow blades) of the vortex pump stage are blade elements which are capable of compressing gas to atmospheric pressure, even if a blade clearance is wide. The vortex flow blade of the vortex pump stage comprises rotor blade parts formed radially at an outer circumferential portion of a rotating circular disk, annular recesses (flow passages) which surround the rotating circular disk having the rotor blade parts, and a communicating passage for allowing the vertically adjacent flow passages to communicate with each other. However, the vortex pump stage has disadvantages that a volume of the blade element is large because the flow passages for surrounding the rotating circular disk above and below are required. Further, gas is drawn in from a single communicating passage (intake port) provided at the flow passage, compressed in a circumferential direction, and discharged from a communicating passage (discharge port) communicating with the adjacent flow passage. Therefore, the vortex pump stage has disadvantages that evacuation velocity (evacuation capacity) is small. Furthermore, because the rotating circular disk having a lot of rotor blade parts radially formed is rotated in an atmospheric pressure range, a large operating power is required. In addition, the vortex pump stage has structural disadvantages that stationary-side structure having the flow passages and the communicating passage is complicated.

On the other hand, the turbo vacuum pump in which the centrifugal compression pump stages are combined with the gas bearings is disclosed in Japanese laid-open utility model publication No. 1-142594. This turbo vacuum pump is capable of compressing gas from low vacuum range to substantially atmospheric pressure. In this turbo vacuum pump, the thrust gas bearing is disposed at the discharge port side, and a rotating thrust disk of the thrust gas bearing is placed axially between a stationary upper disk and a stationary lower disk. This turbo vacuum pump has disadvantages that the number of parts is large because the centrifugal compression pump stage and the gas bearing are discrete structures. Because the centrifugal compression pump stage and the gas bearing are discrete structures, it is difficult to make the blade clearance of the centrifugal compression pump stage minute.

Further, as a turbo vacuum pump, there is a vacuum pump in which multiple evacuation pump stages are disposed in a pump casing having an intake port and a discharge port, rotor blades in the multiple pump stages are composed of ceramics, and a main shaft for supporting the ceramic rotor blades is composed of a metal having a small coefficient of linear expansion.

Since there is a small blade clearance between the rotor blade and the stator blade in the vacuum pump, heat is generated in the process of compressing gas to increase a temperature of the blades. Therefore, an example in which ceramics are used to construct multistage rotor blades as a material having a small coefficient of linear expansion and a large specific strength is disclosed in Japanese laid-open patent publication No. 5-332287. In this example, a main shaft is composed of a material having a small coefficient of linear expansion so that the difference between the coefficient of linear expansion of the ceramic rotor blade and the coefficient of linear expansion of the main shaft is not more than $5\times10^{-6}$/°C.

However, in the case where martensitic stainless steel is used as a material for the main shaft, the coefficient of linear expansion of the martensitic stainless steel is about $10\times10^{-6}$/°C., and the difference between the coefficient of linear expansion of the martensitic stainless steel and the coefficient of linear expansion of silicon nitride ceramics ($3\times10^{-6}$/°C.) as high-strength ceramics used for a rotor is $7\times10^{-6}$/°C. If austenitic stainless steel is used as a material for the main shaft, the difference between the coefficient of linear expansion of the silicon nitride ceramics ($3\times10^{-6}$/°C.) and the coefficient of linear expansion of austenitic stainless steel ($17\times10^{-6}$/°C.) becomes much larger. Therefore, in the prior art (Japanese laid-open patent publication No. 5-332287), it is necessary for a material of the main shaft to select a material having a high Young's modulus in consideration of a small coefficient of linear expansion and a large natural frequency of a rotating member, resulting in increased cost.

On the other hand, the centrifugal compression pump stage of the turbo vacuum pump disclosed in Japanese laid-open utility model publication No. 1-142594 comprises rotating disks and stationary circular disks which are alternately disposed.

FIG. 28 is a cross-sectional view showing the centrifugal compression pump stage disclosed in Japanese laid-open utility model publication No. 1-142594. As shown in FIG. 28, stationary circular disks 2*a*, or 2*b*, are axially positioned and stacked using cylindrical spacers $\mathbf{2}a_2$ or $\mathbf{2}b_2$. Impellers $\mathbf{1}a_1$ or rotating disks $\mathbf{1}b_1$ are formed integrally with a main shaft 1.

In the centrifugal compression pump stage of the vacuum pump disclosed in Japanese laid-open utility model publication No. 1-142594, the stationary circular disks $\mathbf{2}a_1$ or $\mathbf{2}b_1$ are axially positioned and stacked using the cylindrical spacers $\mathbf{2}a_2$ or $\mathbf{2}b_2$, and the impellers $\mathbf{1}a_1$ or the rotating disks $\mathbf{1}b_1$ are formed integrally with the main shaft 1. Specifically, the number of parts is large because blade elements and spacer elements as a stationary assembly are discrete parts. Further, since the main shaft 1 and the rotating disks $\mathbf{1}b_1$ as a rotating assembly are an integral structure, it is difficult to raise axial dimensional accuracy and geometric tolerance accuracy in each stage.

SUMMARY OF THE INVENTION

The present invention has been made in view of the above drawbacks. It is therefore a first object of the present invention to provide a turbo vacuum pump having blade elements which can compress gas from high vacuum to atmospheric pressure, and are simple in structure and have high efficiency (small operating power).

Further, a second object of the present invention is to provide a turbo vacuum pump having blade elements made of ceramics which can compress gas from high vacuum to atmospheric pressure, and are simple in structure and inexpensive.

Furthermore, a third object of the present invention is to provide a turbo vacuum pump having blade elements which can compress gas from high vacuum to atmospheric pressure, can improve axial dimensional accuracy and geometric tolerance accuracy, and can be manufactured inexpensively by reducing the number of parts.

In order to achieve the first object of the present invention, according to a first aspect of the present invention, there is provided a turbo vacuum pump comprising: a casing; a pumping section having rotor blades and stator blades which are disposed alternately in the casing; a main shaft for supporting the rotor blades; and a bearing and motor section having a motor for rotating the main shaft and a bearing mechanism for supporting the main shaft rotatably; wherein a gas bearing is used as a bearing for supporting the main shaft in a thrust direction, spiral grooves are formed in both surfaces of a stationary part of the gas bearing, and the stationary part having the spiral grooves is placed between an upper rotating part and a lower rotating part which are fixed to the main shaft; and wherein the upper rotating part has a first surface and a second surface opposite to the first surface, a centrifugal blade element for compressing and evacuating gas in a radial direction is formed on the first surface of the upper rotating part, and the second surface faces the spiral grooves of the stationary part.

According to the first aspect of the present invention, because the gas bearing is used as a bearing for supporting the rotor including the main shaft and the rotor blades fixed to the main shaft in a thrust direction, the rotor can be rotatably supported in an axial direction of the rotor with an accuracy of several micron meters (μm) to several tens of micron meters (μm). The centrifugal blade element for compressing gas in a radial direction is integrally formed on the rotor part constituting a part of the gas bearing, i.e. the upper rotating part. Because the minute clearance of the gas bearing and the minute clearance of the centrifugal blades are in the same thrust direction, the blade clearance of the centrifugal blade element can be set to be substantially equal to the clearance of the gas bearing or to be slightly larger than the clearance of the gas bearing. Specifically, because the centrifugal blade element for compressing gas in the radial direction is formed on the upper rotating part, the upper rotating part constitutes a centrifugal blade as well as a part of the gas bearing for axial positioning of the rotor. In this manner, since the centrifugal blade element for compressing gas in the radial direction is formed on the upper rotating part for axial positioning of the rotor, the blade clearance of the centrifugal blade element can be controlled with high accuracy.

In a preferred aspect of the present invention, centrifugal blade elements for compressing and evacuating gas in a radial direction are axially disposed in a multistage manner, and blade clearances of the centrifugal blade elements are arranged to be gradually larger from the discharge side to the intake side.

In order to compress gas from ultra-high vacuum to atmospheric pressure, it is necessary to arrange a plurality of blades in a multistage manner. If the temperature of the rotor blade is compared with the temperature of the stator blade, the temperature of the rotor blade should be higher than the temperature of the stator blade. Therefore, if the clearance of the adjacent blades in each stage is equal to each other in the multistage blades, the difference in thermal expansion between the rotor blade and the stator blade is developed due to a temperature difference between the rotor blade and the stator blade, and the clearances of the adjacent blades at the upstream side become gradually narrower. Thus, contact of the adjacent blades is liable to occur. Therefore, it is necessary to adjust the blade clearance in each stage in consideration of the temperature difference. However, because the blade clearance in each stage is extremely small, measurement and adjustment of the blade clearances in all stages is troublesome and time-consuming, and thus assembly time is prolonged. Therefore, according to the present invention, it is desirable that the blade clearances are arranged to be getting gradually larger from the discharge side to the intake side.

In a preferred aspect of the present invention, centrifugal blade elements for compressing and evacuating gas in a radial direction are axially disposed in a multistage manner, and an axial thickness of the stator blade is thicker than an axial thickness of the rotor blade having the centrifugal blade element by about 10 to 50% of blade clearance which is formed in an axial direction.

According to the present invention, the axial thickness of the stator blade is set to be thicker than the axial thickness of the rotor blade. Then, as the number of stages increases, the blade clearance increases accordingly. For example, the axial thickness of the stator blade is set to be thicker than the axial thickness of the rotor blade by t μm. In this case, assuming that the blade clearance of the centrifugal blade stage closest to the gas bearing is taken as CLμm, the blade clearance at the next stage becomes CLμm+t μm, and then the blade clearance at the stage after the next becomes CLμm+2×t μm. As the number of stages increases, the blade clearance increases accordingly. This dimensional difference may be determined in consideration of the temperature difference between the rotor blade and the stator blade. If the rotor blade and the stator blade are composed of different materials, the difference in these coefficients of linear expansion should be taken into consideration.

In a preferred aspect of the present invention, centrifugal blade grooves of a centrifugal blade element for compressing and evacuating gas in a radial direction are formed in both of a surface for forming minute axial clearance and its opposite surface of the rotor blade.

In order to arrange a plurality of blades in a multistage manner, it would be better to make the accuracy of parts as high as possible. The centrifugal blade element comprising centrifugal blade grooves for compressing and evacuating gas in a radial direction is formed on the surface for evacuating gas from an inner circumferential side to an outer circumferential side. That is, the centrifugal blade element is formed in a direction in which a centrifugal force acts. However, if the centrifugal blade element is formed on a single surface, the centrifugal blade surface is liable to be bent and deformed, and it is necessary to correct the bent or deformed surface.

According to the present invention, in the rotor blade side, the same centrifugal blade grooves are formed in the surface opposite to the surface in which the centrifugal blade grooves are formed, and thus bending or deformation of the surface can be reduced.

In a preferred aspect of the present invention, an elastic deformation structure is provided as at least a part of components for fastening multistage centrifugal blade elements in an axial direction.

In the turbo vacuum pump according to the present invention, in order to form extremely minute blade clearance, ceramics are suitable for materials of respective parts. The rotor blade is preferably composed of silicon nitride ceramics having high strength, and the stator blade is preferably composed of silicon carbide ceramics having high thermal conductivity. The stator blade may be composed of alumina ceramics. In the case where the rotor blade is composed of a material having a small coefficient of linear expansion (about $3\times10^{-6}$/°C.) such as ceramics, and the main shaft is composed of stainless steel (martensitic stainless steel), because the coefficient of linear expansion of stainless steel (martensitic stainless steel) is about $10\times10^{-6}$/°C., loosening of the fastened portion is liable to occur during the temperature rise caused by rotation of the rotor due to the difference in the coefficient of linear expansion.

According to the present invention, the elastic deformation structure is provided as a part of the members for fastening the multistage centrifugal blade elements in an axial direction. When the rotor blades are fastened in an axial direction, an axial deformation is imparted to the elastic deformation structure in advance. Thus, loosening of the rotor blades caused by thermal deformation can be prevented. The elastic deformation structure is preferably composed of aluminum alloy.

In order to achieve the second object of the present invention, according to a second aspect of the present invention, there is provided a turbo vacuum pump comprising: a casing; a pumping section having rotor blades and stator blades which are disposed alternately in the casing; a main shaft for supporting the rotor blades; and a bearing and motor section having a motor for rotating the main shaft and a bearing mechanism for supporting the main shaft rotatably; wherein a gas bearing is used as a bearing for supporting the main shaft in a thrust direction, spiral grooves are formed in both surfaces of a stationary part of the gas bearing, and the stationary part having the spiral grooves is placed between an upper rotating part and a lower rotating part which are fixed to the main shaft; and wherein a spacer is provided between the lower rotating part and an end face of the main shaft.

In the case where the main shaft is composed of martensitic stainless steel or austenitic stainless steel and the rotor blades are composed of ceramics, if the end face of the main shaft is brought into direct contact with the lower rotating member (lower rotating part) of the gas bearing, then the lower rotating member (lower rotating part) is radially stretched due to the difference in coefficient of linear expansion and is liable to be broken or damaged due to an increased internal stress.

According to the second aspect of the present invention, since the spacer is provided between the lower rotating member (lower rotating part) of the gas bearing and the end face of the main shaft, the spacer is smaller than the lower rotating member (lower rotating part) in diameter, thus reducing the internal stress of the spacer. Further, since sliding occurs at the upper and lower surfaces of the spacer, the internal stress of the lower rotating member (lower rotating part) of the gas bearing is not increased.

In a preferred aspect of the present invention, the coefficients of linear expansion of the main shaft, the lower rotating part of the gas bearing and the spacer are taken as $\lambda sf$, $\lambda d1$, $\lambda sp$, respectively, and a material of the spacer is set to be $\lambda sf>\lambda sp\geqq\lambda d1$.

According to the present invention, the coefficient of linear expansion ($\lambda sp$) of the spacer is set between the coefficient of linear expansion ($\lambda sf$) of the main shaft and the coefficient of linear expansion ($\lambda d1$) of the lower rotating part of the gas bearing, and hence an increase of the internal stress of the lower rotating part caused by thermal deformation can be suppressed. The material of the spacer is preferably titanium alloy ($8.8\times10^{-6}$/°C.), alumina ceramics ($7.2\times10^{-6}$/°C.), tungsten carbide ($5.8\times10^{-6}$/°C.), or the like.

Further, even if the coefficient of linear expansion ($\lambda sp$) of the spacer is smaller than the coefficient of linear expansion ($\lambda sf$) of the main shaft and is identical to the coefficient of linear expansion ($\lambda d1$) of the lower rotating part of the gas bearing, the spacer is smaller than the lower rotating part in diameter, thus reducing the internal stress of the spacer.

According to a third aspect of the present invention, there is provided a turbo vacuum pump comprising: a casing; a pumping section having rotor blades and stator blades which are disposed alternately in the casing; a main shaft for supporting the rotor blades; and a bearing and motor section having a motor for rotating the main shaft and a bearing mechanism for supporting the main shaft rotatably; wherein a gas bearing is used as a bearing for supporting the main shaft in a thrust direction, spiral grooves are formed in both surfaces of a rotating part of the gas bearing fixed to the main shaft, and the rotating part having the spiral grooves is placed between an upper stationary part and a lower stationary part; and wherein a spacer is provided between the rotating part having the spiral grooves and an end face of the main shaft.

According to the third aspect of the present invention, since the spacer is provided between the rotating part having spiral grooves of the gas bearing and the end face of the main shaft, the spacer is smaller than the rotating part in diameter, thus reducing the internal stress of the spacer. Further, since sliding occurs at the upper and lower surfaces of the spacer, the internal stress of the rotating part is not increased.

In a preferred aspect of the present invention, the coefficients of linear expansion of the main shaft, the rotating part of the gas bearing and the spacer are taken as $\lambda sf$, $\lambda d2$, $\lambda sp$, respectively, and a material of the spacer is set to be $\lambda sf>\lambda sp\geqq\lambda d2$.

According to the present invention, the coefficient of linear expansion ($\lambda sp$) of the spacer is set between the coefficient of linear expansion ($\lambda sf$) of the main shaft and the coefficient of linear expansion ($\lambda d2$) of the rotating part of the gas bearing, and hence an increase of the internal stress of the rotating part caused by thermal deformation can be suppressed. The material of the spacer is preferably titanium alloy ($8.8\times10^{-6}$/°C.), alumina ceramics ($7.2\times10^{-6}$/°C.), tungsten carbide ($5.8\times10^{-6}$/°C.), or the like.

Further, even if the coefficient of linear expansion ($\lambda sp$) of the spacer is smaller than the coefficient of linear expansion ($\lambda sf$) of the main shaft and is identical to the coefficient of linear expansion ($\lambda d2$) of the rotating part of the gas bearing, the spacer is smaller than the rotating part in diameter, thus reducing the internal stress of the spacer.

According to a fourth aspect of the present invention, there is provided a turbo vacuum pump comprising: a casing; a pumping section having rotor blades and stator blades which are disposed alternately in the casing; a main shaft for supporting the rotor blades; and a bearing and motor section having a motor for rotating the main shaft and a bearing mechanism for supporting the main shaft rotatably; wherein a gas bearing is used as a bearing for supporting the main shaft in a thrust direction, spiral grooves are formed in both surfaces of a stationary part of the gas bearing, and the stationary part having the spiral grooves is placed between an upper rotating part and a lower rotating part which are fixed to the main shaft; and wherein an outer diameter of the main shaft is getting gradually smaller from the intake side to the downstream side.

In order to rotate the rotor including the main shaft and the rotor blades fixed to the main shaft at a high speed, it is desirable for the structure of the rotor blades fitted over the main shaft that radial clearance should be as small as possible in consideration of reduction of unbalance amount. However, if the main shaft is composed of stainless steel and the rotor blades are composed of ceramics, the coefficient of linear expansion of the main shaft is different from the coefficient of linear expansion of the rotor blade, and the coefficient of linear expansion of the main shaft is larger than the coefficient of linear expansion of the rotor blade, then the following phenomenon, "decreasedclearance→sticking→increased internal stress of the rotor blade→damage" is liable to occur. However, if an initial clearance between the rotor blade and the main shaft is too large in consideration of the above phenomenon, some failure such as an increase of the unbalance amount or variation of the unbalance amount during rotation occurs, and it may cause interference with stable rotation of the rotor. Further, in the case where the blade elements are arranged in a multistage manner, it may cause a greater impact on the rotor.

Therefore, according to the fourth aspect of the present invention, the outer diameter of the main shaft is getting gradually smaller from the intake side to the downstream side. In the blade element part of the rotor, as pressure is closer to the atmospheric pressure, heat generation caused by loss in the blade element part becomes larger. Therefore, the main shaft is thermally deformed more greatly at the location where the pressure is closer to the atmospheric pressure. In view of this fact, the main shaft is set to be a tapered shape so that the outer diameter of the main shaft is getting gradually smaller from the intake side to the downstream side of the main shaft. Thus, damage caused by the increased internal stress of the rotor blade and an increase of unbalance amount are avoidable. The outer diameter of the main shaft may be smaller in a step-like shape without using the continuously smaller shape.

In order to achieve the third object of the present invention, according to a fifth aspect of the present invention, there is provided a turbo vacuum pump comprising: a casing; a pumping section having rotor blades and stator blades which are disposed alternately in the casing; a main shaft for supporting the rotor blades; and a bearing and motor section having a motor for rotating the main shaft and a bearing mechanism for supporting the main shaft rotatably; wherein a gas bearing is used as a bearing for supporting the main shaft in a thrust direction, spiral grooves are formed in both surfaces of a stationary part of the gas bearing, and the stationary part having the spiral grooves is placed between an upper rotating part and a lower rotating part which are fixed to the main shaft; and wherein at least one of the rotor blade and the stator blade comprises a spacer-equipped blade member comprising a circular disk-shaped blade portion and a cylindrical spacer extending from the circular disk-shaped blade portion which are integrally formed, and the spacer-equipped blade members are stacked in a multistage manner to construct the pumping section.

According to a sixth aspect of the present invention, there is provided a turbo vacuum pump comprising: a casing; a pumping section having rotor blades and stator blades which are disposed alternately in the casing; a main shaft for supporting the rotor blades; and a bearing and motor section having a motor for rotating the main shaft and a bearing mechanism for supporting the main shaft rotatably; wherein a gas bearing is used as a bearing for supporting the main shaft in a thrust direction, spiral grooves are formed in both surfaces of a rotating part of the gas bearing fixed to the main shaft, and the rotating part having the spiral grooves is placed between an upper stationary part and a lower stationary part; and wherein at least one of the rotor blade and the stator blade comprises a spacer-equipped blade member comprising a circular disk-shaped blade portion and a cylindrical spacer extending from the circular disk-shaped blade portion which are integrally formed, and the spacer-equipped blade members are stacked in a multistage manner to construct the pumping section.

Conventionally, the circular disk-shaped blade member and the cylindrical spacer have been discrete members. According to the fifth and sixth aspects of the present invention, the circular disk-shaped blade portion and the cylindrical spacer are integrally formed, and thus the number of parts can be decreased to lower the manufacturing cost. Further, since the circular disk-shaped blade portion and the cylindrical spacer are integrally formed, assembling error caused by stacking discrete components (parts) can be reduced. In the case where the circular disk-shaped blade portion and the cylindrical spacer are integrally formed, axial errors are produced only on both end surfaces of the integral member. However, in the case where the circular disk-shaped blade member and the cylindrical spacer are discrete components, axial errors are produced on three surfaces including both end surfaces and a contact surface of the circular disk-shaped blade member and the cylindrical spacer.

According to the fifth and sixth aspects of the present invention, because the gas bearing is used as a bearing for supporting the rotor including the main shaft and the rotor blades fixed to the main shaft in a thrust direction, the rotor can be rotatably supported in an axial direction of the rotor with an accuracy of several micron meters (μm) to several tens of micron meters (μm).

In a preferred aspect of the present invention, the circular disk-shaped blade portion has a centrifugal blade element for compressing and evacuating gas in a radial direction, and the spacer-equipped blade member comprises an integrally formed component so that the centrifugal blade element is located at an end surface side of the integrally formed component.

In the case where the circular disk-shaped blade portion having the centrifugal blade element and the cylindrical spacer are integrally formed, it is desirable that the surface on which the centrifugal blade element is formed should be located at an end surface side of the integrally formed component. The evacuation performance of the centrifugal blade is largely affected by the axial clearance. As the axial clearance is smaller, the evacuation performance is higher. Therefore, as the dimensional accuracy and geometric tolerance accuracy of the axial end surfaces of the centrifugal blade element is higher, the clearance is smaller to improve the evacuation performance.

According to the present invention, if the surface on which the centrifugal blade element is formed is located at an end surface side of the integrally formed component, then a machining method such as lapping by which the accuracy of parallelism and flatness becomes very high can be applied to the integrally formed component. Therefore, because the dimensional accuracy and geometric tolerance accuracy of the axial end surfaces of the centrifugal blade element is high, the clearance can be minute to improve the evacuation performance. The above effects are not limited to either the stator blade side or the rotor blade side.

In a preferred aspect of the present invention, the spacer-equipped blade member constitutes the rotor blade, the cylindrical spacer extends downwardly from an inner circumferential side of the circular disk-shaped blade portion, and a centrifugal blade element for compressing and evacuating gas in a radial direction is formed on an upper end surface of the circular disk-shaped blade portion.

According to the present invention, in the rotor blade side, the cylindrical spacer and the circular disk-shaped blade portion are integrally formed so that the blade evacuation surface is located at an upper end surface side of the integrally formed component comprising the spacer-equipped blade member. Thus, the accuracy of parallelism and flatness can be very high by lapping.

In a preferred aspect of the present invention, the spacer-equipped blade member constitutes the stator blade, the cylindrical spacer extends upwardly from an outer circumferential side of the circular disk-shaped blade portion, and a blade evacuation surface is formed at a lower end of the circular disk-shaped blade portion.

According to the present invention, in the stator blade side, the cylindrical spacer and the circular disk-shaped blade portion are integrally formed so that the blade evacuation surface is located at a lower end surface side of the integrally formed component comprising the spacer-equipped blade member. Thus, the accuracy of parallelism and flatness can be very high by lapping.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
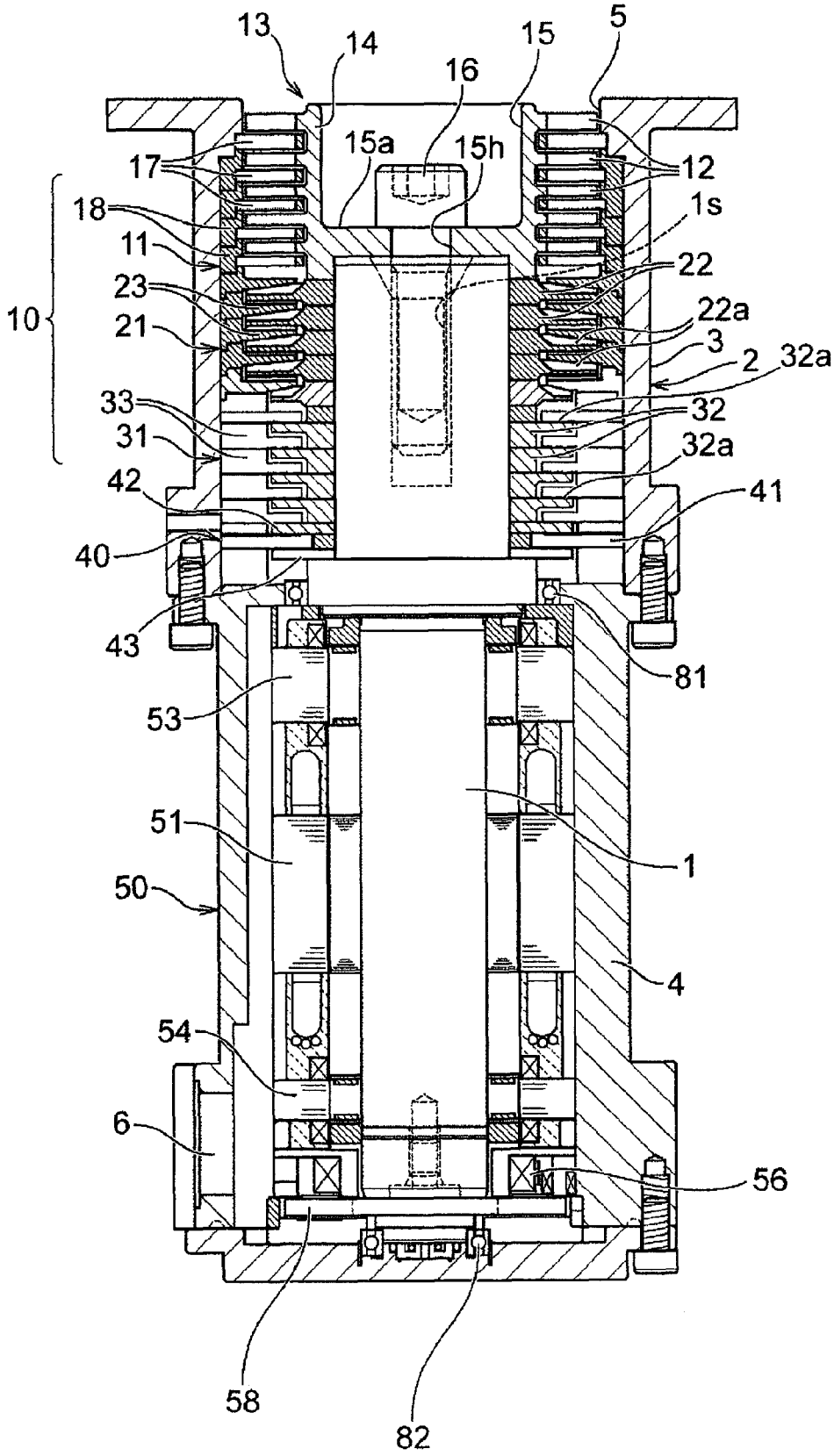
FIG. 1 is a cross-sectional view showing a turbo vacuum pump according to a first embodiment of the present invention.

A turbo vacuum pump according to a first embodiment of the present invention will be described below with reference to FIGS. 1 through 12. Like or corresponding parts are denoted by like or corresponding reference numerals throughout drawings and will not be described below repetitively.

FIG. 1 is a cross-sectional view showing a turbo vacuum pump according to the first embodiment of the present invention. As shown in FIG. 1, the turbo vacuum pump comprises a main shaft (rotating shaft) 1 extending over the substantially entire length of the pump, a pumping section 10 in which rotor blades and stator blades are alternately disposed in a casing 2, and a bearing and motor section 50 having a motor for rotating the main shaft 1 and bearings for rotatably supporting the main shaft 1. The casing 2 comprises an upper casing 3 for housing the pumping section 10 and a lower casing 4 for housing the bearing and motor section 50, and an intake port 5 is formed at the upper end portion of the upper casing 3 and a discharge port 6 is formed at the lower part of the lower casing 4.

The pumping section 10 comprises a turbine blade pumping section 11, a first centrifugal blade pumping section 21 and a second centrifugal blade pumping section 31 which are arranged in series from the intake port side to the lower part of the upper casing 3. The turbine blade pumping section 11 comprises multistage turbine blades 12 as multistage rotor blades, and multistage stator blades 17 which are disposed at immediately downstream side of the multistage turbine blades 12. The multistage turbine blades 12 are integrally formed on a substantially cylindrical turbine blade unit 13, and a hollow part 15 is formed in a boss part 14 of the turbine blade unit 13. A through hole 15*h* is formed in a bottom 15*a* of the hollow part 15, so that a bolt 16 is inserted into the through hole 15*h*. Specifically, the bolt 16 passes through the through hole 15*h* and is screwed into a threaded hole 1*s* of the upper part of the main shaft 1. Thus, the turbine blade unit 13 is fixed to the main shaft 1.

On the other hand, the multistage stator blades 17 are held between spacers 18 stacked in the upper casing 3 and are fixed in the upper casing 3. In this manner, the multistage turbine blades 12 as rotor blades and the multistage stator blades 17 are alternately disposed in the turbine blade pumping section 11.

The first centrifugal blade pumping section 21 comprises centrifugal blades 22 as multistage rotor blades, and multistage stator blades 23 which are disposed at immediately downstream side of the centrifugal blades 22. The centrifugal blades 22 are stacked in a multistage manner and fitted over the outer periphery of the main shaft 1. The centrifugal blades 22 may be fixed to the main shaft 1 by a fixing member such as a key. Further, the stator blades 23 are stacked in a multistage manner in the upper casing 3. In this manner, the centrifugal blades 22 as rotor blades and the stator blades 23 are alternately disposed in the first centrifugal blade pumping section 21. Each of the centrifugal blades 22 has a centrifugal blade element 22*a* comprising centrifugal blade grooves for compressing and evacuating gas in a radial direction.

The second centrifugal blade pumping section 31 comprises centrifugal blades 32 as multistage rotor blades, and multistage stator blades 33 which are disposed at immediately downstream side of the centrifugal blades 32. The centrifugal blades 32 are stacked in a multistage manner and fitted over the outer periphery of the main shaft. The centrifugal blades 32 may be fixed to the main shaft 1 by a fixing member such as a key. Further, the stator blades 33 are stacked in a multistage manner in the upper casing 3. In this manner, the centrifugal blades 32 as rotor blades and the stator blades 33 are alternately disposed in the second centrifugal blade pumping section 31. Each of the centrifugal blades 32 has a centrifugal blade element 32*a* comprising centrifugal blade grooves for compressing and evacuating gas in a radial direction. A gas bearing 40 is provided at immediately downstream side of the second centrifugal blade pumping section 31 to support the rotor including the main shaft 1 and the rotor blades 12, 22, 32 fixed to the main shaft 1.

Figure 2:
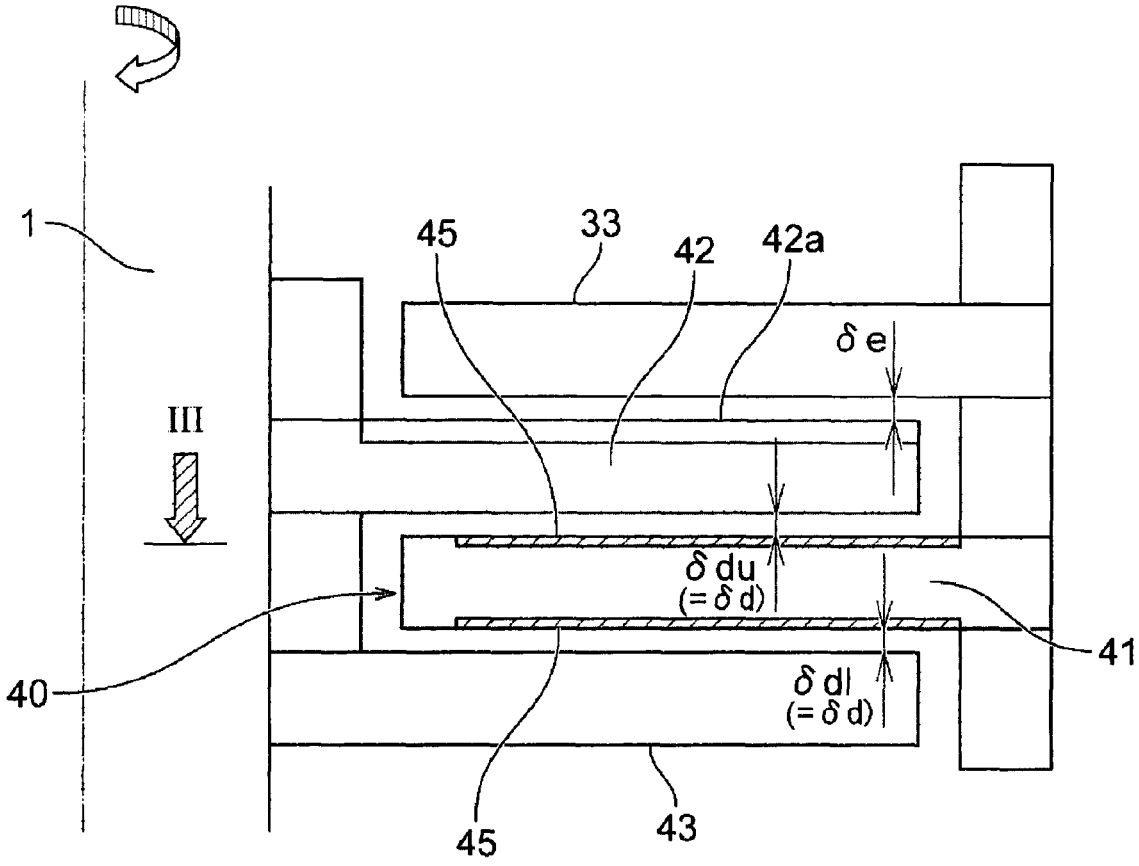
FIG. 2 is an enlarged view showing a gas bearing and peripheral part of the gas bearing.

FIG. 2 is an enlarged view showing the gas bearing 40 and peripheral part of the gas bearing 40. As shown in FIG. 2, the gas bearing 40 comprises a stationary member (stationary part) 41 fixed to the upper casing 3, and an upper rotating member (upper rotating part) 42 and a lower rotating member (lower rotating part) 43 which are disposed above and below the stationary member (stationary part) 41 so as to place the stationary member (stationary part) 41 between the upper rotating member (upper rotating part) 42 and the lower rotating member (lower rotating part) 43. The upper rotating member (upper rotating part) 42 and the lower rotating member (lower rotating part) 43 are fixed to the main shaft 1. Spiral grooves 45, 45 are formed in both surfaces of the stationary member (stationary part) 41.

Specifically, the stationary member (stationary part) 41 having the spiral grooves 45, 45 is placed between the upper and lower divided members (parts), i.e. the upper rotating member (upper rotating part) 42 and the lower rotating member (lower rotating part) 43. A centrifugal blade element 42*a* for compressing and evacuating gas in a radial direction is formed on a surface of the upper rotating member (upper rotating part) 42 having an opposite surface which faces the spiral grooves 45 of the stationary member (stationary part) 41. The centrifugal blade element 42*a* comprises centrifugal blade grooves for compressing and evacuating gas in a radial direction.

Figure 3:
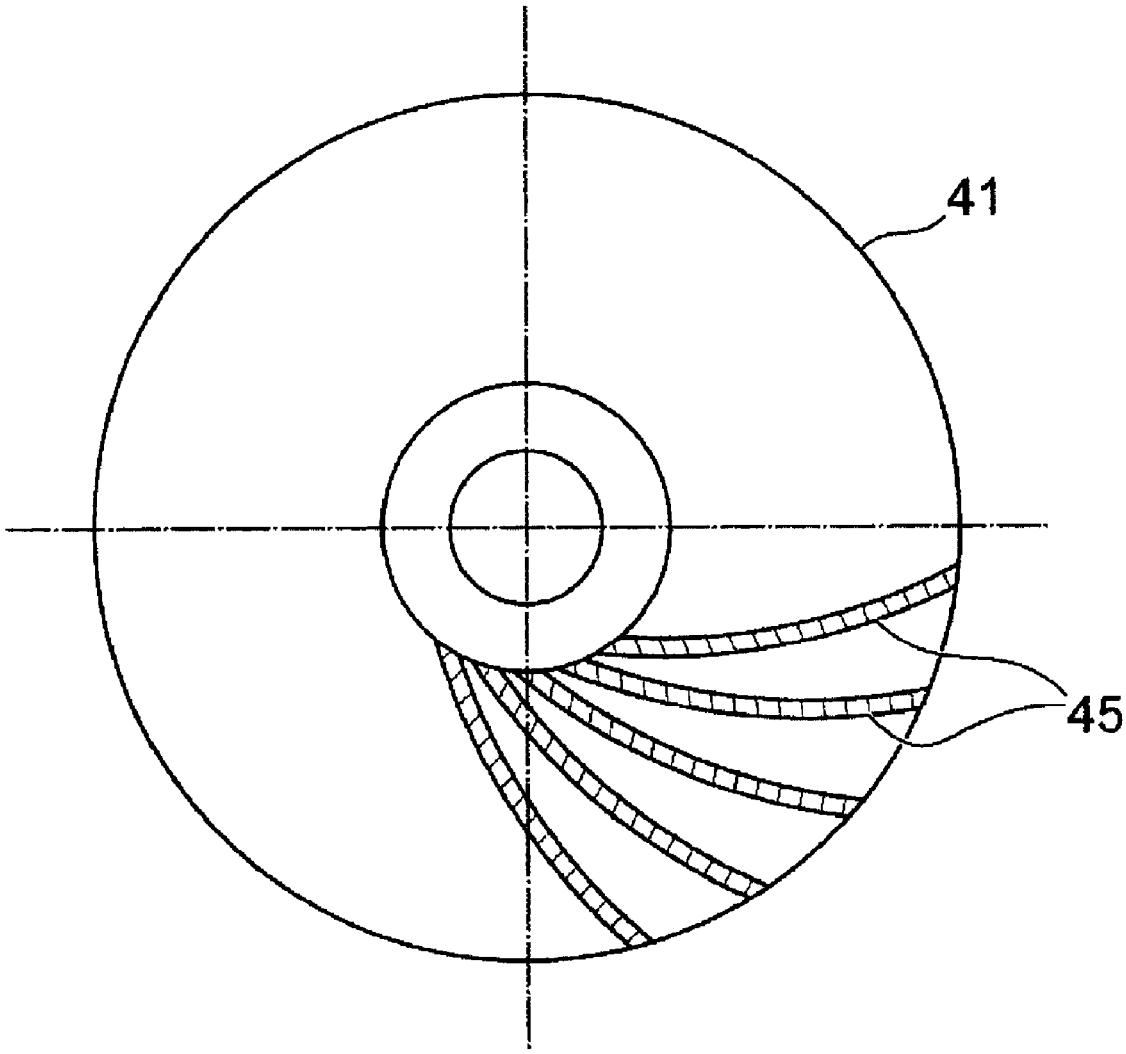
FIG. 3 is a view as viewed from an arrow III of FIG. 2.

FIG. 3 is a view as viewed from an arrow III of FIG. 2. As shown in FIG. 3, a number of spiral grooves 45 are formed in the surface of the stationary member (stationary part) 41 over the substantially entire surface of the stationary member (stationary part) 41 (in FIG. 3, part of spiral grooves are shown).

As shown in FIG. 2, because the gas bearing 40 is used as a bearing for supporting the rotor including the main shaft 1 and the rotor blades fixed to the main shaft 1 in a thrust direction, the rotor can be rotatably supported in an axial direction of the rotor with an accuracy of several micron meters (μm) to several tens of micron meters (μm). The centrifugal blade element 42*a* for compressing gas in a radial direction is integrally formed on the rotor part constituting a part of the gas bearing 40, i.e. the upper rotating member (upper rotating part) 42. Because the minute clearance of the gas bearing 40 and the minute clearance of the centrifugal blades are in the same thrust direction, the blade clearance of the centrifugal blade element 42*a* can be set to be substantially equal to the clearance of the gas bearing 40 or to be slightly larger than the clearance of the gas bearing 40. Specifically, because the centrifugal blade element 42*a* for compressing gas in the radial direction is formed on the upper rotating member (upper rotating part) 42, the upper rotating member (upper rotating part) 42 constitutes a centrifugal blade as well as a part of the gas bearing 40 for axial positioning of the rotor. In this manner, since the centrifugal blade element 42*a* for compressing gas in the radial direction is formed on the upper rotating member (upper rotating part) 42 for axial positioning of the rotor, the blade clearance of the centrifugal blade element 42*a* can be controlled with high accuracy.

When the rotor including the main shaft 1 and the rotor blades fixed to the main shaft 1 is levitated at the center of the axial direction of the gas bearing 40, the clearance of the gas bearing 40 is taken as δd, and the blade clearance is taken as δe. Then, it is suitable from the aspect of reliability against contact of blade portions and evacuation performance of blade that the difference (δe−δd) between the clearance δe and the clearance δd is set to about 10 to 30% of the total clearance 2δd (i.e. δdu+δd1) in the gas bearing 40. Specifically, it is desirable to set δe−δd=(0.1~0.3)×(2δd).

In FIG. 2, the state in which the rotor is levitated at the center of the axial direction of the gas bearing 40 is shown, and the clearances are expressed as δdu (=δd), δd1 (=δd).

The reason why the evacuation performance of the turbo blade element is low at an atmospheric pressure range is that the blade clearance is large, and countercurrent flow is more likely to occur at the atmospheric pressure range. According to the present invention, the blade clearance can be arranged to be smaller, and compression capability at the atmospheric pressure range can be greatly improved.

Further, in the turbo vacuum pump according to the present embodiment, the centrifugal blade elements 42*a*, 32*a* and 22*a* for compressing and evacuating gas in a radial direction are axially disposed in a multistage manner, and the blade clearances of the centrifugal blade elements 32*a* and 22*a* are getting gradually larger from the discharge side to the intake side. In order to compress gas from ultra-high vacuum to atmospheric pressure, it is necessary to arrange a plurality of blades in a multistage manner. If the temperature of the rotor blade is compared with the temperature of the stator blade, the temperature of the rotor blade should be higher than the temperature of the stator blade. Therefore, if the clearance of the adjacent blades in each stage is equal to each other in the multistage blades, the difference in thermal expansion between the rotor blade and the stator blade is developed due to a temperature difference between the rotor blade and the stator blade, and the clearances of the adjacent blades at the upstream side become gradually narrower. Thus, contact of the adjacent blades is liable to occur. Therefore, it is necessary to adjust the blade clearance in each stage in consideration of the temperature difference. However, because the blade clearance in each stage is extremely small, measurement and adjustment of the blade clearances in all stages is troublesome and time-consuming, and thus assembly time is prolonged. Therefore, it is desirable that the blade clearances are arranged to be getting gradually larger from the discharge side to the intake side.

Figure 4:
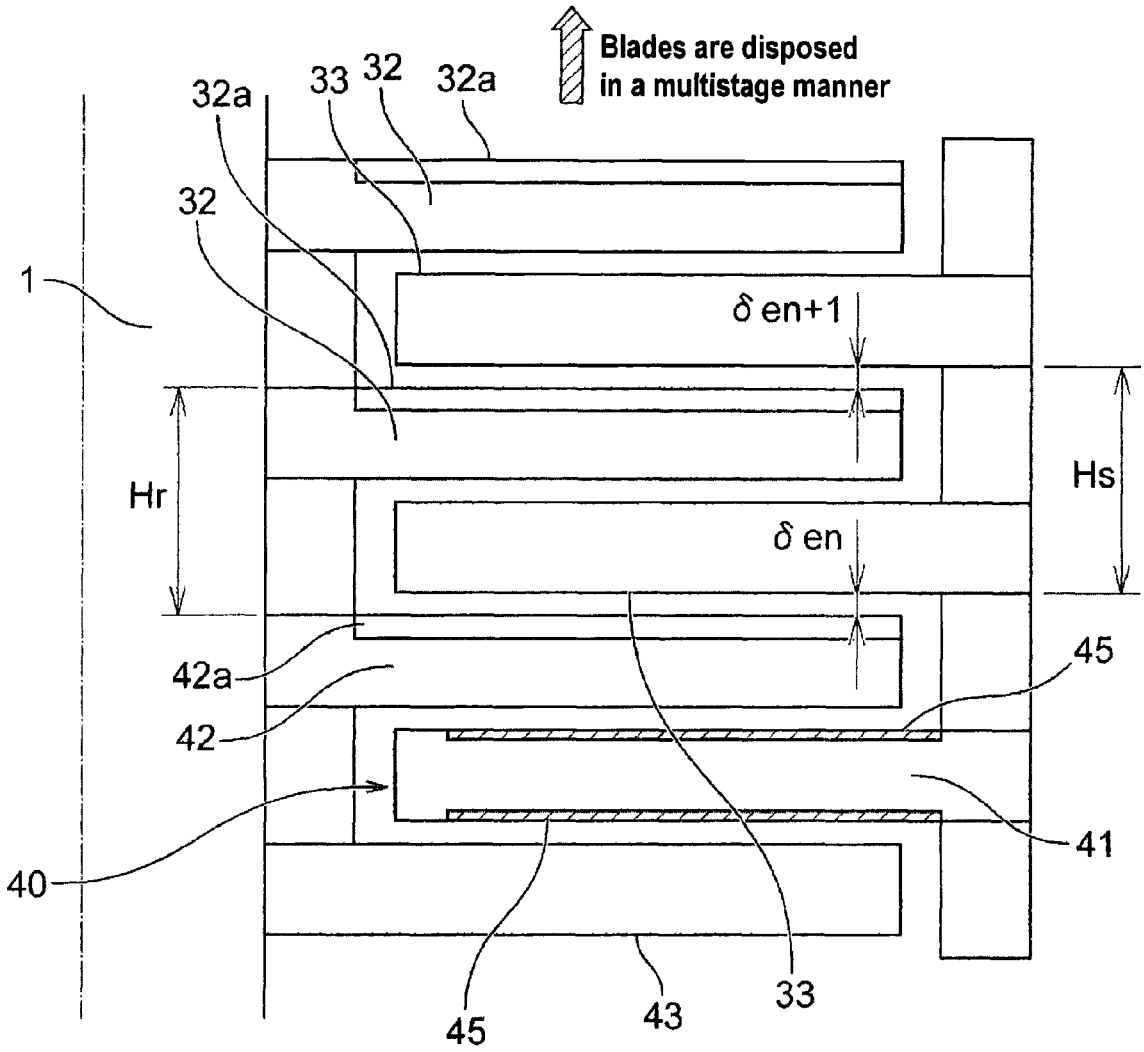
FIG. 4 is an enlarged view showing a pumping section in which blade clearances are arranged to be gradually larger from the discharge side to the intake side.

FIG. 4 is an enlarged view showing a pumping section in which the blade clearances are arranged to be getting gradually larger from the discharge side to the intake side. Assuming that the number of stages of the centrifugal blades is five, the relationship of the blade clearances will be described with reference to FIG. 4. In the case where n is taken as the number of stages of the centrifugal blades, the centrifugal blade stage closest to the gas bearing 40 is expressed as n=1 and the blade clearance is expressed as δe1. In this case, the blade clearances are expressed as δe1 to δe5, and the relationship of δe1 to δe5 are set as follows:

δe1≦δe2≦δe3≦δe4≦δe5 (the relationship in which all the blade clearances are equal, i.e. δe1=δe2=δe3=δe4=δe5 is excluded).

Further, FIG. 4 shows the relationship of axial thicknesses of the stator blades with respect to the axial thicknesses of the rotor blades. As shown in FIG. 4, in the turbo vacuum pump according to the present embodiment, the centrifugal blade elements for compressing and evacuating gas in a radial direction are axially disposed in a multistage manner, and the axial thickness of the stator blade is thicker than the axial thickness of the rotor blade having the centrifugal blade element by about 10 to 50% of the blade clearance which is formed in the axial direction. Specifically, in the case where the axial thickness of the rotor blade (the upper rotating member 42, the centrifugal blade 32 and the centrifugal blade 22) having the centrifugal blade element in the pumping section 10 is taken as Hr and the axial thickness of the stator blade 23, 33 is taken as Hs, Hs−Hr is set to about 10 to 50% of the total clearance 2δd (i.e. δdu+δd1) of the gas bearing 40. Further, in the case where n is taken as the number of stages of the centrifugal blades, and the centrifugal blade stage closest to the gas bearing 40 is taken as n=1, the relationship between the blade clearance $\delta_{e\,n}$ of nth centrifugal blade stage from the gas bearing 40 and the blade clearance $\delta_{en+1}$ of (n+1) th centrifugal blade stage from the gas bearing 40 is expressed in the following equation.

$$\delta_{en+1}=\delta_{e\,n}+(Hs-Hr)$$

In order to compress gas from ultra-high vacuum to atmospheric pressure, it is necessary to arrange a plurality of blades in a multistage manner. If the temperature of the rotor blade is compared with the temperature of the stator blade, the temperature of the rotor blade is naturally higher than the temperature of the stator blade. Therefore, if the clearance in each stage is equal to each other in the multistage blades, the difference in thermal expansion between the rotor blade and the stator blade is developed due to a temperature difference between the rotor blade and the stator blade, and the clearance between the rotor blade and the stator blade at the upstream side becomes gradually narrower. Thus, contact of the rotor blade and the stator blade is liable to occur. Therefore, it is necessary to adjust the blade clearance in each stage in consideration of the temperature difference. However, because the blade clearance in each stage is extremely small, measurement and adjustment of the clearances in all stages is troublesome and time-consuming, and thus assembly time is prolonged.

Therefore, the axial thickness of the stator blade is set to be thicker than the axial thickness of the rotor blade. Then, as the number of stages increases, the blade clearance increases accordingly. For example, the axial thickness of the stator blade is set to be thicker than the axial thickness of the rotor blade by t μm. In this case, assuming that the blade clearance of the centrifugal blade stage closest to the gas bearing 40 is taken as CLμm, the blade clearance at the next stage becomes CLμm+t μm, and then the blade clearance at the stage after the next becomes CLμm+t μm+t μm. As the number of stages increases, the blade clearance increases accordingly. This dimensional difference may be determined in consideration of the temperature difference between the rotor blade and the stator blade. If the rotor blade and the stator blade are composed of different materials, the difference in these coefficients of linear expansion must be taken into consideration.

As the dimensional difference becomes larger, the clearance at the upstream side becomes larger, and the degree of impact on performance degradation becomes larger. This dimensional difference is determined from the viewpoints of assembling performance, reliability against contact of blades and evacuation performance, and is preferably set to about 10 to 50% of the blade clearance of the lowermost stage (atmospheric pressure side).

Figure 5:
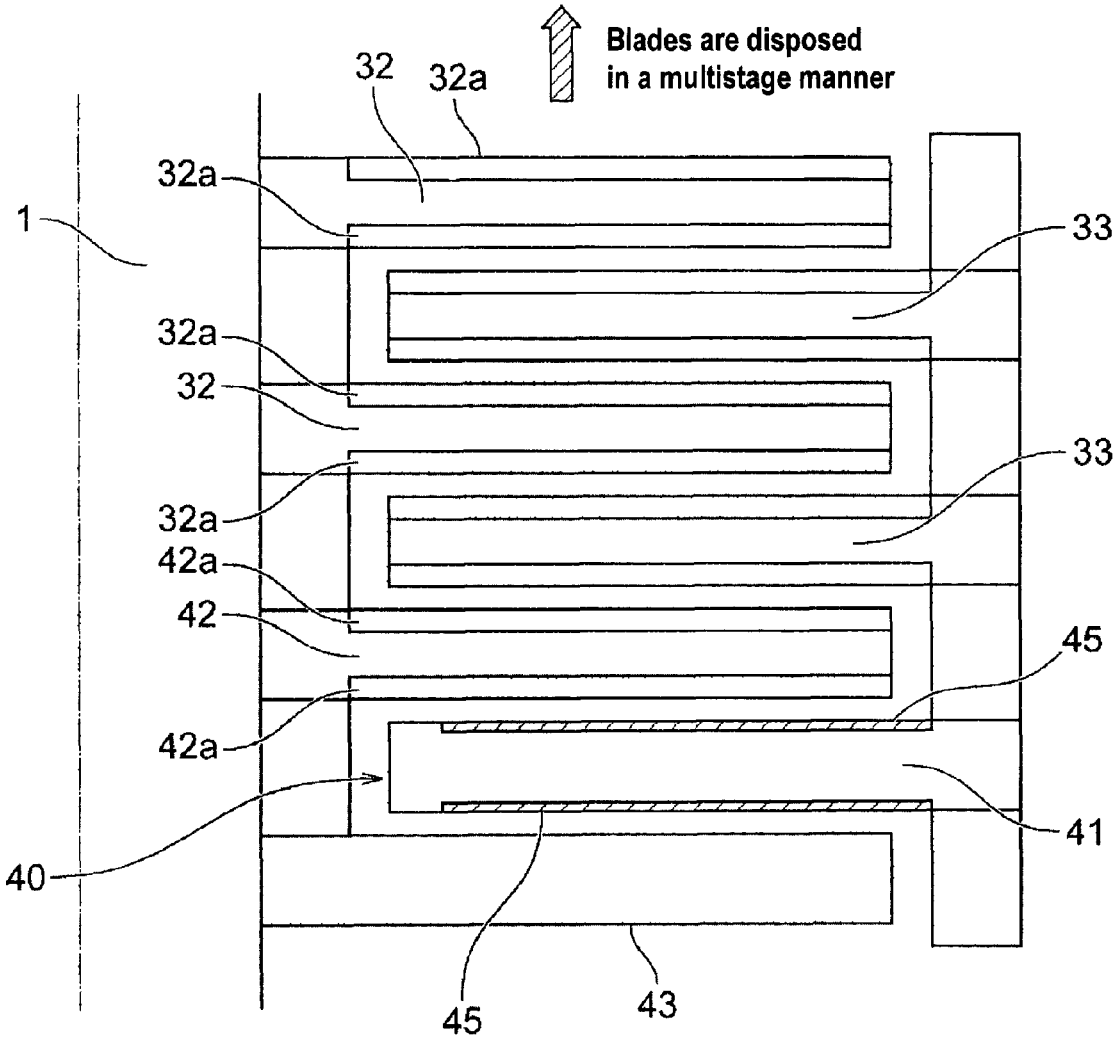
FIG. 5 is an enlarged view showing a pumping section in which centrifugal blade elements are formed on both of a surface for forming minute axial clearance at a rotor blade side and its opposite surface.

FIG. 5 is an enlarged view showing a pumping section in which centrifugal blade elements are formed on both of a surface for forming minute axial clearance at the rotor blade side and its opposite surface. As shown in FIG. 5, in the turbo vacuum pump according to the present embodiment, the centrifugal blade elements 32*a* (42*a*) comprising centrifugal blade grooves for compressing and evacuating gas in a radial direction are formed on both of a surface for forming minute axial clearance at the rotating blade side and its opposite surface.

In order to arrange a plurality of blades in a multistage manner, it would be better to make the accuracy of parts as high as possible. The centrifugal blade element 32*a* (42*a*) comprising centrifugal blade grooves for compressing and evacuating gas in a radial direction is formed on the surface for evacuating gas from an inner circumferential side to an outer circumferential side. That is, the centrifugal blade element 32*a* (42*a*) is formed in a direction in which a centrifugal force acts. However, if the centrifugal blade element is formed on a single surface, the centrifugal blade surface is liable to be bent and deformed, and it is necessary to correct the bent or deformed surface. If the same centrifugal blade grooves are formed in the surface opposite to the surface on which the centrifugal blade grooves are formed, bending or deformation of the surface can be reduced. That is, centrifugal blade grooves constituting the centrifugal blade element 42*a*, 22*a*, 32*a* are formed in both surfaces of each of the upper rotating member (upper rotating part) 42, the centrifugal blade 22, and the centrifugal blade 32. Further, the centrifugal blade grooves formed in the surface opposite to the surface for evacuating gas from the inner circumferential side to the outer circumferential side are formed at an angle for directing gas from the outer circumferential side to the inner circumferential side, and have an effect of compressing gas. However, the compression effect of the centrifugal blade grooves for directing gas from the outer circumferential side to the inner circumferential side is smaller than that of the centrifugal blade grooves formed in the normal surface, because compression is made in a direction contrary to the centrifugal force.

Figure 6:
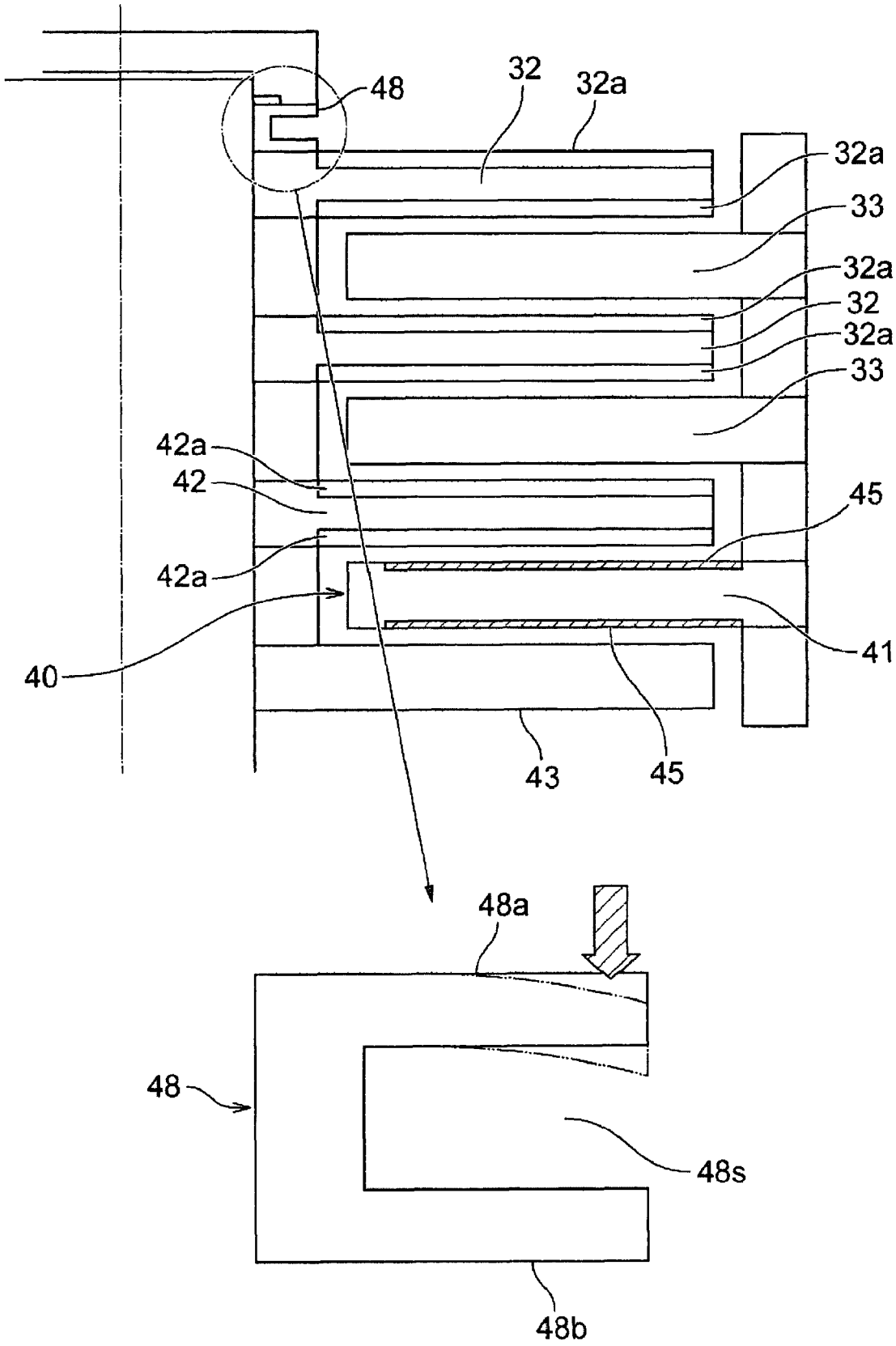
FIG. 6 is an enlarged view showing the configuration for fastening multistage centrifugal blade elements in an axial direction.

FIG. 6 is an enlarged view showing the configuration for fastening multistage centrifugal blade elements in an axial direction. As shown in FIG. 6, in the turbo vacuum pump according to the present embodiment, an elastic deformation structure 48 is provided as a part of the members for fastening the multistage centrifugal blade elements 32*a*, 42*a* in an axial direction. The elastic deformation structure 48 comprises a ring-shaped spacer, and has a slit 48*s* at the central portion of the elastic deformation structure 48 so that an upper part 48*a* and a lower part 48*b* are easily deformable.

In the turbo vacuum pump according to the present embodiment, in order to form extremely minute blade clearance, ceramics are suitable for materials of respective parts. The rotor blade is preferably composed of silicon nitride ceramics having high strength, and the stator blade is preferably composed of silicon carbide ceramics having high thermal conductivity. The stator blade may be composed of alumina ceramics. In the case where the rotor blade is composed of a material having a small coefficient of linear expansion (about $3\times10^{-6}$/°C.) such as ceramics, and the main shaft is composed of stainless steel (martensitic stainless steel), because the coefficient of linear expansion of stainless steel (martensitic stainless steel) is about $10\times10^{-6}$/°C., loosening of the fastened portion is liable to occur during the temperature rise caused by rotation of the rotor due to the difference in the coefficient of linear expansion. Therefore, as shown in FIG. 6, an elastic deformation structure 48 is provided as a part of the members for fastening the multistage centrifugal blade elements 32*a*, 42*a* in an axial direction. When the rotor blades are fastened in an axial direction, as shown by broken lines of FIG. 6, an axial deformation is imparted to the elastic deformation structure 48 in advance. Thus, loosening of the rotor blades caused by thermal deformation can be prevented. The elastic deformation structure 48 is preferably composed of aluminum alloy. The aluminum alloy has a large coefficient of linear expansion ($23\times10^{-6}$/°C.), and is ductile material.

Next, the blade elements of the pumping section 10 will be described in detail.

Figure 7A:
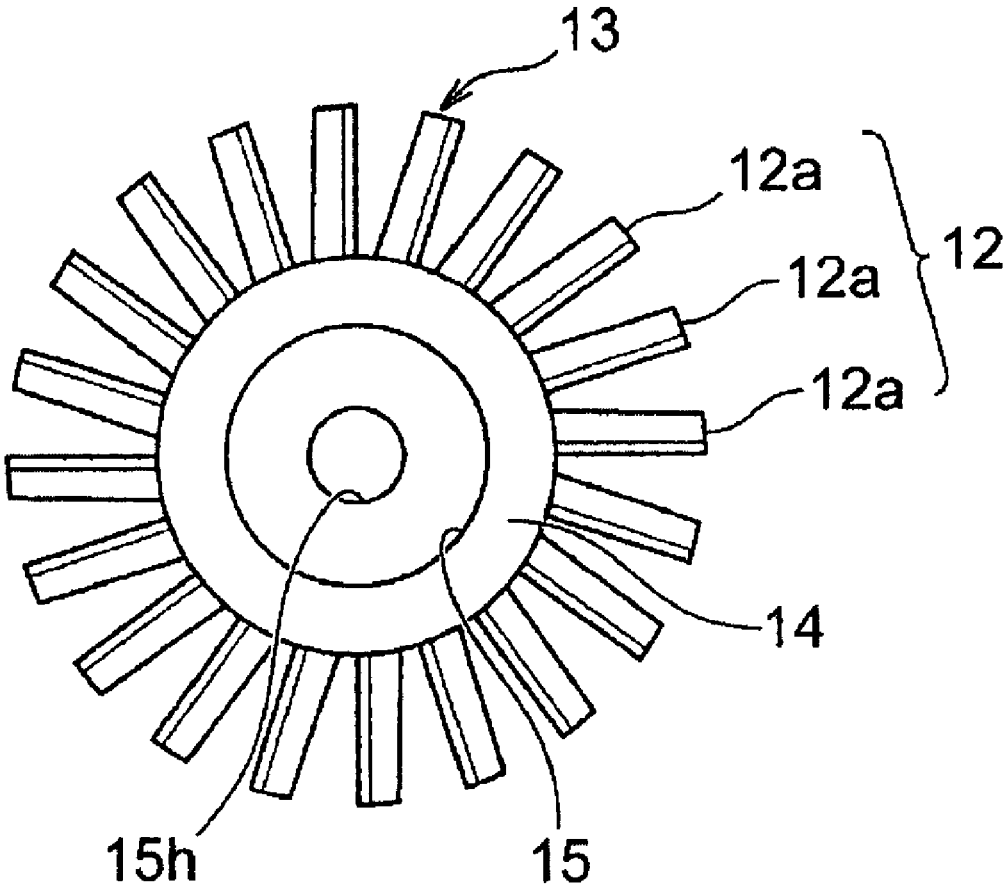
FIG. 7A is a plan view showing a turbine blade unit of a turbine blade pumping section, as viewed from the intake port side, and showing only an uppermost stage turbine blade closest to an intake port of a casing.
Figure 7B:
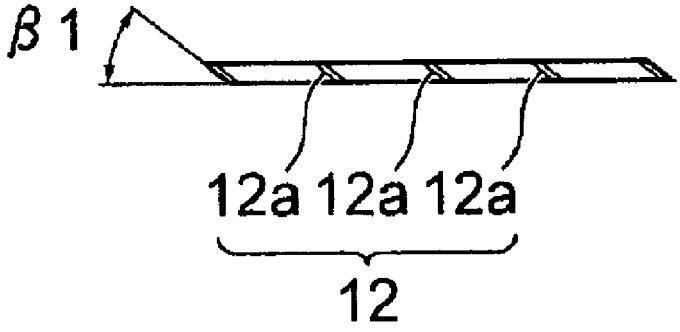
FIG. 7B is a plan view, partially developed on a plane, of the turbine blade, as viewed radially toward the center thereof.

FIGS. 7A and 7B are views showing the configuration of the turbine blade unit 13 of the turbine blade pumping section 11. FIG. 7A is a plan view showing the turbine blade unit 13, as viewed from the intake port side, and showing only the uppermost stage turbine blade 12 closest to the intake port of the casing 2. FIG. 7B is a plan view, partially developed on a plane, of the turbine blade 12, as viewed radially toward the center thereof. As shown in FIGS. 7A and 7B, the turbine blade unit 13 has a boss part 14 and turbine blades 12. Each of the turbine blades 12 has a plurality of plate-like vanes 12*a* radially extending from the outer periphery of the boss part 14. The boss part 14 has a hollow part 15 and a through hole 15*h*. Each vane 12*a* is attached with a twist angle of β1 (10° to 40°, for example) with respect to the central axis of the main shaft 1.

The other turbine blades 12 have the same configuration as the uppermost stage turbine blade 12. The number of the vanes 12*a*, the twist angle β1 of the vanes 12*a*, the outer diameter of the portion of the boss part 14 to which the vanes 12*a* are attached, and the length of the vanes 12*a* may be changed as needed.

Figure 8A:
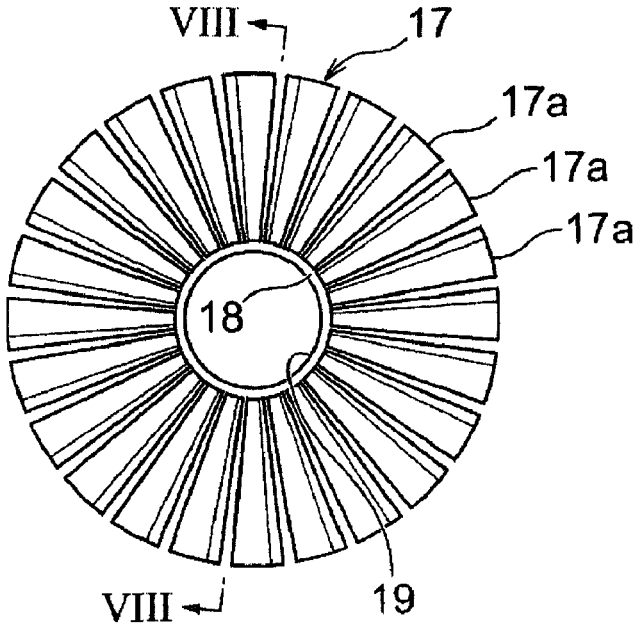
FIG. 8A is a plan view of an uppermost stage stator blade closest to the intake port of the casing, as viewed from the intake port side.
Figure 8B:
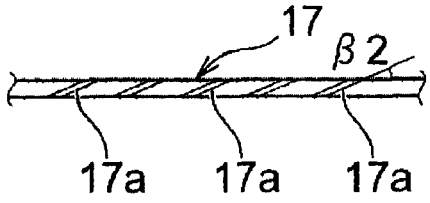
FIG. 8B is a plan view, partially developed on a plane, of the stator blade, as viewed radially toward the center thereof.
Figure 8C:
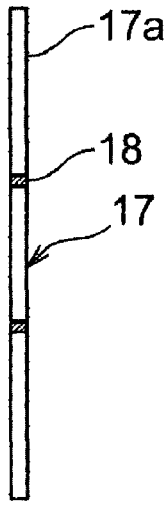
FIG. 8C is a cross-sectional view taken along the line VIII-VIII of FIG. 8A.

FIGS. 8A, 8B and 8C are views showing the configuration of the stator blade 17 of the turbine blade pumping section. FIG. 8A is a plan view of the uppermost stage stator blade 17 closest to the intake port 5 of the casing 2, as viewed from the intake port side. FIG. 8B is a plan view, partially developed on a plane, of the stator blade 17, as viewed radially toward the center thereof. FIG. 8C is a cross-sectional view taken along the line VIII-VIII of FIG. 8A. The stator blade 17 has a ring-shaped portion 18 with an annular shape, and plate-like vanes 17*a* radially extending from the outer periphery of the ring-shaped portion 18. The inner periphery of the ring-shaped portion 18 defines a shaft hole 19, and the main shaft 1 (shown in FIG. 1) passes through the shaft hole 19. Each vane 17*a* is attached with a twist angle of β2 (10° to 40°, for example) with respect to the central axis of the main shaft 1. The other stator blades 17 have the same configuration as the uppermost stage stator blade 17. The number of the vanes 17*a*, the twist angle β2 of the vanes 17*a*, the outer diameter of the ring-shaped portion 18 and the length of the vanes 17*a* may be changed as needed.

Figure 9A:
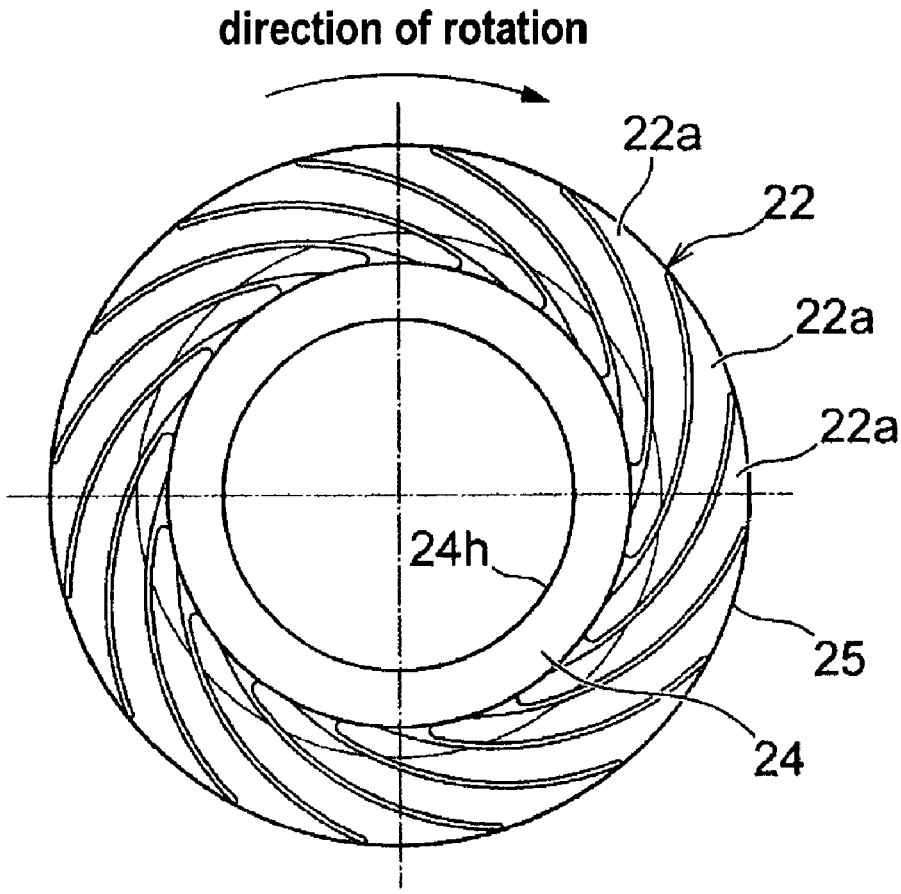
FIG. 9A is a plan view showing a centrifugal blade of a first centrifugal blade pumping section, and showing the uppermost stage turbine blade closest to the intake port of the casing.
Figure 9B:
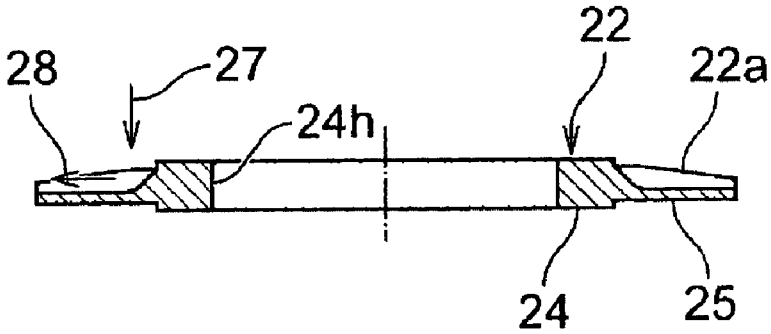
FIG. 9B is a front cross-sectional view showing the centrifugal blade of the first centrifugal blade pumping section.

FIGS. 9A and 9B are views showing the configuration of the centrifugal blade 22 of the first centrifugal blade pumping section 21. FIG. 9A is a plan view of the uppermost stage centrifugal blade 22 closest to the intake port 5 of the casing 2, and FIG. 9B is a front cross-sectional view of the centrifugal blade 22. The centrifugal blade 22 serving as a centrifugal blade located at the high-vacuum side has a generally disk-shaped base part 25 having a boss part 24, and a centrifugal blade element 22*a* formed on a surface of the base part 25. The boss part 24 has a through hole 24*h*, and the main shaft 1 passes through the through hole 24*h*. The centrifugal blade 22 is rotated in a clockwise direction in FIG. 9A.

The centrifugal blade element 22*a* comprises spiral centrifugal grooves as shown in FIG. 9A. The spiral centrifugal grooves constituting the centrifugal blade element 22*a* extend in such a direction as to cause the gas to flow counter to the direction of rotation (in a direction opposite to the direction of rotation). Each of the spiral centrifugal grooves extends from an outer peripheral surface of the boss part 24 to an outer periphery of the base part 25. The other centrifugal blades 22 have the same configuration as the uppermost stage centrifugal blade 22. The number and shape of the centrifugal grooves, the outer diameter of the boss part 24, and the length of flow passages defined by the centrifugal grooves may be changed as needed.

Figure 10A:
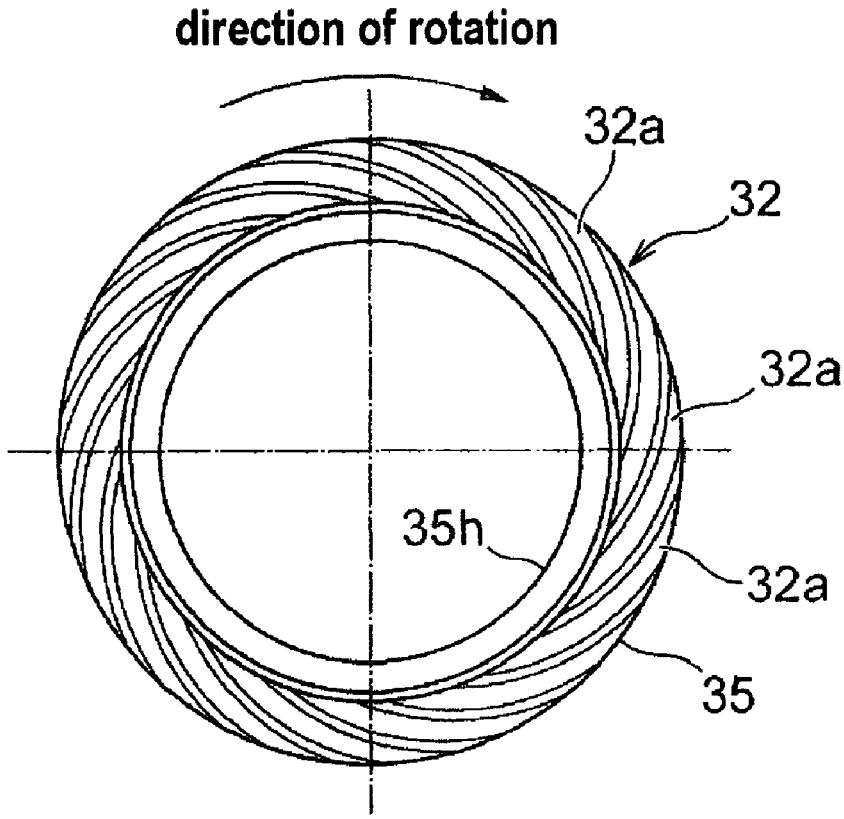
FIG. 10A is a plan view showing a centrifugal blade of a second centrifugal blade pumping section, and showing the uppermost stage turbine blade closest to the intake port of the casing.
Figure 10B:
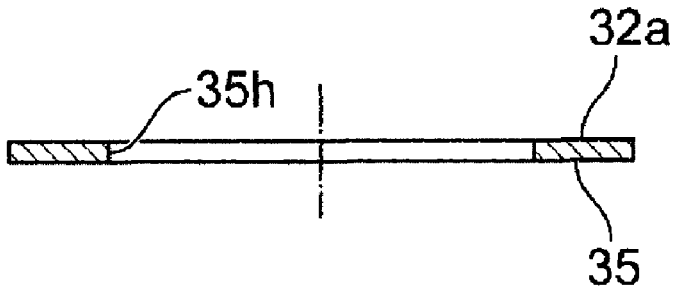
FIG. 10B is a front cross-sectional view showing the centrifugal blade of the second centrifugal blade pumping section.

FIGS. 10A and 10B are views showing the configuration of the centrifugal blades 32 of the second centrifugal blade pumping section 31. FIG. 10A is a plan view of the uppermost stage centrifugal blade 32 closest to the intake port 5 of the casing 2, and FIG. 10B is a front cross-sectional view of the centrifugal blade 32. The centrifugal blade 32 serving as a centrifugal blade located at the atmospheric pressure side has a generally disk-shaped base part 35, and a centrifugal blade element 32*a* formed on a surface of the base part 35. The base part 35 has a through hole 35*h*, and the main shaft 1 passes through the through hole 35*h*. The centrifugal blade 32 is rotated in a clockwise direction in FIG. 10A.

The centrifugal blade element 32*a* comprises spiral centrifugal grooves as shown in FIG. 1A. The spiral centrifugal grooves constituting the centrifugal blade element 32*a* extend in such a direction as to cause the gas to flow counter to the direction of rotation (in a direction opposite to the direction of rotation). Each of the spiral centrifugal grooves extends from an inner peripheral portion to an outer periphery of the generally disk-shaped base part 35. The other centrifugal blades 32 have the same configuration as the uppermost stage centrifugal blade 32. The number and shape of the centrifugal grooves, and the length of flow passages defined by the centrifugal grooves may be changed as needed.

As shown in FIGS. 9 and 10, in the case where the centrifugal blade 32 at the atmospheric pressure side is compared with the centrifugal blade 22 at the high-vacuum side, the grooves of the centrifugal blade element 32*a* of the centrifugal blade 32 at the atmospheric pressure side are set to be shallow (or the height of projections is set to be low), and the grooves of the centrifugal blade element 22*a* of the centrifugal blade 22 at the high-vacuum side are set to be deep (or the height of projections is set to be high). Specifically, as vacuum is higher, the centrifugal grooves of the centrifugal blade element are deeper (or the height of projections is higher). In short, as the degree of vacuum is higher, the evacuation velocity of the centrifugal blade is higher.

Next, the bearing and motor section 50 will be described in detail. As shown in FIG. 1, the bearing and motor section 50 comprises a motor 51 for rotating the main shaft 1, an upper radial magnetic bearing 53 and a lower radial magnetic bearing 54 for rotatably supporting the main shaft 1 in a radial direction, and an upper thrust magnetic bearing 56 for attracting the rotor in an axial direction. The motor 51 comprises a high-frequency motor. The upper radial magnetic bearing 53, the lower radial magnetic bearing 54 and the upper thrust magnetic bearing 56 comprise an active magnetic bearing. In order to prevent the rotor blade and the stator blade from being brought into contact with each other when an abnormality occurs in one of the magnetic bearings 53, 54, 56, an upper touchdown bearing 81 and a lower touchdown bearing 82 are provided to support the main shaft 1 in a radial direction and an axial direction. The upper thrust magnetic bearing 56 is configured to attract a target disk 58 by electromagnet.

Next, the operation of the turbo vacuum pump shown in FIGS. 1 through 10 will be described in detail.

When the turbine blades 12 of the turbine blade pumping section 11 rotates, gas is introduced in the axial direction of the pump through the intake port 5 of the pump. The turbine blade 12 increases the evacuation velocity (discharge rate) and allows a relatively large amount of gas to be evacuated. The gas introduced from the intake port 5 passes through the uppermost turbine blade 12, and is then decreased in speed and increased in pressure by the stator blade 17. The gas is then discharged in the axial direction by the downstream turbine blades 12 and the downstream stator blades 17 in the same manner.

The gas flowing from the turbine blade pumping section 11 into the first centrifugal blade pumping section 21 is introduced into the uppermost stage centrifugal blade 22 and flows toward the outer peripheral part along the surface of the base part 25 of the centrifugal blade 22, and is compressed and discharged by a reciprocal action of the uppermost stage centrifugal blade 22 and the uppermost stage stator blade 23, that is, by a drag effect caused by the viscosity of the gas and a centrifugal effect caused by the rotation of the centrifugal blade element 22*a*. Specifically, the gas drawn by the uppermost stage centrifugal blade 22 is introduced in a generally axial direction 27 shown in FIG. 9B relative to the centrifugal blade 22, flows in a centrifugal direction 28 through the spiral centrifugal grooves toward the outer periphery of the centrifugal blade 22, and is compressed and discharged.

The gas compressed radially outward by the uppermost stage centrifugal blade 22 flows toward the uppermost stage stator blade 23, is directed in a generally axial direction by the inner peripheral surface of the stator blade 23, and flows into a space having the spiral guides (not shown) provided on the surface of the stator blade 23. By the rotation of the uppermost stage centrifugal blade 22, the gas flows toward the inner peripheral part along the surface of the uppermost stage stator blade 23 by a drag effect of the spiral guides of the stator blade 23 and the reverse side of the base part 25 of the uppermost stage centrifugal blade 22 caused by the viscosity of the gas, and is compressed and discharged. The gas having reached the inner peripheral part of the uppermost stage stator blade 23 is directed in the generally axial direction by the outer peripheral surface of the boss part 24 of the uppermost stage centrifugal blade 22, and flows toward the downstream centrifugal blade 22. Then, the gas is compressed and discharged in the same manner as described above by the downstream centrifugal blades 22 and the downstream stator blades 23.

The gas flowing from the first centrifugal blade pumping section 21 into the second centrifugal blade pumping section 31 is introduced into the uppermost stage centrifugal blade 32 and flows toward the outer peripheral part along the surface of the base part 35 of the uppermost stage centrifugal blade 32, and is compressed and discharged by a reciprocal action of the uppermost stage centrifugal blade 32 and the uppermost stage stator blade 33, that is, by a drag effect caused by the viscosity of the gas and a centrifugal effect caused by the rotation of the centrifugal blade element 32*a*. Then, the gas flows toward the uppermost stage stator blade 33, is directed in a generally axial direction by the inner peripheral surface of the stator blade 33, and flows into a space having the spiral guides (not shown) provided on the surface of the stator blade 33. By the rotation of the uppermost stage centrifugal blade 32, the gas flows toward the inner peripheral part along the surface of the uppermost stage stator blade 33 by a drag effect of the spiral guides of the stator blade 33 and the reverse side of the base part 35 of the uppermost stage centrifugal blade 32 caused by the viscosity of the gas, and is compressed and discharged. The gas having reached the inner peripheral part of the uppermost stage stator blade 33 is directed in the generally axial direction, and flows toward the downstream centrifugal blade 32. Then, the gas is compressed and discharged in the same manner as described above by the downstream centrifugal blades 32 and the downstream stator blades 33. Thereafter, the gas discharged from the second centrifugal blade pumping section 31 is discharged from the discharge port 6 to the outside of the vacuum pump.

Figure 11:
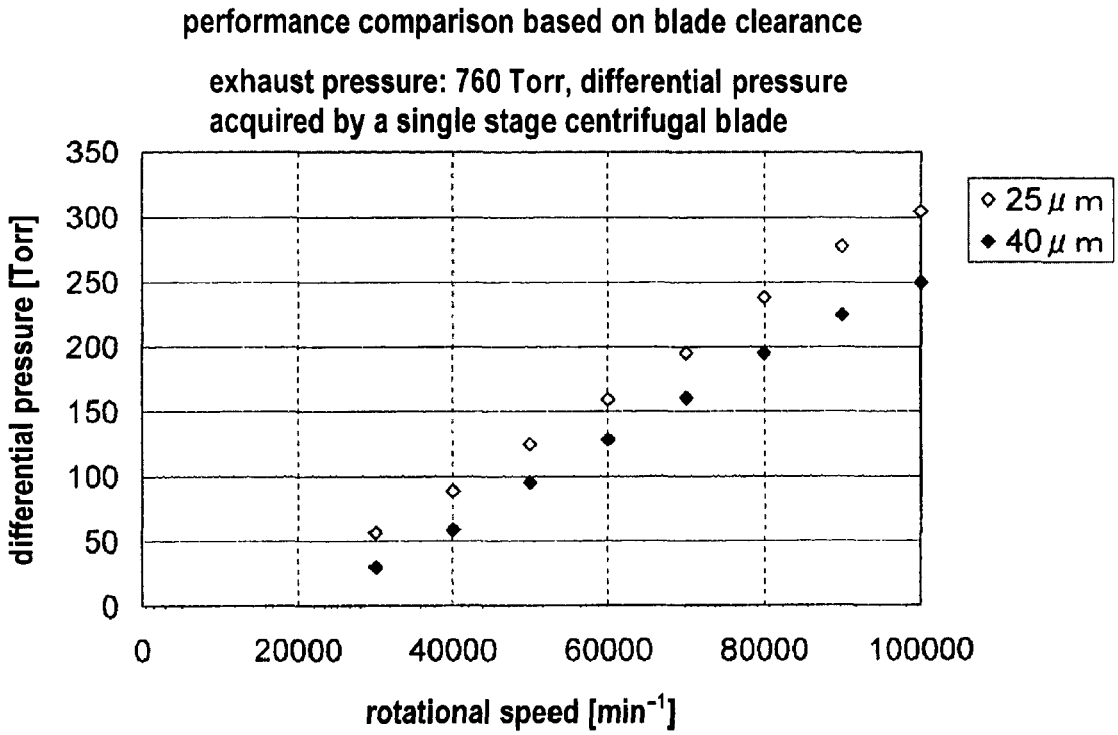
FIG. 11 is a graph showing performance comparison based on blade clearance in the turbo vacuum pump, and showing the relationship between differential pressure acquired by a single stage centrifugal blade and rotational speed at exhaust pressure of 760 Torr.

FIG. 11 is a graph showing performance comparison based on blade clearance in the turbo vacuum pump. FIG. 11 shows the relationship between differential pressure acquired by a single stage centrifugal blade and rotational speed. In FIG. 11, the horizontal axis represents rotational speed ($min^{-1}$) of the vacuum pump, and the vertical axis represents differential pressure (Torr). In FIG. 11, the case where blade clearance is 25 μm and the case where blade clearance is 40 μm are comparatively shown. As shown in FIG. 11, in the case where the blade clearance is 25 μm, the differential pressure of about 300 Torr can be acquired at the rotational speed of 100,000 rpm ($min^{-1}$) by a single stage centrifugal blade. In contrast, in the case where the blade clearance is 40 μm, the differential pressure of about 250 Torr can be acquired at the rotational speed of 100,000 rpm ($min^{-1}$) by a single stage centrifugal blade. Specifically, in the case where the blade clearance varies from 25 μm to 40 μm by 15 μm, the evacuation performance is lowered as shown in the graph. From this fact, the effect of the present invention in which the blade clearance can be set to be minute has been verified.

Figure 12:
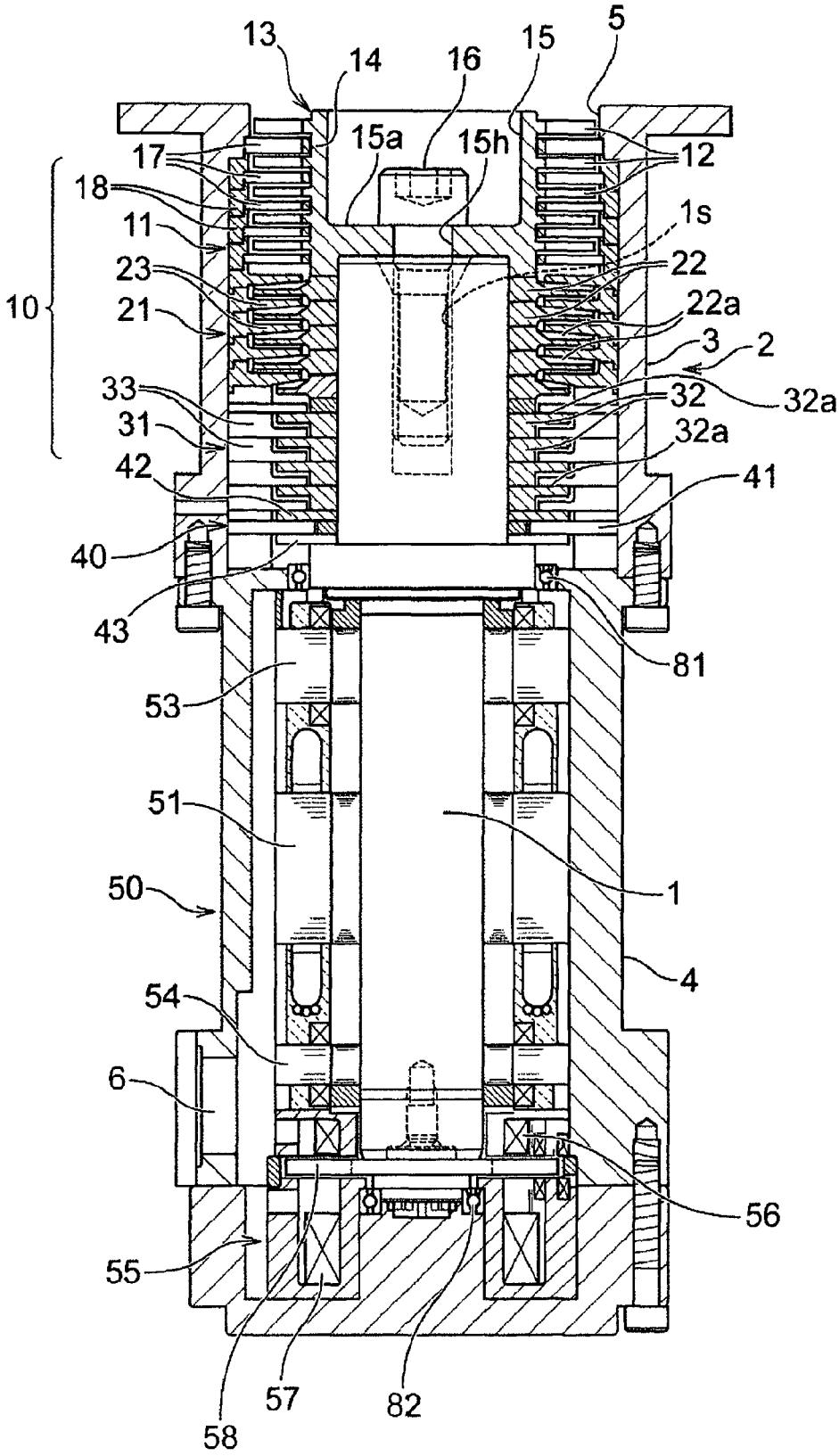
FIG. 12 is a vertical cross-sectional view showing a modified example of the first embodiment of the turbo vacuum pump according to the present invention.

FIG. 12 is a vertical cross-sectional view showing a modified example of the first embodiment of the turbo vacuum pump according to the present invention. As shown in FIG. 12, the turbo vacuum pump has a thrust magnetic bearing 55 for canceling out a thrust force generated by the differential pressure between the discharge side and the intake side by an evacuation action of the pumping section 10. The thrust magnetic bearing 55 comprises an upper thrust magnetic bearing 56 having electromagnet, a lower thrust magnetic bearing 57 having electromagnet, and a target disk 58 fixed to the lower part of the main shaft 1. In the thrust magnetic bearing 55, the target disk 58 is held between the upper thrust magnetic bearing 56 and the lower thrust magnetic bearing 57, and the target disk 58 is attracted by the electromagnets of the upper and lower thrust magnetic bearings 56, 57 to cancel out a thrust force generated by the differential pressure between the discharge side and the intake side by an evacuation action of the pumping section 10. The other structure of the turbo vacuum pump shown in FIG. 12 is the same as the structure of the turbo vacuum pump shown in FIG. 1.

According to the above embodiments of the present invention, the magnetic bearings are used as radial bearings, but the gas bearings may be used. Further, the present invention has advantages at the atmospheric pressure range. At the upstream side of the blade element in this atmospheric pressure range, at least one of a cylindrical thread groove rotor, a centrifugal blade, and a turbine blade which have been used in a conventional turbo-molecular pump under vacuum of about 10 Torr or less may be employed. The evacuation principle of the centrifugal blade used in this vacuum range is the same as that of the centrifugal blade having minute clearance according to the present invention. However, because the degree of vacuum is high compared to the atmospheric pressure range, and countercurrent flow is small, blade clearance (about 0.1 to 1 mm) of general turbo-molecular pump may be sufficient without requiring minute blade clearance as in the centrifugal blade operable at the atmospheric pressure range. If this centrifugal blade is composed of alumina alloy, the elastic deformation structure shown in FIG. 5 may be provided.

The gas bearing may be dynamic pressure type or static pressure type, and both types have the same effect on the present invention. However, in the case of the static pressure type gas bearing, it is necessary to provide a gas supply means provided at the outside of the vacuum pump.

The turbo vacuum pump according to the first embodiment of the present invention shown in FIGS. 1 through 12 has the following advantages:

(1) The gas bearing is used as a bearing for supporting the rotor including the main shaft and the rotor blades fixed to the main shaft in a thrust direction, and the centrifugal blade element for compressing gas in a radial direction is integrally formed on the rotor part constituting the gas bearing, i.e. the upper rotating member (upper rotating part). Therefore, the minute clearance of the gas bearing and the minute clearance of the centrifugal blades are in the same thrust direction, and thus the blade clearance of the centrifugal blade element can be set to be substantially equal to the clearance of the gas bearing. Therefore, the blade clearance of the centrifugal blade element can be controlled with high accuracy.

(2) The blade clearances of the centrifugal blade elements axially disposed in a multistage manner are arranged to be gradually larger from the discharge side to the intake side. Therefore, even if the difference in thermal expansion between the rotor blade and the stator blade is developed due to the temperature difference between the rotor blade and the stator blade, and the clearance between the rotor blade and the stator blade at the upstream side becomes gradually narrower, contact of the rotor blade and the stator blade can be prevented. Thus, it is not necessary to adjust the blade clearance in each stage in consideration of the temperature difference, and assembly time can be shortened.

(3) The axial thickness of the stator blade is set to be thicker than the axial thickness of the rotor blade. Then, as the number of stages increases, the blade clearance increases accordingly, and it is not necessary to adjust the blade clearance.

(4) Because the centrifugal blade grooves of the centrifugal blade element for compressing and evacuating gas in a radial direction are formed in both of a surface for forming minute axial clearance at the rotor blade side and its opposite surface, it is possible to reduce the bending or deformation of the surface. Thus, it is not necessary to correct the surface of the blade.

(5) The elastic deformation structure is provided as a part of the members for fastening the multistage centrifugal blade elements in an axial direction. When the rotor blades are fastened in an axial direction, an axial deformation is imparted to the elastic deformation structure in advance, and thus loosening of the rotor blades caused by thermal deformation can be prevented.

Next, a turbo vacuum pump according to a second embodiment of the present invention will be described below with reference to FIGS. 13 through 18. Like or corresponding parts are denoted by like or corresponding reference numerals throughout drawings and will not be described below repetitively.

Figure 13:
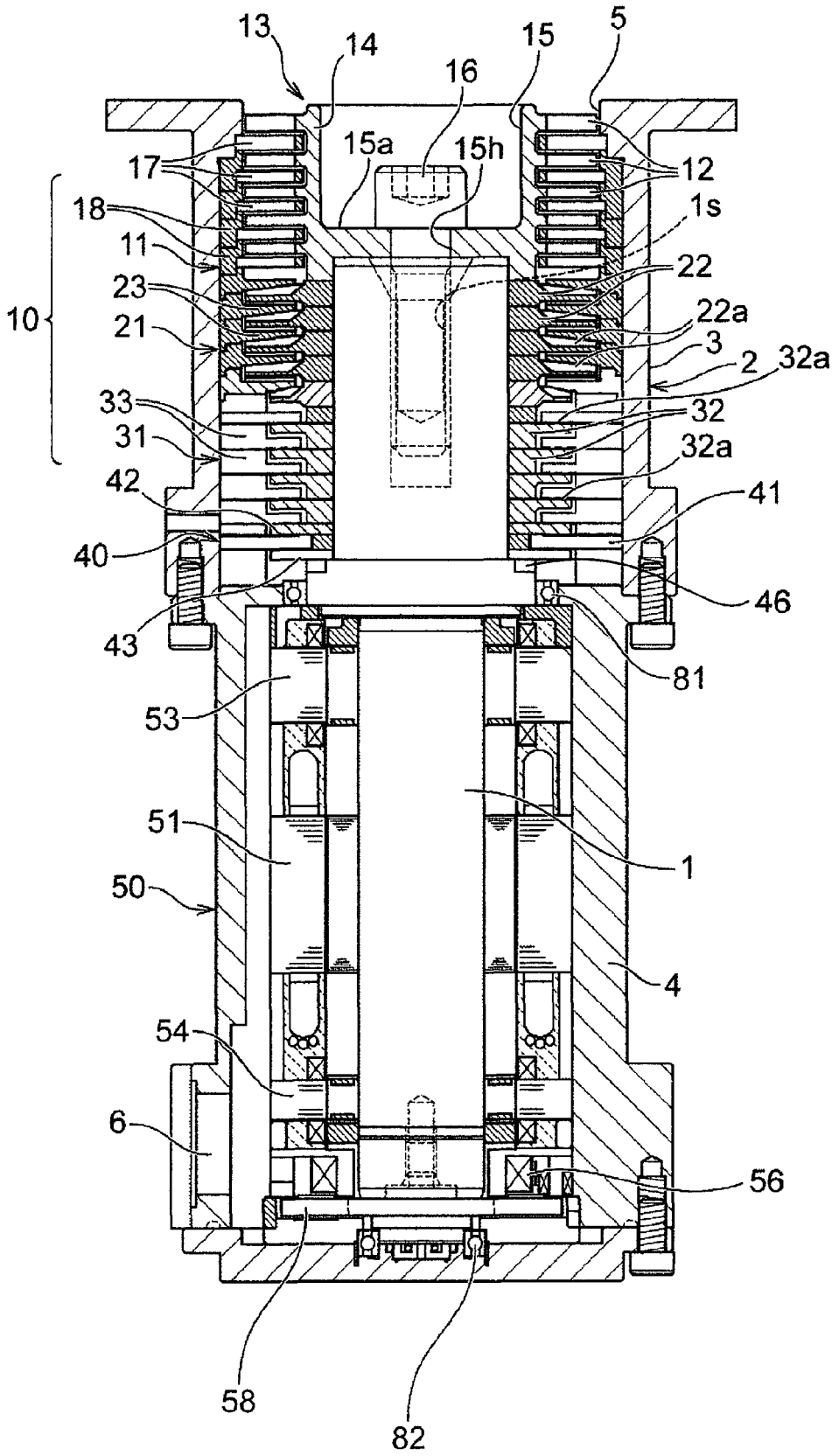
FIG. 13 is a cross-sectional view showing a turbo vacuum pump according to a second embodiment of the present invention.

FIG. 13 is a cross-sectional view showing a turbo vacuum pump according to the second embodiment of the present invention. As shown in FIG. 13, the turbo vacuum pump comprises a main shaft 1 extending over the substantially entire length of the pump, a pumping section 10 in which rotor blades and stator blades are alternately disposed in a casing 2, and a bearing and motor section 50 having a motor for rotating the main shaft 1 and bearings for rotatably supporting the main shaft 1. The casing 2 comprises an upper casing 3 for housing the pumping section 10 and a lower casing 4 for housing the bearing and motor section 50, and an intake port 5 is formed at the upper end portion of the upper casing 3 and a discharge port 6 is formed at the lower part of the lower casing 4. The main shaft 1 is composed of martensitic stainless steel or austenitic stainless steel.

The pumping section 10 comprises a turbine blade pumping section 11, a first centrifugal blade pumping section 21 and a second centrifugal blade pumping section 31 which are arranged in series from the intake port side to the lower part of the upper casing 3 in the same manner as the turbo vacuum pump shown in FIG. 1. The turbine blade pumping section 11, the first centrifugal blade pumping section 21 and the second centrifugal blade pumping section 31 have the same respective structures as those of the turbo vacuum pump shown in FIG. 1. In the turbine blade pumping section 11, the first centrifugal blade pumping section 21 and the second centrifugal blade pumping section 31, the rotor blades including the turbine blades 12, the centrifugal blades 22 and the centrifugal blades 32 are composed of ceramics such as silicon nitride ceramics having high strength, and the stator blades including the stator blades 17, the stator blades 23 and the stator blades 33 are composed of ceramics such as silicon carbide ceramics having high thermal conductivity. The stator blades may be composed of alumina ceramics. A gas bearing 40 is provided at immediately downstream side of the second centrifugal blade pumping section 31 to support the rotor including the main shaft 1 and the rotor blades 12, 22, 32 in a thrust direction fixed to the main shaft 1.

Figure 14:
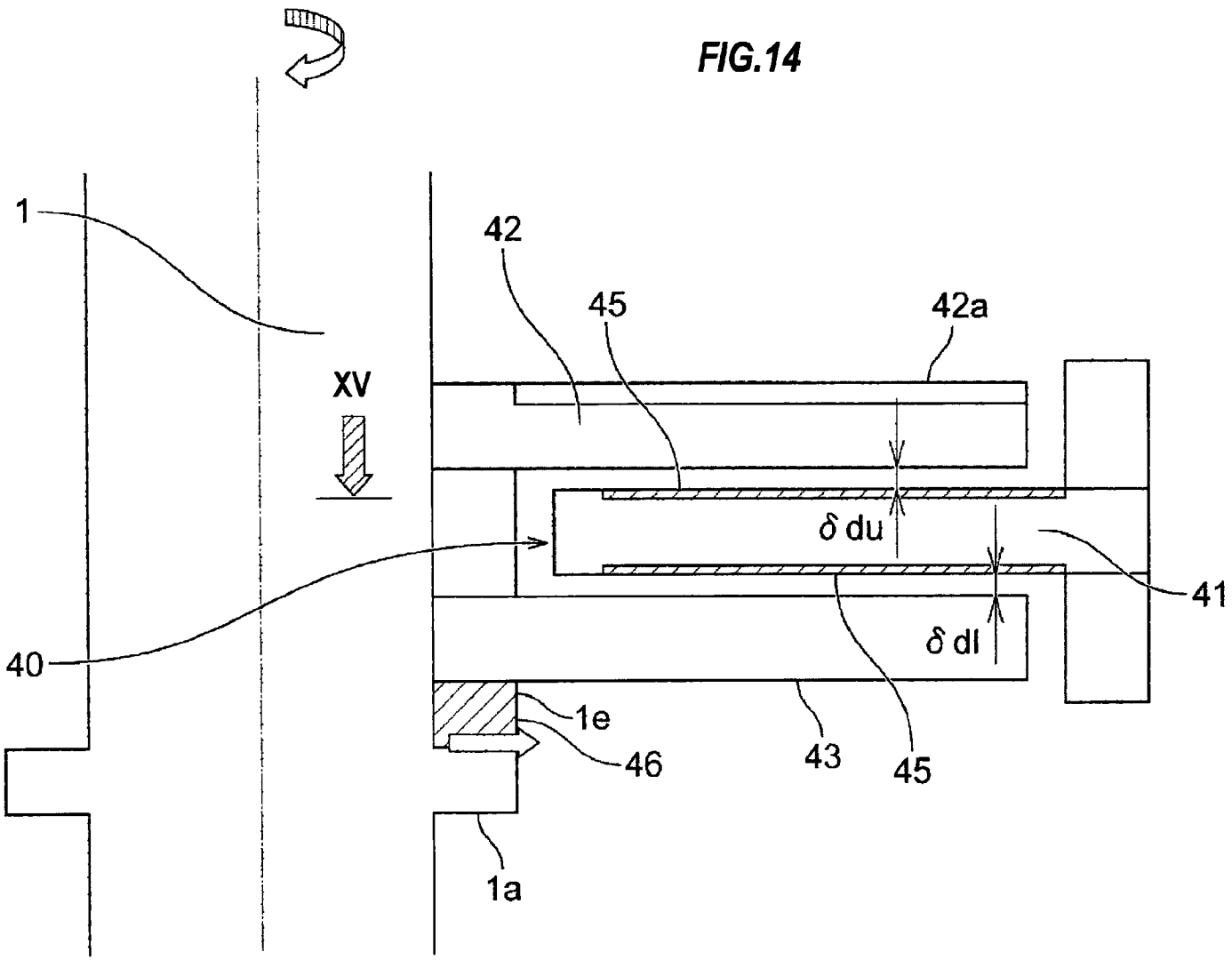
FIG. 14 is an enlarged view showing a gas bearing and peripheral part of the gas bearing.

FIG. 14 is an enlarged view showing the gas bearing 40 and peripheral part of the gas bearing 40. As shown in FIG. 14, the gas bearing 40 comprises a stationary member (stationary part) 41 fixed to the upper casing 3, and an upper rotating member (upper rotating part) 42 and a lower rotating member (lower rotating part) 43 which are disposed above and below the stationary member (stationary part) 41 so as to place the stationary member (stationary part) 41 between the upper rotating member (upper rotating part) 42 and the lower rotating member (lower rotating part) 43. The upper rotating member (upper rotating part) 42 and the lower rotating member (lower rotating part) 43 are fixed to the main shaft 1. Spiral grooves 45, 45 are formed in both surfaces of the stationary member 41 (stationary part).

Specifically, the stationary member (stationary part) 41 having the spiral grooves 45, 45 is placed between the upper and lower divided members (parts), i.e. the upper rotating member (upper rotating part) 42 and the lower rotating member (lower rotating part) 43. A centrifugal blade element 42*a* for compressing and evacuating gas in a radial direction is formed on a surface of the upper rotating member (upper rotating part) 42 having an opposite surface which faces the spiral grooves 45 of the stationary member (stationary part) 41. The centrifugal blade element 42*a* comprises centrifugal blade grooves for compressing and evacuating gas in a radial direction.

The rotor members including the upper rotating member (upper rotating part) 42 and the lower rotating member (lower rotating part) 43 are composed of ceramics such as silicon nitride ceramics having high strength, and the stator members including the stationary member (stationary part) 41 are composed of ceramics such as silicon carbide ceramics having high thermal conductivity. The stator members may be composed of alumina ceramics. Further, the main shaft 1 has a support portion 1*a* projecting radially outwardly from the outer peripheral surface of the main shaft, and a spacer 46 is provided between the lower rotating member (lower rotating part) 43 and an end face 1*e* of the support portion 1*a* of the main shaft 1.

In the case where the main shaft is composed of martensitic stainless steel or austenitic stainless steel and the rotor blades are composed of ceramics, if the end face of the main shaft 1 is brought into direct contact with the lower rotating member (lower rotating part) 43, then the lower rotating member (lower rotating part) 43 is radially stretched due to the difference in coefficient of linear expansion and is liable to be broken or damaged due to an increased internal stress.

As shown in FIG. 14, according to the present invention, since the spacer 46 is provided between the end face 1*e* of the main shaft 1 and the lower rotating member (lower rotating part) 43, the spacer 46 is smaller than the lower rotating member (lower rotating part) 43 in diameter, thus reducing the internal stress of the spacer 46. Further, since sliding occurs at the upper and lower surfaces of the spacer 46, the internal stress of the lower rotating member (lower rotating part) 43 is not increased.

In the case where the coefficients of linear expansion of the main shaft 1, the lower rotating member (lower rotating part) 43 and the spacer 46 are taken as $\lambda sf$ $\lambda d1$, $\lambda sp$, respectively, the material of the spacer 46 is set so as to be $\lambda sf > \lambda sp \geqq \lambda d1$. Specifically, the coefficient of linear expansion ($\lambda sp$) of the spacer 46 is set between the coefficient of linear expansion ($\lambda sf$) of the main shaft 1 and the coefficient of linear expansion ($\lambda d1$) of the lower rotating member (lower rotating part) 43, and hence an increase of the internal stress of the lower rotating member caused by thermal deformation can be suppressed. The material of the spacer 46 is preferably titanium alloy ($8.8\times10^{-6}$/°C.), alumina ceramics ($7.2\times10^{-6}$/°C.) and tungsten carbide ($5.8\times10^{-6}$/°C.).

Further, even if the coefficient of linear expansion ($\lambda sp$) of the spacer 46 is smaller than the coefficient of linear expansion ($\lambda sf$) of the main shaft 1 and is identical to the coefficient of linear expansion ($\lambda d1$) of the lower rotating member (lower rotating part) 43, the spacer 46 is smaller than the lower rotating member (lower rotating part) 43 in diameter, thus reducing the internal stress of the spacer 46.

Figure 15:
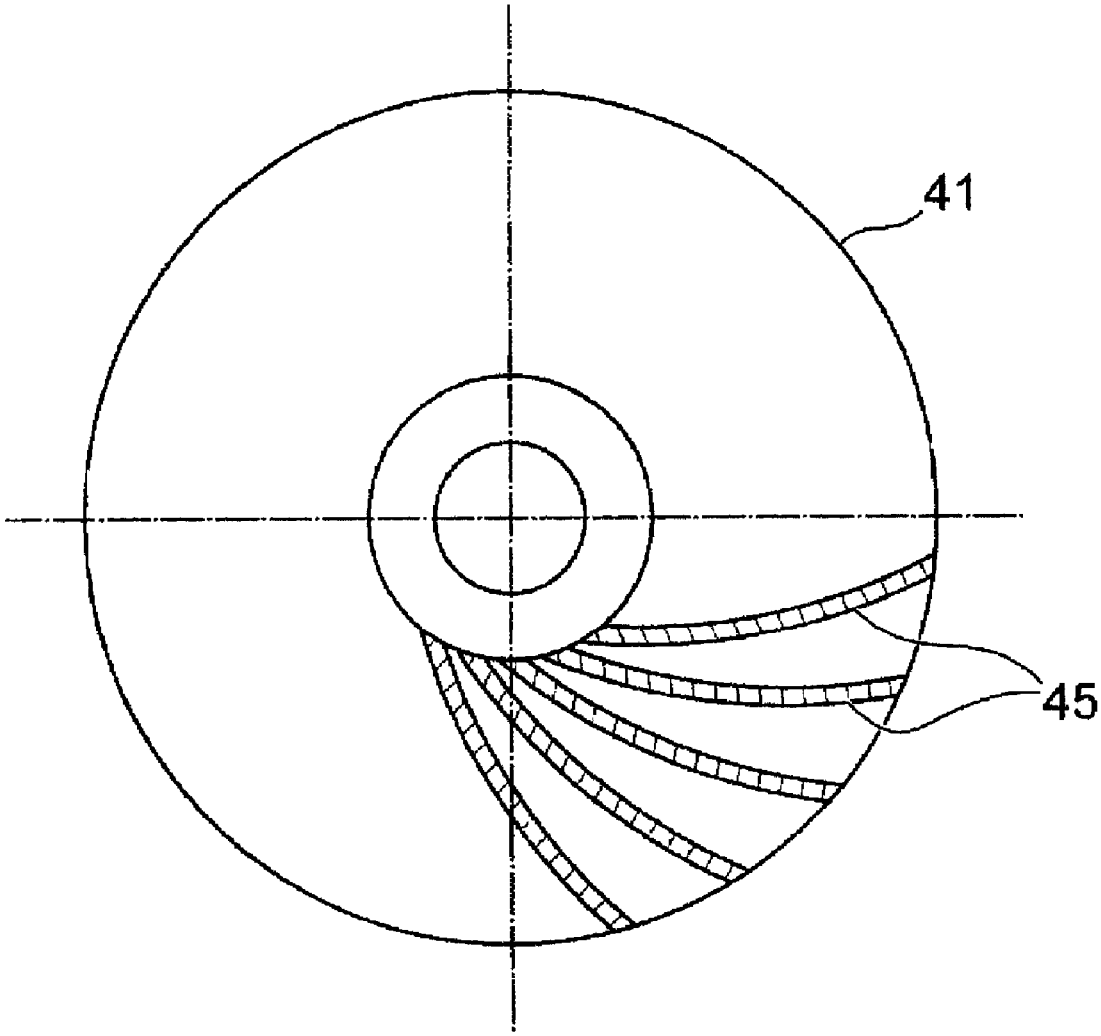
FIG. 15 is a view as viewed from arrow XV of FIG. 14.

FIG. 15 is a view as viewed from arrow XV of FIG. 14. As shown in FIG. 15, a number of spiral grooves 45 are formed in the surface of the stationary member (stationary part) 41 over the substantially entire surface of the stationary member (stationary part) 41 (in FIG. 15, part of spiral grooves are shown).

As shown in FIG. 14, because the gas bearing 40 is used as a bearing for supporting the rotor including the main shaft 1 and the rotor blades fixed to the main shaft 1 in a thrust direction, the rotor can be rotatably supported in an axial direction of the rotor with an accuracy of several micron meters (μm) to several tens of micron meters (μm). The centrifugal blade element 42*a* for compressing gas in a radial direction is integrally formed on the rotor part constituting a part of the gas bearing 40, i.e. the upper rotating member (upper rotating part) 42. Because the minute clearance of the gas bearing 40 and the minute clearance of the centrifugal blades are in the same thrust direction, the blade clearance of the centrifugal blade element 42*a* can be set to be substantially equal to the clearance of the gas bearing 40 or to be slightly larger than the clearance of the gas bearing 40. Specifically, because the centrifugal blade element 42*a* for compressing gas in the radial direction is formed on the upper rotating member (upper rotating part) 42, the upper rotating member (upper rotating part) 42 constitutes a centrifugal blade as well as a part of the gas bearing 40 for axial positioning. In this manner, since the centrifugal blade element 42*a* for compressing gas in a radial direction is formed on the upper rotating member (upper rotating part) 42 for axial positioning of the rotor, the blade clearance of the centrifugal blade element 42*a* can be controlled with high accuracy.

Next, the bearing and motor section 50 will be described in detail. As shown in FIG. 13, the bearing and motor section 50 comprises a motor 51 for rotating the main shaft 1, an upper radial magnetic bearing 53 and a lower radial magnetic bearing 54 for rotatably supporting the main shaft 1 in a radial direction, and an upper thrust magnetic bearing 56 for attracting the rotor in an axial direction. The motor 51 comprises a high-frequency motor. The upper radial magnetic bearing 53, the lower radial magnetic bearing 54 and the upper thrust magnetic bearing 56 comprise an active magnetic bearing. In order to prevent the rotor blade and the stator blade from being brought into contact with each other when an abnormality occurs in one of the magnetic bearings 53, 54, 56, an upper touchdown bearing 81 and a lower touchdown bearing 82 are provided to support the main shaft 1 in a radial direction and an axial direction. The upper thrust magnetic bearing 56 is configured to attract a target disk 58 by electromagnet. Further, in place of the upper thrust magnetic bearing 56 and the target disk 58, a thrust magnetic bearing 55 comprising an upper thrust magnetic bearing 56, a lower thrust magnetic bearing 57 and a target disk 58 may be provided in the same manner as the turbo vacuum pump shown in FIG. 12.

According to the present embodiment, because the gas bearing 40 is used as a bearing for supporting the rotor in a thrust direction, the rotor can be rotatably supported in an axial direction of the rotor with an accuracy of several micron meters (μm) to several tens of micron meters (μm). If the rotor is axially displaced due to a thrust force generated by differential pressure caused by a compression action of the pump and cannot be stably rotated due to the contact in the minute clearance portion of the gas bearing 40, such displacement of the rotor is detected by a displacement sensor or the like (not shown) provided in the vicinity of the gas bearing 40. Then, the thrust magnetic bearing 55 for canceling out the thrust force generated by the differential pressure attracts the rotor, thereby rotating the rotor stably.

Figure 16:
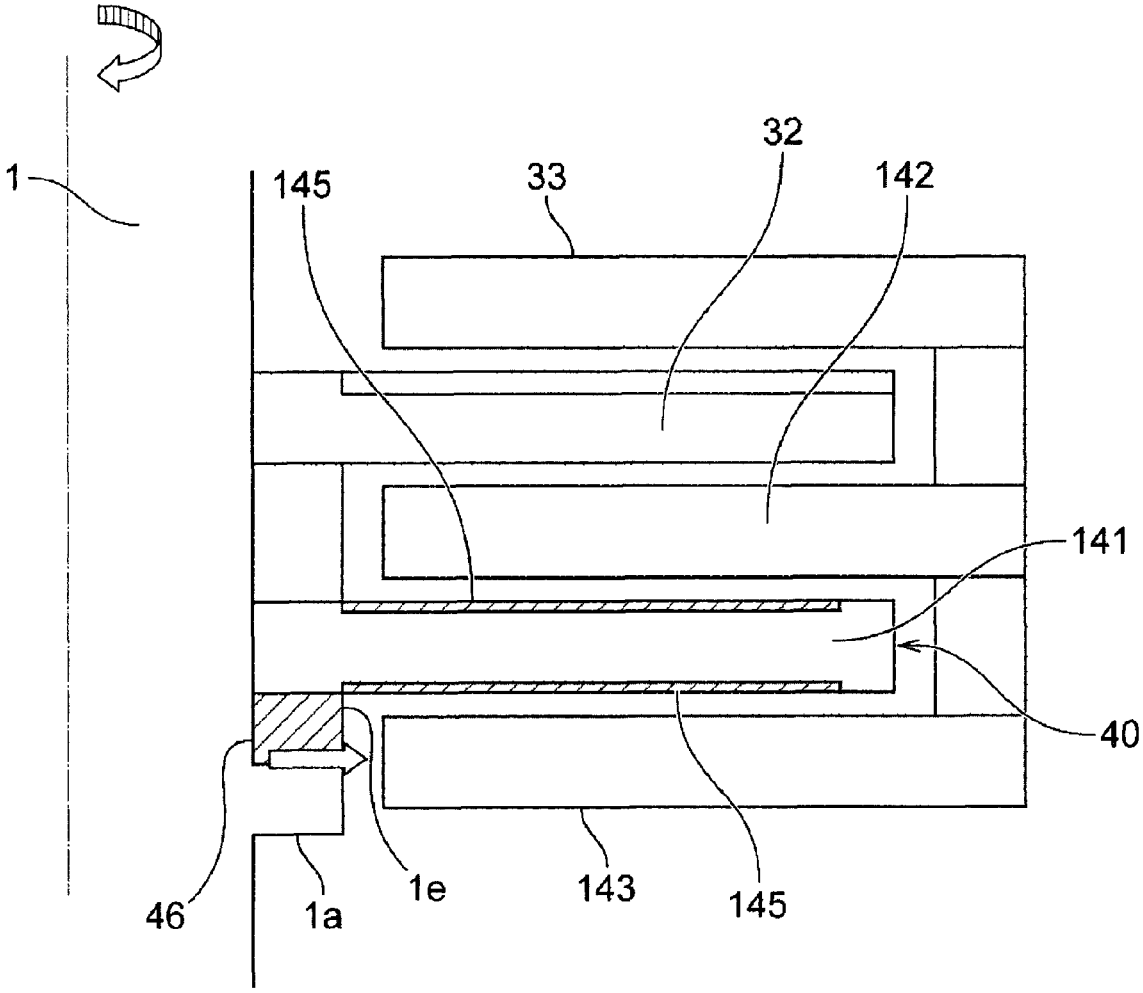
FIG. 16 is an enlarged view showing a gas bearing and peripheral part of the gas bearing according to another embodiment.

FIG. 16 is an enlarged view showing the gas bearing 40 and peripheral part of the gas bearing 40. As shown in FIG. 16, the gas bearing 40 comprises a rotating member (rotating part) 141 fixed to the main shaft 1, and an upper stationary member (upper stationary part) 142 and a lower stationary member (lower stationary part) 143 which are disposed above and below the rotating member (rotating part) 141 so as to place the rotating member (rotating part) 141 between the upper stationary member (upper stationary part) 142 and the lower stationary member (lower stationary part) 143. The upper stationary member (upper stationary part) 142 and the lower stationary member (lower stationary part) 143 are fixed to the upper casing 3. Spiral grooves 145, 145 are formed in both surfaces of the rotating member (rotating part) 141.

Specifically, the rotating member (rotating part) 141 having the spiral grooves 145, 145 is placed between the upper and lower divided members (parts), i.e. the upper stationary member (upper stationary part) 142 and the lower stationary member (lower stationary part) 143.

The rotating member (rotating part) 141 is composed of ceramics such as silicon nitride ceramics having high strength, and the stator members including the upper stationary member (upper stationary part) 142 and the lower stationary member (lower stationary part) 143 are composed of ceramics such as silicon carbide ceramics having high thermal conductivity. The stator members may be composed of alumina ceramics. Further, the main shaft 1 has a support portion 1*a* projecting radially outwardly from the outer peripheral surface of the main shaft, and a spacer 46 is provided between the rotating member (rotating part) 141 and an end face 1*e* of the support portion 1*a* of the main shaft 1.

According to the present embodiment, since the spacer 46 is provided between the end face 1*e* of the main shaft 1 and the rotating member (rotating part) 141, the spacer 46 is smaller than the rotating member (rotating part) 141 in diameter, thus reducing the internal stress of the spacer 46. Further, since sliding occurs at the upper and lower surfaces of the spacer 46, the internal stress of the rotating member (rotating part) 141 is not increased.

In the case where the coefficients of linear expansion of the main shaft 1, the rotating member (rotating part) 141 and the spacer 46 are taken as λsf, λd2, λsp, respectively, the material of the spacer 46 is set so as to be $\lambda sf > \lambda sp \geqq \lambda d2$. Specifically, the coefficient of linear expansion (λsp) of the spacer 46 is set between the coefficient of linear expansion (λsf) of the main shaft 1 (stainless steel) and the coefficient of linear expansion (λd2) of the rotating member (rotating part) 141 (ceramics), and hence an increase of the internal stress of the rotating member caused by thermal deformation can be suppressed. The material of the spacer 46 is preferably titanium alloy ($8.8\times10^{-6}$/°C.), alumina ceramics ($7.2\times10^{-6}$/°C.), and tungsten carbide ($5.8\times10^{-6}$/°C.).

Further, even if the coefficient of linear expansion (λsp) of the spacer 46 is smaller than the coefficient of linear expansion (λsf) of the main shaft 1 (stainless steel) and is identical to the coefficient of linear expansion (λd2) of the rotating member (rotating part) 141 (ceramics), the spacer 46 is smaller than the rotating member (rotating part) 141 in diameter, thus reducing the internal stress of the spacer 46.

Figure 17:
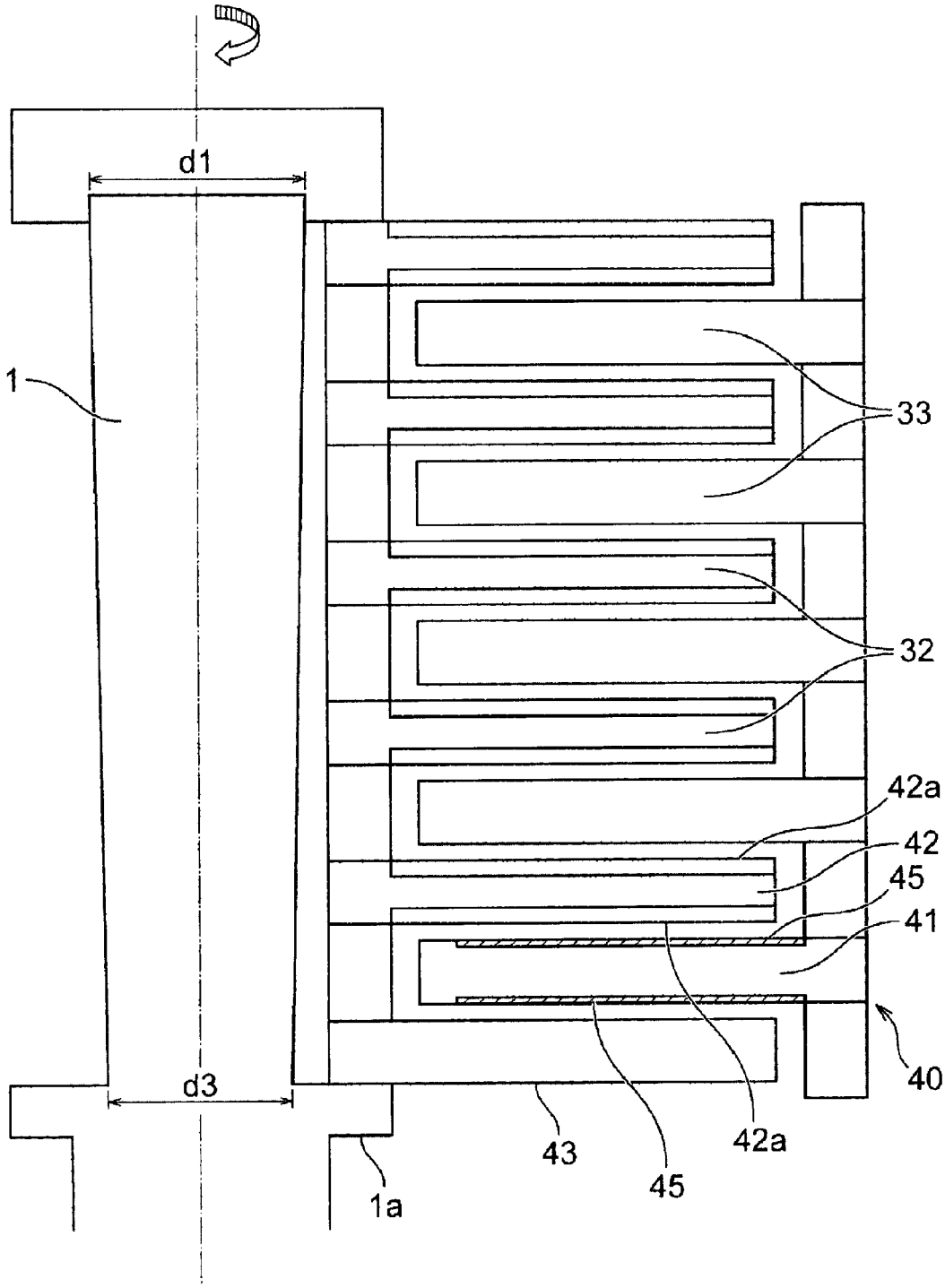
FIG. 17 is an enlarged cross-sectional view showing a modified example of the second embodiment of the turbo vacuum pump according to the present invention.

FIG. 17 is an enlarged cross-sectional view showing a modified example of the second embodiment of the turbo vacuum pump according to the present invention. As shown in FIG. 17, in the turbo vacuum pump of the present embodiment, the outer diameter of the main shaft 1 to which the rotor blades including the turbine blades 12, the centrifugal blades 22 and the centrifugal blades 32 are fixed is getting gradually smaller from the intake side to the downstream side.

In order to rotate the rotor including the main shaft 1 and the rotor blades fixed to the main shaft 1 at a high speed, it is desirable for the structure of the rotor blades fitted over the main shaft that radial clearance should be as small as possible in consideration of reduction of unbalance amount. However, as described above, if the main shaft is composed of stainless steel and the rotor blades are composed of ceramics, the coefficient of linear expansion of the main shaft is different from the coefficient of linear expansion of the rotor blade, and the coefficient of linear expansion of the main shaft is larger than the coefficient of linear expansion of the rotor blade, then the following phenomenon, "decreased clearance→sticking→increased internal stress of the rotor blade→damage" is liable to occur. However, if an initial clearance between the rotor blade and the main shaft is too large in consideration of the above phenomenon, some failure such as an increase of the unbalance amount or variation of the unbalance amount during rotation occurs, and it may cause interference with stable rotation of the rotor. Further, in the case where the blade elements are arranged in a multistage manner, it may cause a greater impact on the rotor.

Therefore, according to the present invention, as shown in FIG. 17, the outer diameter of the main shaft 1 is getting gradually smaller from the intake side to the downstream side. In the blade element part of the rotor, as pressure is closer to the atmospheric pressure, heat generation caused by loss in the blade element part becomes larger. Therefore, the main shaft is thermally deformed more greatly at the location where the pressure is closer to the atmospheric pressure. In view of this fact, as shown in FIG. 17, the main shaft is set to be a tapered shape so that the outer diameter of the main shaft 1 is getting gradually smaller from the intake side to the downstream side. Thus, since the sticking caused by the decreased clearance due to thermal deformation can be prevented, damage caused by the increased internal stress of the rotor blade and an increase of unbalance amount are avoidable. Specifically, the main shaft 1 is configured to be a tapered shape so that the outer diameter d1 of the upper side of the main shaft 1 is larger than the outer diameter d3 of the lower side of the main shaft 1.

Figure 18:
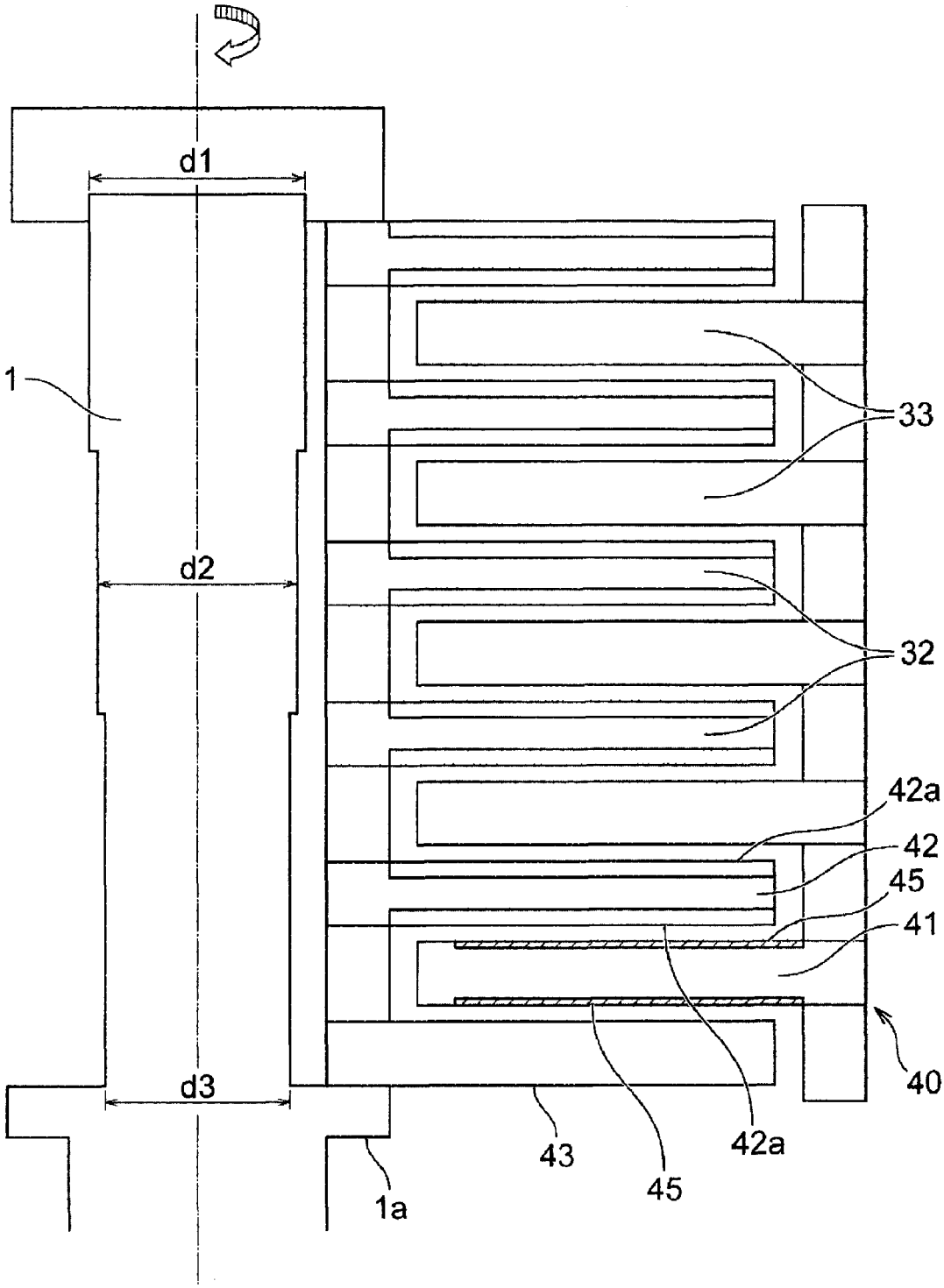
FIG. 18 is an enlarged cross-sectional view showing another modified example of the second embodiment of the turbo vacuum pump according to the present invention.

As shown in FIG. 18, the outer diameter of the main shaft 1 may be smaller in a step-like shape without using the continuously smaller shape shown in FIG. 17. Specifically, the outer diameter of the main shaft 1 may be smaller as follows: the outer diameter d1 of the upper side>the outer diameter d2 of the intermediate portion>the outer diameter d3 of the lower side. In the case of the step-like shape, any number of steps may be used.

In FIGS. 17 and 18, the upper rotating member (upper rotating part) 42 and the centrifugal blades 32 are illustrated as rotor blades. However, the rotor blades may include the centrifugal blades 22 or the turbine blades 12. The other structure of the turbo vacuum pump shown in FIGS. 17 and 18, i.e. the structure of the gas bearing 40, the bearing and motor section 50 having the trust magnetic baring 55, and the like is the same as the structure of the turbo vacuum pump shown in FIGS. 13 through 16.

Further, the structure of the blade elements of the pumping section in the turbo vacuum pump shown in FIGS. 13 through 18 is the same as that of the blade elements shown in FIGS. 7 through 10. Specifically, the turbine blade unit 13 of the turbine blade pumping section 11 is shown in FIGS. 7A and 7B. The stator blade 17 of the turbine blade pumping section 11 is shown in FIGS. 8A, 8B and 8C. The centrifugal blade 22 of the first centrifugal blade pumping section 21 is shown in FIGS. 9A and 9B. The centrifugal blade 32 of the second centrifugal blade pumping section 31 is shown in FIGS. 10A and 10B.

The evacuation action of the turbo vacuum pump shown in FIGS. 13 through 18 is the same as that of the turbo vacuum pump shown in FIGS. 1 through 10. The performance comparison based on blade clearance in the turbo vacuum pump is the same as the graph shown in FIG. 11.

The turbo vacuum pump according to the second embodiment of the present invention shown in FIGS. 13 through 18 has the following advantages:

(1) Because the gas bearing is used as a bearing for supporting the rotor including the main shaft and the rotor blades fixed to the main shaft in a thrust direction, the rotor can be rotatably supported in an axial direction of the rotor with an accuracy of several micron meters (μm) to several tens of micron meters (μm). Since the spacer is provided between the lower rotating member (rotating part) of the gas bearing and the end face of the main shaft, the spacer is smaller than the lower rotating member (rotating part) in diameter, thus reducing the internal stress of the spacer. Further, since sliding occurs at the upper and lower surfaces of the spacer, the internal stress of the lower rotating member (rotating part) of the gas bearing is not increased.

(2) Because the coefficient of linear expansion of the spacer is set between the coefficient of linear expansion of the main shaft and the coefficient of linear expansion of the lower rotating member (rotating part) of the gas bearing, an increase of the internal stress of the lower rotating member (rotating part) caused by thermal deformation can be suppressed.

(3) Because the spacer is provided between the main shaft and the rotor blade, and the difference in the coefficient of linear expansion between the main shaft and the rotor blade can be absorbed, it is possible to use martensitic stainless steel or austenitic stainless steel without using expensive material such as Kovar (registered trademark) or Invar (registered trademark). Thus, the turbo vacuum pump can be produced inexpensively.

(4) In the blade element part of the rotor, as pressure is closer to the atmospheric pressure, heat generation caused by loss in the blade element part becomes larger. However, the outer diameter of the main shaft is getting gradually smaller from the intake side to the discharge side (downstream side). Thus, even if the coefficient of linear expansion of the main shaft is larger than the coefficient of linear expansion of the rotor blade, sticking caused by the decreased clearance due to thermal deformation can be prevented, and damage caused by the increased internal stress of the rotor blade and an increase of unbalance amount are avoidable.

(5) Because the outer diameter of the main shaft is getting gradually smaller from the intake side to the discharge side (downstream side), the difference in the coefficient of linear expansion between the main shaft and the rotor blade can be absorbed by the simple structure. Thus, the turbo vacuum pump can be produced inexpensively.

A turbo vacuum pump according to a third embodiment of the present invention will be described below with reference to FIGS. 19 through 27. Like or corresponding parts are denoted by like or corresponding reference numerals throughout drawings and will not be described below repetitively.

Figure 19:
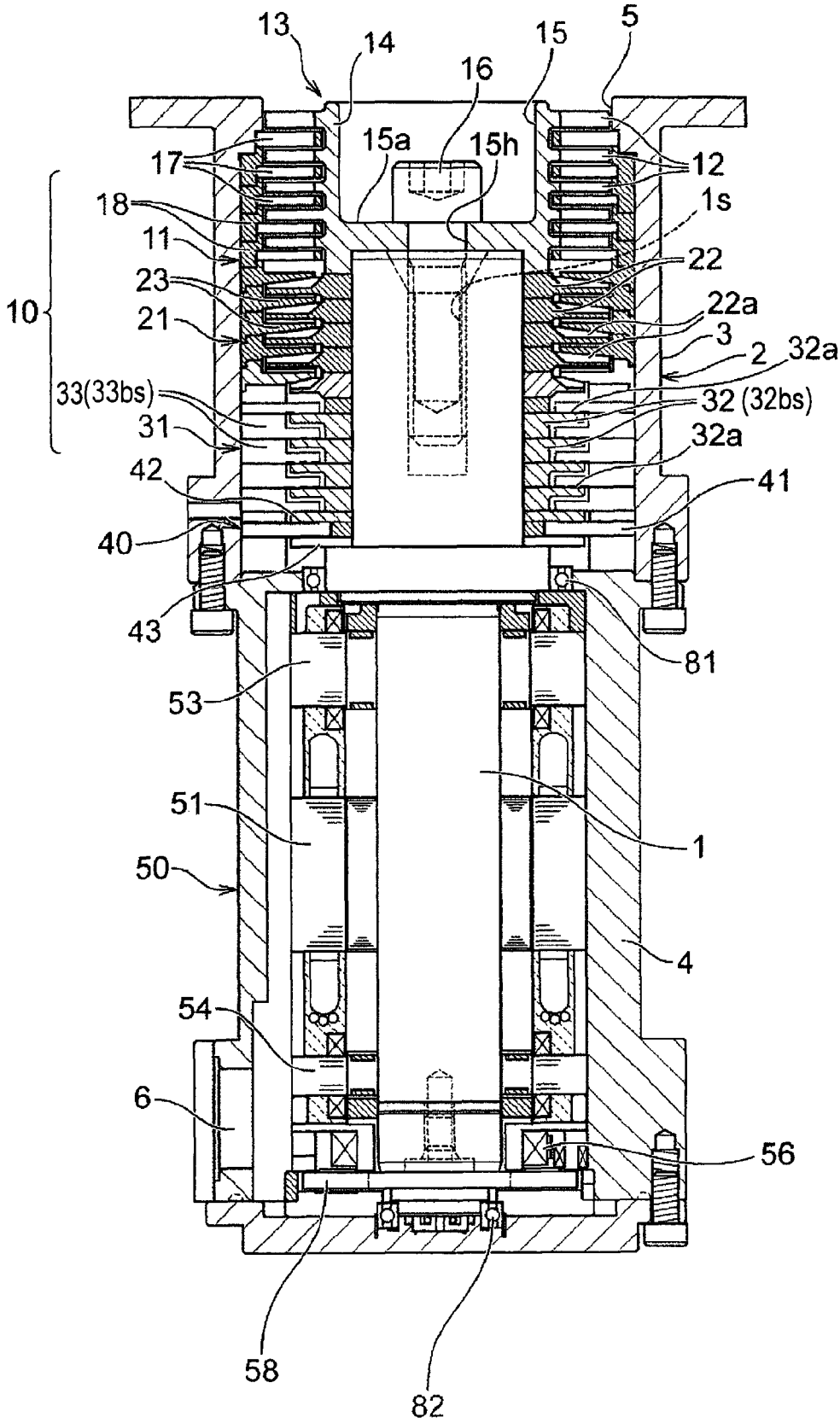
FIG. 19 is a cross-sectional view showing a turbo vacuum pump according to a third embodiment of the present invention.

FIG. 19 is a cross-sectional view showing a turbo vacuum pump according to a third embodiment of the present invention. As shown in FIG. 19, the turbo vacuum pump comprises a main shaft 1 extending over the substantially entire length of the pump, a pumping section 10 in which rotor blades and stator blades are alternately disposed in a casing 2, and a bearing and motor section 50 having a motor for rotating the main shaft 1 and bearings for rotatably supporting the main shaft 1. The casing 2 comprises an upper casing 3 for housing the pumping section 10 and a lower casing 4 for housing the bearing and motor section 50, and an intake port 5 is formed at the upper end portion of the upper casing 3 and a discharge port 6 is formed at the lower part of the lower casing 4.

The pumping section 10 comprises a turbine blade pumping section 11, a first centrifugal blade pumping section 21 and a second centrifugal blade pumping section 31 which are arranged in series from the intake port side to the lower part of the upper casing 3 in the same manner as the turbo vacuum pump shown in FIG. 1. The turbine blade pumping section 11, the first centrifugal blade pumping section 21 and the second centrifugal blade pumping section 31 have the same respective structures as those of the turbo vacuum pump shown in FIG. 1.

A gas bearing 40 is provided at immediately downstream side of the second centrifugal blade pumping section 31 to support the rotor including the main shaft 1 and the rotor blades 12, 22, 32 fixed to the main shaft 1 in a thrust direction.

Figure 20:
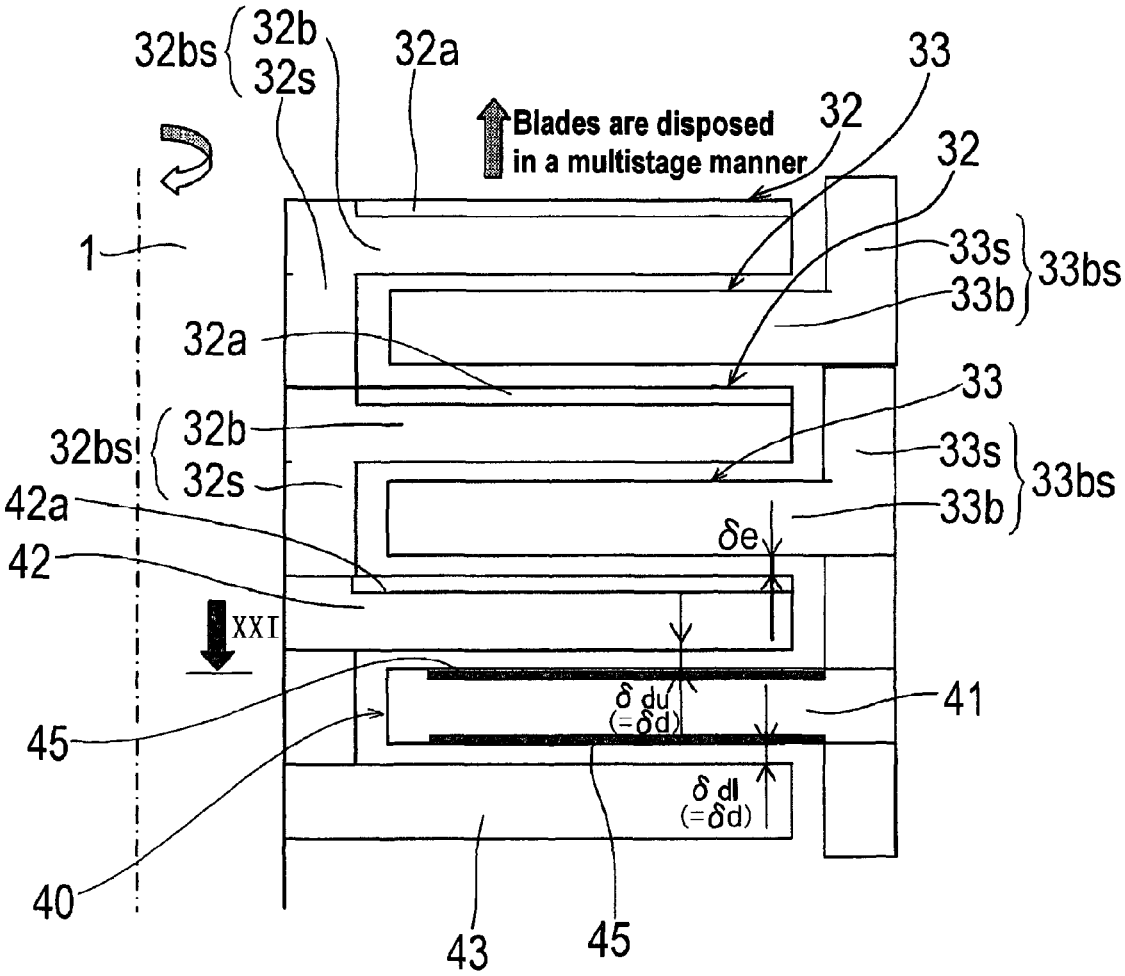
FIG. 20 is an enlarged view showing a gas bearing and peripheral part of the gas bearing.

FIG. 20 is an enlarged view showing the gas bearing 40 and peripheral part of the gas bearing 40. As shown in FIG. 20, the gas bearing 40 comprises a stationary member (stationary part) 41 fixed to the upper casing 3, and an upper rotating member (upper rotating part) 42 and a lower rotating member (lower rotating part) 43 which are disposed above and below the stationary member (stationary part) 41 so as to place the stationary member (stationary part) 41 between the upper rotating member (upper rotating part) 42 and the lower rotating member (lower rotating part) 43. The upper rotating member (upper rotating part) 42 and the lower rotating member (lower rotating part) 43 are fixed to the main shaft 1. Spiral grooves 45, 45 are formed in both surfaces of the stationary member 41.

Specifically, the stationary member (stationary part) 41 having the spiral grooves 45, 45 is placed between the upper and lower divided members (parts), i.e. the upper rotating member (upper rotating part) 42 and the lower rotating member (lower rotating part) 43. A centrifugal blade element 42*a* for compressing and evacuating gas in a radial direction is formed on a surface of the upper rotating member (upper rotating part) 42 having an opposite surface which faces the spiral grooves 45 of the stationary member (stationary part) 41. The centrifugal blade element 42*a* comprises centrifugal blade grooves for compressing and evacuating gas in a radial direction of the upper rotating member (upper rotating part) 42.

Figure 21:
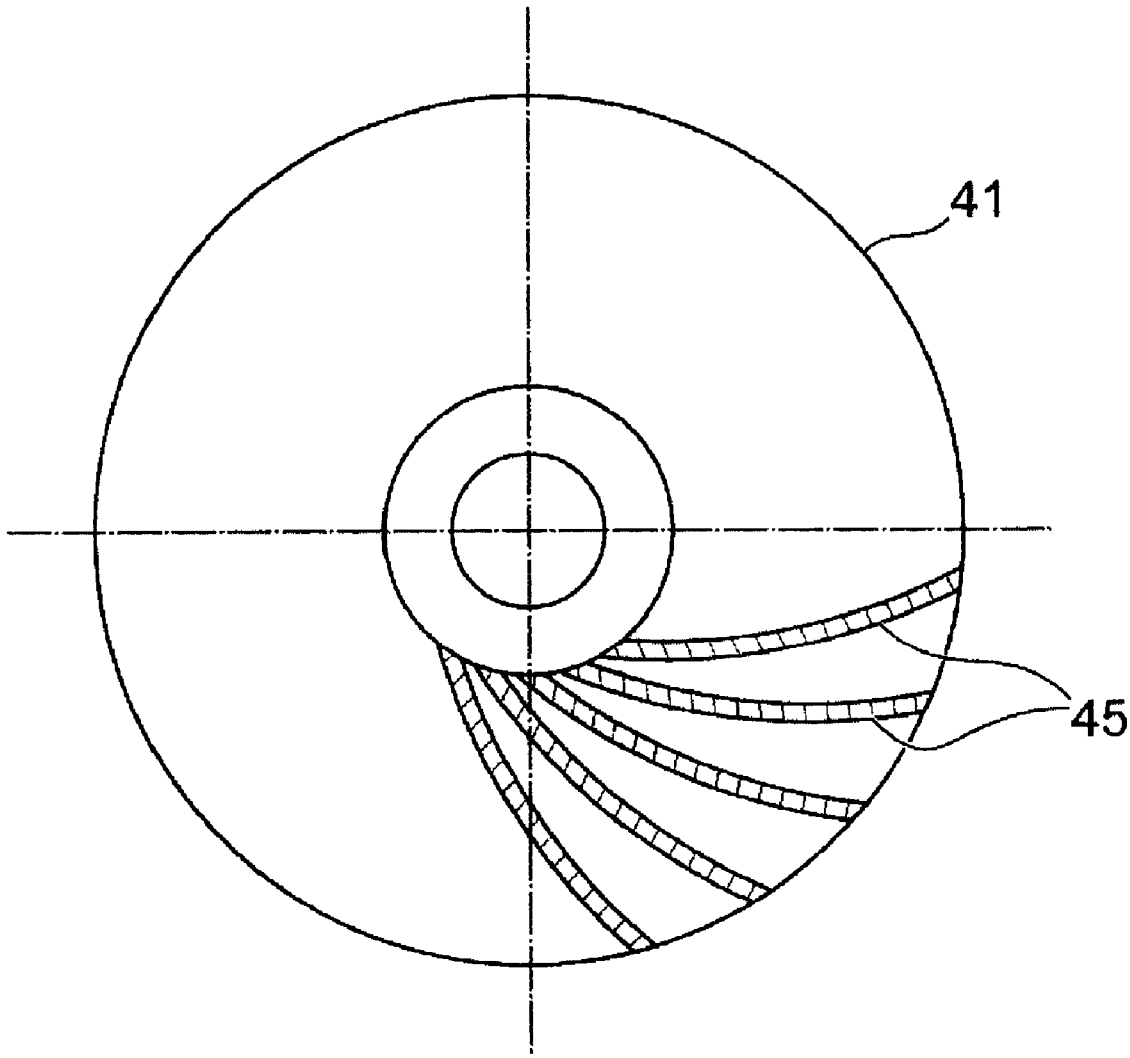
FIG. 21 is a view as viewed from an arrow XXI of FIG. 20.

FIG. 21 is a view as viewed from an arrow XXI of FIG. 20. As shown in FIG. 21, a number of spiral grooves 45 are formed in the surface of the stationary member (stationary part) 41 over the substantially entire surface of the stationary member (stationary part) 41 (in FIG. 21, part of spiral grooves are shown).

As shown in FIG. 20, because the gas bearing 40 is used as a bearing for supporting the rotor including the main shaft 1 and the rotor blades fixed to the main shaft 1 in a thrust direction, the rotor can be rotatably supported in an axial direction of the rotor with an accuracy of several micron meters (μm) to several tens of micron meters (μm). The centrifugal blade element 42*a* for compressing gas in a radial direction is integrally formed on the rotor part constituting a part of the gas bearing 40, i.e. the upper rotating member (upper rotating part) 42. Because the minute clearance of the gas bearing 40 and the minute clearance of the centrifugal blades are in the same thrust direction, the blade clearance of the centrifugal blade element 42*a* can be set to be substantially equal to the clearance of the gas bearing 40 or to be slightly larger than the clearance of the gas bearing 40. Specifically, because the centrifugal blade element 42*a* for compressing gas in the radial direction is formed on the upper rotating member (upper rotating part) 42, the upper rotating member (upper rotating part) 42 constitutes a centrifugal blade as well as a part of the gas bearing 40 for axial positioning of the rotor. In this manner, since the centrifugal blade element 42*a* for compressing gas in the radial direction is formed on the upper rotating member (upper rotating part) 42 for axial positioning, the blade clearance of the centrifugal blade element 42*a* can be controlled with high accuracy.

When the rotor including the main shaft 1 and the rotor blades fixed to the main shaft 1 is levitated at the center of the axial direction of the gas bearing 40, the clearance of the gas bearing 40 is taken as $\delta d$, and the blade clearance is taken as $\delta e$. It is suitable from the aspect of reliability against contact of blade portions and evacuation performance of blade that the difference ($\delta e-\delta d$) between the clearance $\delta e$ and the clearance $\delta d$ is set to about 10 to 30% of the total clearance $2\delta d$ (i.e. $\delta du+\delta d1$) in the gas bearing 40. Specifically, it is desirable to set $\delta e-\delta d=(0.1\sim0.3)\times(2\delta d)$.

In FIG. 20, the state in which the rotor is levitated at the center of the axial direction of the gas bearing 40 is shown, and the clearances are expressed as $\delta du$ (=$\delta d$), $\delta d1$ (=$\delta d$).

The reason why the evacuation performance of the turbo blade element is low at an atmospheric pressure range is that the blade clearance is large, and countercurrent flow is more likely to occur at the atmospheric pressure range. According to the present invention, the blade clearance can be smaller, and compression capability at the atmospheric pressure range can be greatly improved.

As shown in FIG. 20, in the centrifugal blade pumping section immediately above the gas bearing 40, spacer-equipped blade members (blade members with a spacer) 32*bs*, each comprising a circular disk-shaped blade portion 32*b* having a centrifugal blade element 32*a* and a cylindrical spacer 32*s* which are integrally formed, are disposed in a multistage manner to construct multistage rotor blades 32. The spacer-equipped blade members (blade members with a spacer) 33*bs*, each comprising a circular disk-shaped blade portion 33*b* and a cylindrical spacer 33*s* which are integrally formed, are disposed in a multistage manner to construct multistage stator blades 33 (described in detail below).

Figure 22:
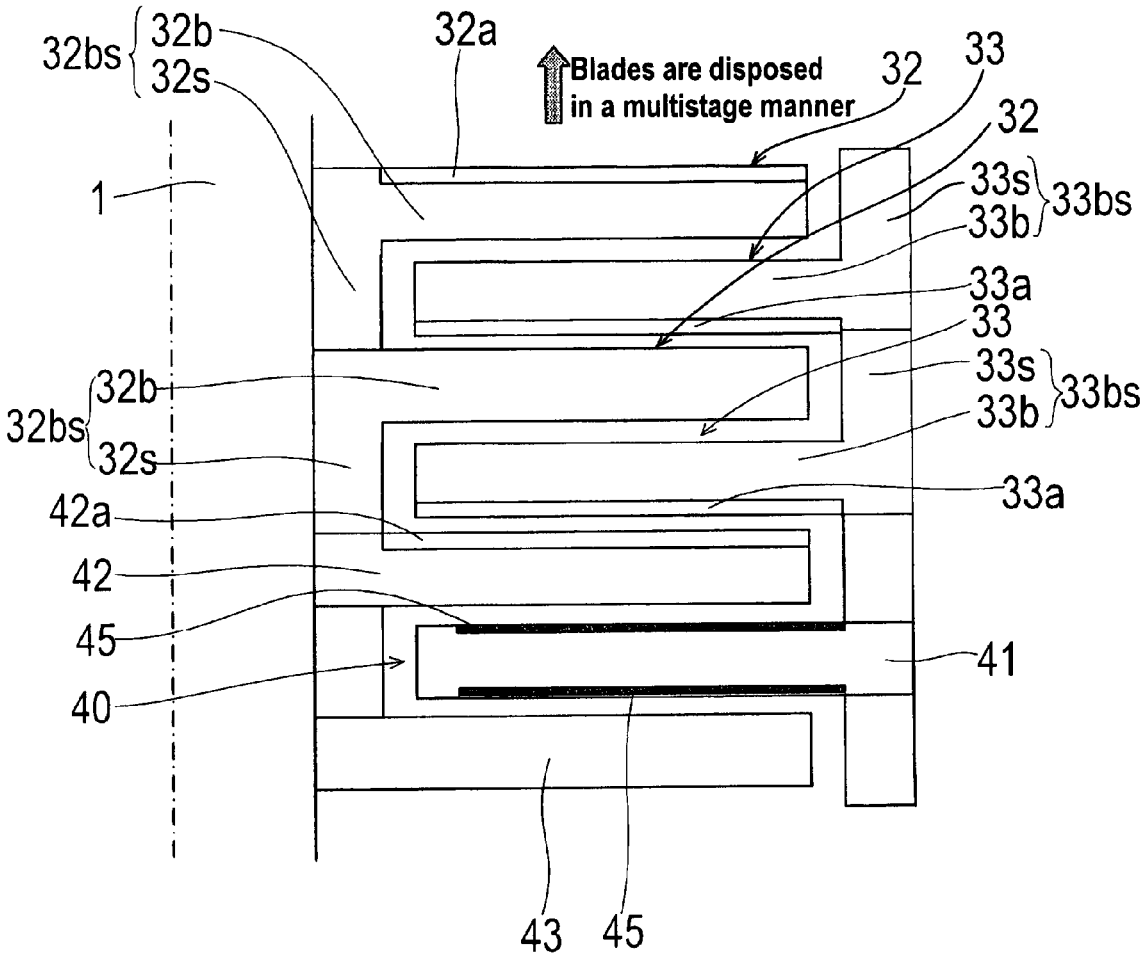
FIG. 22 is an enlarged view showing a pumping section in which a centrifugal blade element for compressing and evacuating gas in a radial direction is formed not only on the rotor blade but also on the stator blade.

FIG. 22 is an enlarged view showing a pumping section in which a centrifugal blade element for compressing and evacuating gas in a radial direction is formed not only on the rotor blade but also on the stator blade. As shown in FIG. 22, in the turbo vacuum pump according to the present embodiment, the centrifugal blade element 32*a* (42*a*) comprising centrifugal blade grooves is formed on the rotor blades 32 (42) and the centrifugal blade element 33*a* comprising centrifugal blade grooves is formed on the stator blade 33. In the example shown in FIG. 22, the centrifugal blade element 32*a* (42*a*) of the rotor blade 32 (42) is formed on the surface for evacuating gas from an inner circumferential side to an outer circumferential side. Specifically, the centrifugal blade element 32*a* (42*a*) is formed in a direction in which a centrifugal force acts. Further, the centrifugal blade element 33*a* of the stator blade 33 is formed on the surface for evacuating gas from an inner circumferential side to an outer circumferential side. Specifically, the centrifugal blade element 33*a* is formed in a direction in which a centrifugal force acts. The other structure of the gas bearing 40 and the centrifugal blade pumping section shown in FIG. 22 is the same as that of the gas bearing 40 and the centrifugal blade pumping portion shown in FIG. 20.

If the centrifugal blade element is formed on a single surface, the centrifugal blade surface is liable to be bent or deformed. Thus, it is necessary to correct the bent or deformed surface. If the same centrifugal blade element is formed on the surface opposite to the surface on which the centrifugal blade element is formed, bending or deformation of the surface can be reduced. Therefore, centrifugal blade grooves constituting the centrifugal blade element 42*a*, 32*a* may be formed in both surfaces of the upper rotating member (upper rotating part) 42 or the rotor blade 32. In this case, the centrifugal blade grooves formed in the surface opposite to the surface for evacuating gas from the inner circumferential side to the outer circumferential side are formed at an angle for directing gas from the outer circumferential side to the inner circumferential side, and have an effect of compressing gas. However, the compression effect of the centrifugal blade grooves for directing gas from the outer circumferential side to the inner circumferential side is smaller than the compression effect of the centrifugal blade grooves formed in the normal surface, because compression is made in a direction contrary to the centrifugal force.

Figure 23A:
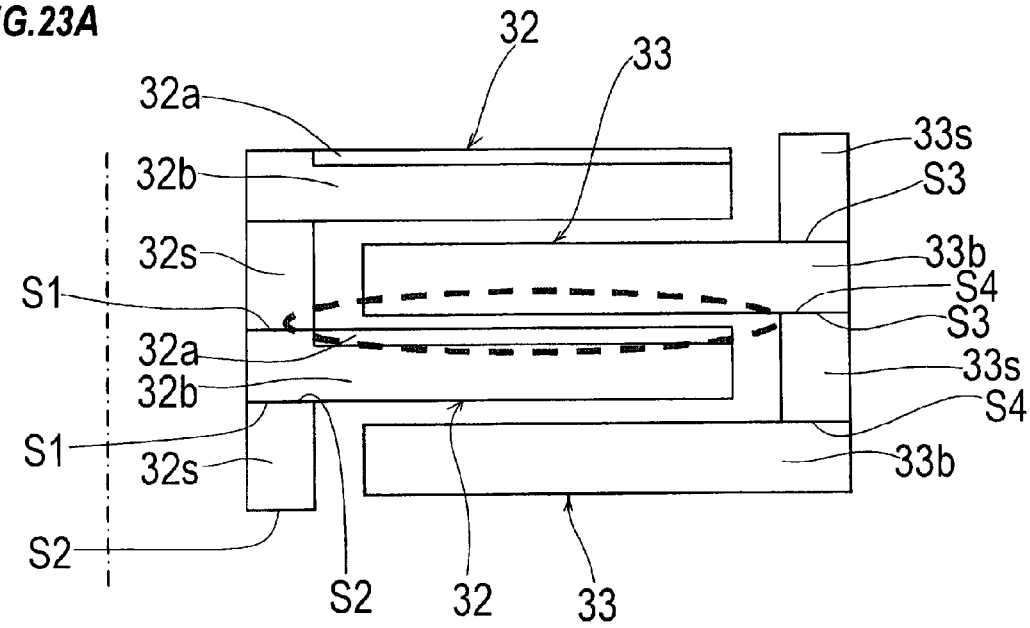
FIG. 23A is an enlarged view showing a centrifugal blade pumping section in which blade members having centrifugal blade elements for compressing and evacuating gas in a radial direction are disposed in a multistage manner.
Figure 23B:
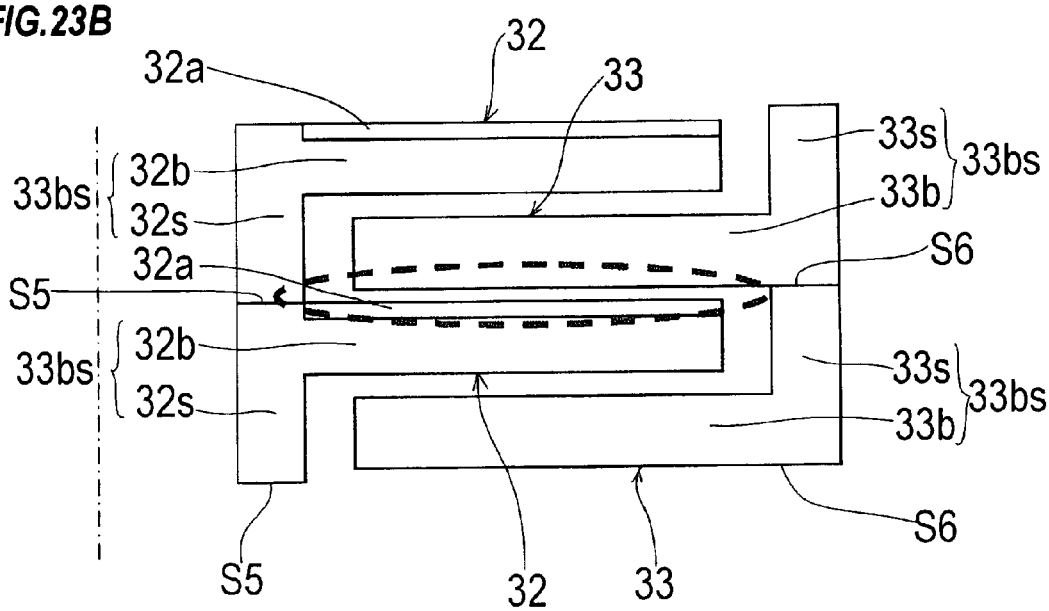
FIG. 23B is an enlarged view showing a centrifugal blade pumping section in which blade members having centrifugal blade elements for compressing and evacuating gas in a radial direction are disposed in a multistage manner.

FIGS. 23A and 23B are enlarged views showing a centrifugal blade pumping portion in which blade members having centrifugal elements for compressing and evacuating gas in a radial direction are axially disposed in a multistage manner. FIG. 23A is a view showing a centrifugal blade pumping section in which circular disk-shaped blade members having centrifugal blade elements are disposed in a multistage and each of cylindrical spacers is placed between the upper and lower circular disk-shaped blade members. FIG. 23B is a view showing a centrifugal blade pumping section in which spacer-equipped blade members (blade members with a spacer) comprising a circular disk-shaped blade portion and a cylindrical spacer which are integrally formed are disposed in a multistage manner.

In the centrifugal blade pumping section immediately above the gas bearing 40 shown in FIG. 23A, circular disk-shaped blade members 32*b* having a centrifugal blade element 32*a* are disposed in a multistage manner, and each of cylindrical spacers 32*s* is disposed between the upper and lower circular disk-shaped blade members 32*b*, 32*b* to construct multistage rotor blades 32. Further, circular disk-shaped blade members 33*b* are disposed in a multistage manner, and each of cylindrical spacers 33*s* is disposed between the upper and lower circular disk-shaped blade members 33*b*, 33*b* to construct multistage stator blades 33. In the centrifugal blade pumping section 21 shown in FIG. 23A, in order to improve an accuracy of the blade evacuation surface (shown by dotted line), it is necessary to improve a machining accuracy of both surfaces S1, S2 of the circular disk-shaped blade member 32*b* and both surfaces S2, S2 of the cylindrical spacer 32*s*. Specifically, in order to improve the accuracy of the blade evacuation surface of the rotor blade 32 in each stage in the rotor blade side, it is necessary to improve the machining accuracy of four surfaces S1, S2, S2, S2. Similarly, it is necessary to improve the machining accuracy of both surfaces S3, S3 of the circular disk-shaped blade member 33*b* and both surfaces S4, S4 of the cylindrical spacer 33*s* in the stator blade side. Specifically, in order to improve the accuracy of the blade evacuation surface (shown by dotted line) of the stator blade 33 in each stage in the stator blade side, it is necessary to improve the machining accuracy of four surfaces S3, S3, S4, S4.

Figure 28:
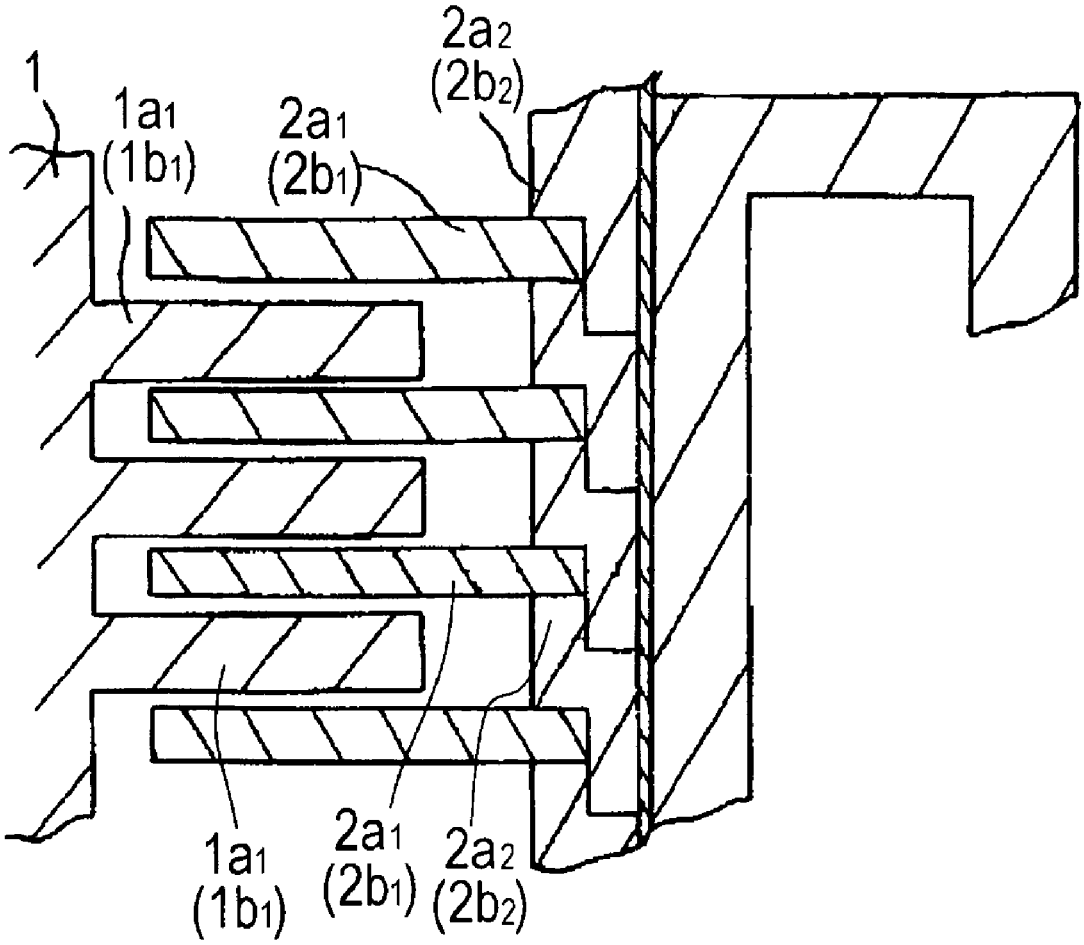
FIG. 28 is a cross-sectional view showing a centrifugal compression pump stage disclosed in Japanese laid-open utility model publication No. 1-142594.

In the stator blades shown in FIG. 28 and disclosed in Japanese utility-model patent publication H1-1425945, it is necessary to improve the machining accuracy of both surfaces of each stationary circular disk $2a_1$ or $2b_1$ and both surfaces of each cylindrical spacer $2a_2$ or $2b_2$ in the same manner as the stator blades shown in FIG. 23A.

In the centrifugal blade pumping section immediately above the gas bearing 40 shown in FIG. 23B, spacer-equipped blade members 32*bs*, each comprising a circular disk-shaped blade portion 32*b* having a centrifugal blade element 32*a* and a cylindrical spacer 32*s* which are integrally formed, are disposed in a multistage manner to construct multistage rotor blades 32. Further, spacer-equipped blade members 33*bs*, each comprising a circular disk-shaped blade portion 33*b* and a cylindrical spacer 33*s* which are integrally formed, are disposed in a multistage manner to construct multistage stator blades 33.

In the centrifugal blade pumping section shown in FIG. 23B, in order to improve the accuracy of the blade evacuation surface (shown by dotted line), it is necessary to improve the machining accuracy of both surfaces S5, S5 of each spacer-equipped blade member 32*bs* in the rotor blade side. Specifically, in order to improve the accuracy of the blade evacuation surface of the rotor blade 32 in each stage in the rotor blade side, it is necessary to improve the machining accuracy of both surfaces S5, S5. Similarly, it is necessary to improve the machining accuracy of both surfaces S6, S6 of each spacer-equipped blade member 33*bs* in the stator blade side. Specifically, in order to improve the accuracy of the blade evacuation surface (dotted-line) of each stator blade 33 in each stage in the stator blade side, it is necessary to improve the machining accuracy of both surfaces S6, S6.

Therefore, according to the present invention, the centrifugal blade pumping section shown in FIG. 23B is employed. Specifically, the spacer-equipped blade members 32*bs*, each comprising a circular disk-shaped blade portion 32*b* having a centrifugal blade element 32*a* and a cylindrical spacer 32*s* which are integrally formed, are disposed in a multistage manner to construct multistage rotor blades 32. Further, the spacer-equipped blade members 33*bs*, each comprising a circular disk-shaped blade portion 33*b* and a cylindrical spacer 33*s* which are integrally formed, are disposed in a multistage manner to construct multistage stator blades 33.

Conventionally, the circular disk-shaped blade member 32*b* having the centrifugal blade element 32*a* and the cylindrical spacer 32*s* have been discrete members. According to the present invention, the circular disk-shaped blade portion 32*b* and the cylindrical spacer 32*s* are integrally formed, and thus the number of parts can be decreased to lower the manufacturing cost. Further, since the circular disk-shaped blade portion 32*b* and the cylindrical spacer 32*s* are integrally formed, assembling error caused by stacking discrete components (parts) can be reduced. In the case where the circular disk-shaped blade portion 32*b* and the cylindrical spacer 32*s* are integrally formed, axial errors are produced only on both end surfaces of the integral member. However, in the case where the circular disk-shaped blade member 32*b* and the cylindrical spacer 32*s* are discrete components, axial errors are produced on three surfaces including both end surfaces and a contact surface of the circular disk-shaped blade members 32*b* and the cylindrical spacer 32*s*.

Figure 24A:
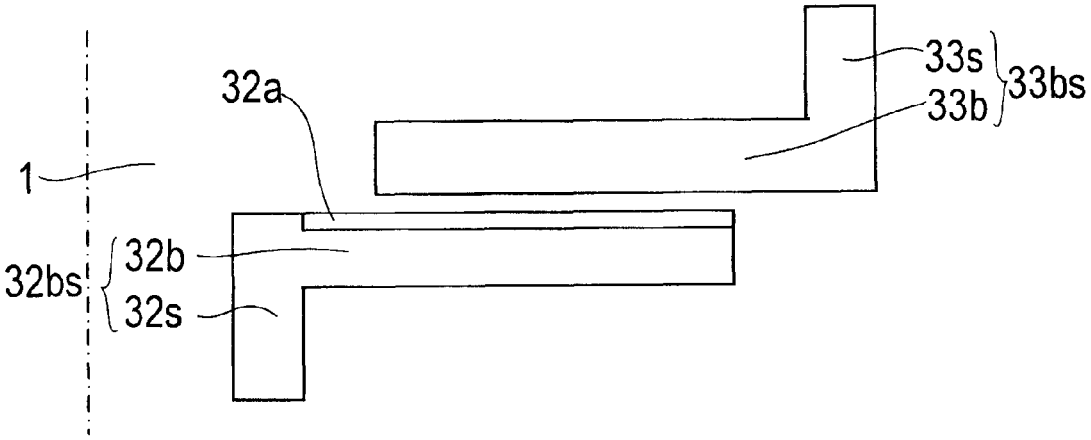
FIG. 24A is an enlarged view showing spacer-equipped blade member (blade member with a spacer) in which a circular disk-shaped blade portion and a cylindrical spacer are integrally formed.
Figure 24B:
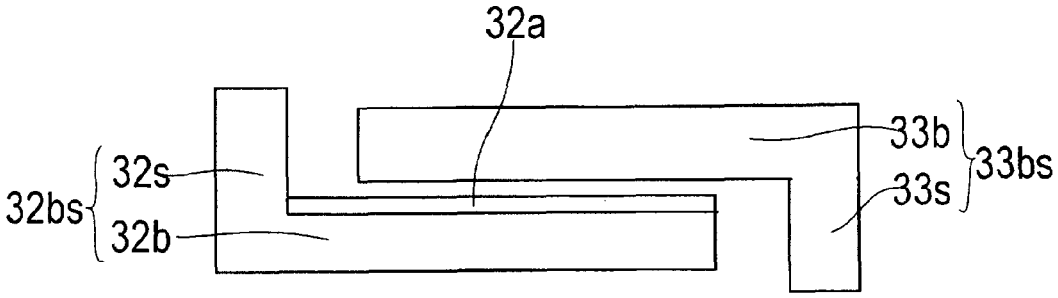
FIG. 24B is an enlarged view showing spacer-equipped blade member (blade member with a spacer) in which a circular disk-shaped blade portion and a cylindrical spacer are integrally formed.

FIGS. 24A and 24B are enlarged views showing spacer-equipped blade member (blade member with a spacer) in which a circular disk-shaped blade portion and a cylindrical spacer are integrally formed. In the example shown in FIG. 24A, the spacer-equipped blade member 32*bs* in the rotor blade side comprises a circular disk-shaped blade portion 32*b*, and a cylindrical spacer 32*s* extending downwardly from the inner circumferential side of the circular disk-shaped blade portion 32*b*, and the spacer-equipped blade member 33*bs* in the stator blade side comprises a circular disk-shaped blade portion 33*b*, and a cylindrical spacer 33*s* extending upwardly from the outer circumferential side of the circular disk-shaped blade portion 33*b*.

In the example shown in FIG. 24B, the spacer-equipped blade member 32*bs* in the rotor blade side comprises a circular disk-shaped blade portion 32*b*, and a cylindrical spacer 32*s* extending upwardly from the inner circumferential side of the circular disk-shaped blade portion 32*b*, and the spacer-equipped blade member 33*bs* in the stator blade side comprises a circular disk-shaped blade portion 33*b*, and a cylindrical spacer 33*s* extending downwardly from the outer circumferential side of the circular disk-shaped blade portion 33*b*.

In the case where the circular disk-shaped blade portion 32*b* having the centrifugal blade element 32*a* and the cylindrical spacer 32*s* are integrally formed, as shown in FIG. 24A, it is desirable that the blade evacuation surface on which the centrifugal blade element 32*a* is formed should be located at an end surface side of the integrally formed component. The evacuation performance of the centrifugal blade is largely affected by the axial clearance. As the axial clearance is smaller, the evacuation performance is higher. Therefore, as the dimensional accuracy and geometric tolerance accuracy of the axial end surfaces of the centrifugal blade is higher, the clearance is smaller to improve the evacuation performance. As shown in FIG. 24A, if the blade evacuation surface on which the centrifugal blade element 32*a* is formed is located at an end surface side of the integrally formed component, then a machining method such as lapping by which the accuracy of parallelism and flatness becomes very high can be applied to the integrally formed component.

In contrast, as shown in FIG. 24B, if the blade evacuation surface on which the centrifugal blade element 32*a* is formed is not located at an end surface side of the integrally formed component but located at an inner position from the end surface, then it is difficult to ensure parallelism and flatness of the blade evacuation surface.

Therefore, according to the present invention, the spacer-equipped blade members shown in FIG. 24A are employed. Specifically, in the rotor blade side, the spacer-equipped blade member (blade member with a spacer) 32*bs* comprising a circular disk-shaped blade portion 32*b* having a blade evacuation surface and a cylindrical spacer 32*s* extending downwardly from the inner circumferential side of the circular disk-shaped blade portion 32*b* is employed. A centrifugal blade element 32*a* is formed in the blade evacuation surface to be positioned at an upper end surface of the spacer-equipped blade member 32*bs*. In the stator blade side, the spacer-equipped blade member 33*bs* comprising a circular disk-shaped blade portion 33*b* having a blade evacuation surface at a lower end, and a cylindrical spacer 33*s* extending upwardly from the outer circumferential side of the circular disk-shaped blade portion 33*b* is employed.

As described above, according to the present invention, in both of the rotor blade side and the stator blade side, the blade evacuation surface is located at an end surface side of the integrally formed component, and hence the accuracy of parallelism and flatness can be very high by lapping. Therefore, because the dimensional accuracy and geometric tolerance accuracy of the axial end surfaces of the centrifugal blade element is high, the clearance can be minute to improve the evacuation performance.

In contrast, in the rotor blade side shown in FIG. 28 and disclosed in Japanese laid-open utility model publication No. 1-142594, the blade portion and the rotor (main shaft) are integrally formed. In the case of the integrally formed rotor, machining of the axial surfaces of the blade portion is considered to be performed by lathe, and lapping cannot be applied to finish the flat surface. The geometric tolerance accuracy (flatness, parallelism) obtained by the lathe is inferior to the geometric tolerance accuracy obtained by lapping.

Figure 25:
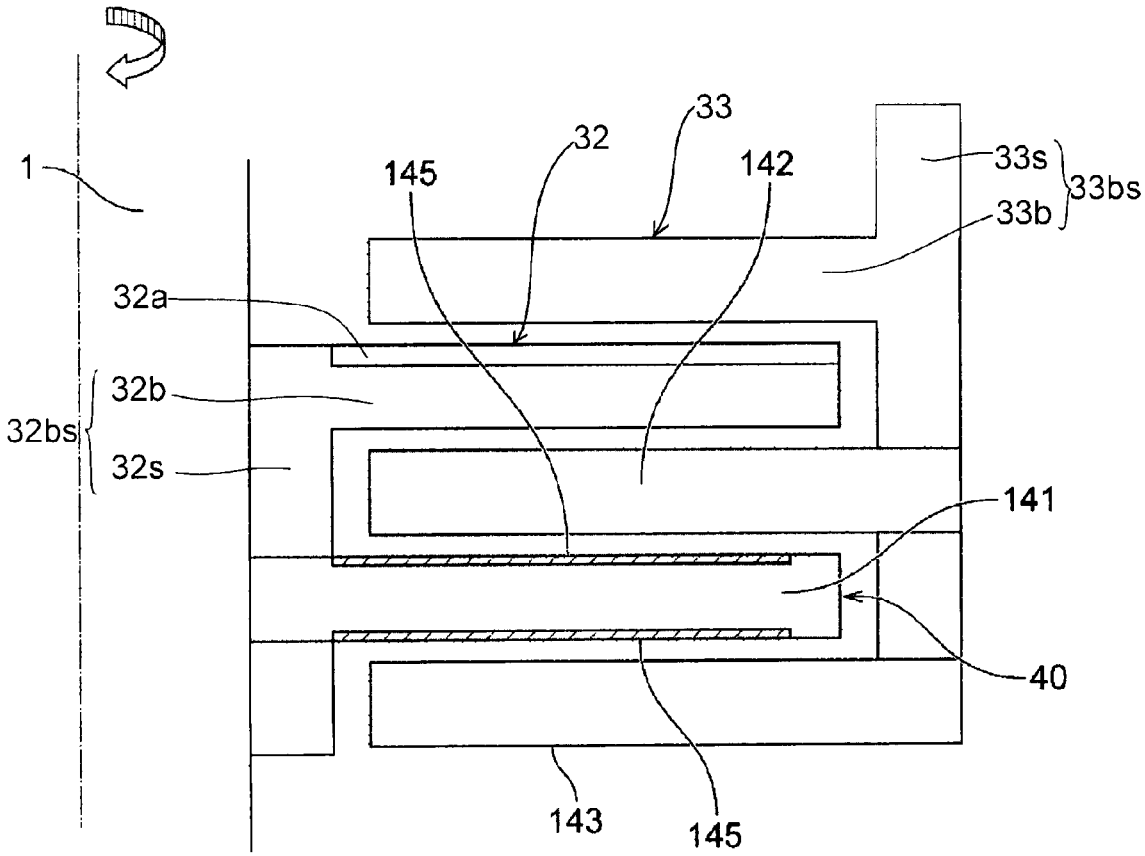
FIG. 25 is an enlarged view showing another embodiment of a gas bearing and a centrifugal blade pumping section above the gas bearing.

FIG. 25 is an enlarged view showing another embodiment of the gas bearing 40 and the centrifugal blade pumping section above the gas bearing 40. As shown in FIG. 25, the gas bearing 40 comprises a rotating member (rotating part) 141 fixed to the main shaft 1, and an upper stationary member (upper stationary part) 142 and a lower stationary member (lower stationary part) 143 which are disposed above and below the rotating member (rotating part) 141 so as to place the rotating member (rotating part) 141 between the upper stationary member (upper stationary part) 142 and the lower stationary member (lower stationary part) 143. The upper stationary member (upper stationary part) 142 and the lower stationary member (lower stationary part) 143 are fixed to the upper casing 3. Spiral grooves 145, 145 are formed in both surfaces of the rotating member 141. Specifically, the rotating member (rotating part) 141 having the spiral grooves 145, 145 is placed between the upper and lower divided members (parts) i.e. the upper stationary member (upper stationary part) 142 and the lower stationary member (lower stationary part) 143.

According to the embodiment shown in FIG. 25, because the gas bearing 40 is used as a bearing for supporting the rotor including the main shaft 1 and the rotor blades fixed to the main shaft 1 in a thrust direction, the rotor can be rotatably supported in an axial direction of the rotor with an accuracy of several micron meters (μm) to several tens of micron meters (μm). The spacer-equipped blade members (blade members with a spacer) 32*bs*, each comprising a circular disk-shaped blade portion 32*b* having a blade evacuation surface on which the centrifugal blade element 32*a* is formed, and a cylindrical spacer 32*s* extending downwardly from the inner circumferential side of the circular disk-shaped blade portion 32*b*, are disposed in a multistage manner immediately above the upper stationary member (upper stationary part) 142 constituting the gas bearing 40. Further, the spacer-equipped blade members 33*bs*, each comprising a circular disk-shaped blade portion 33*b* having a blade evacuation surface at a lower end surface thereof, and a cylindrical spacer 33*s* extending upwardly from the outer circumferential side of the circular disk-shaped blade portion 33*b*, are disposed in a multistage manner.

Further, the structures of the turbine blade unit 13 and the stator blade 17 which are the blade elements of the pumping section 10 in the turbo vacuum pump shown in FIGS. 19 through 25 are the same as the blade elements shown in FIGS. 7 and 8. Specifically, the turbine blade unit 13 of the turbine blade pumping section 11 is shown in FIGS. 7A and 7B. The stator blade 17 of the turbine blade pumping section 11 is shown in FIGS. 8A, 8B and 8C.

Figure 26:
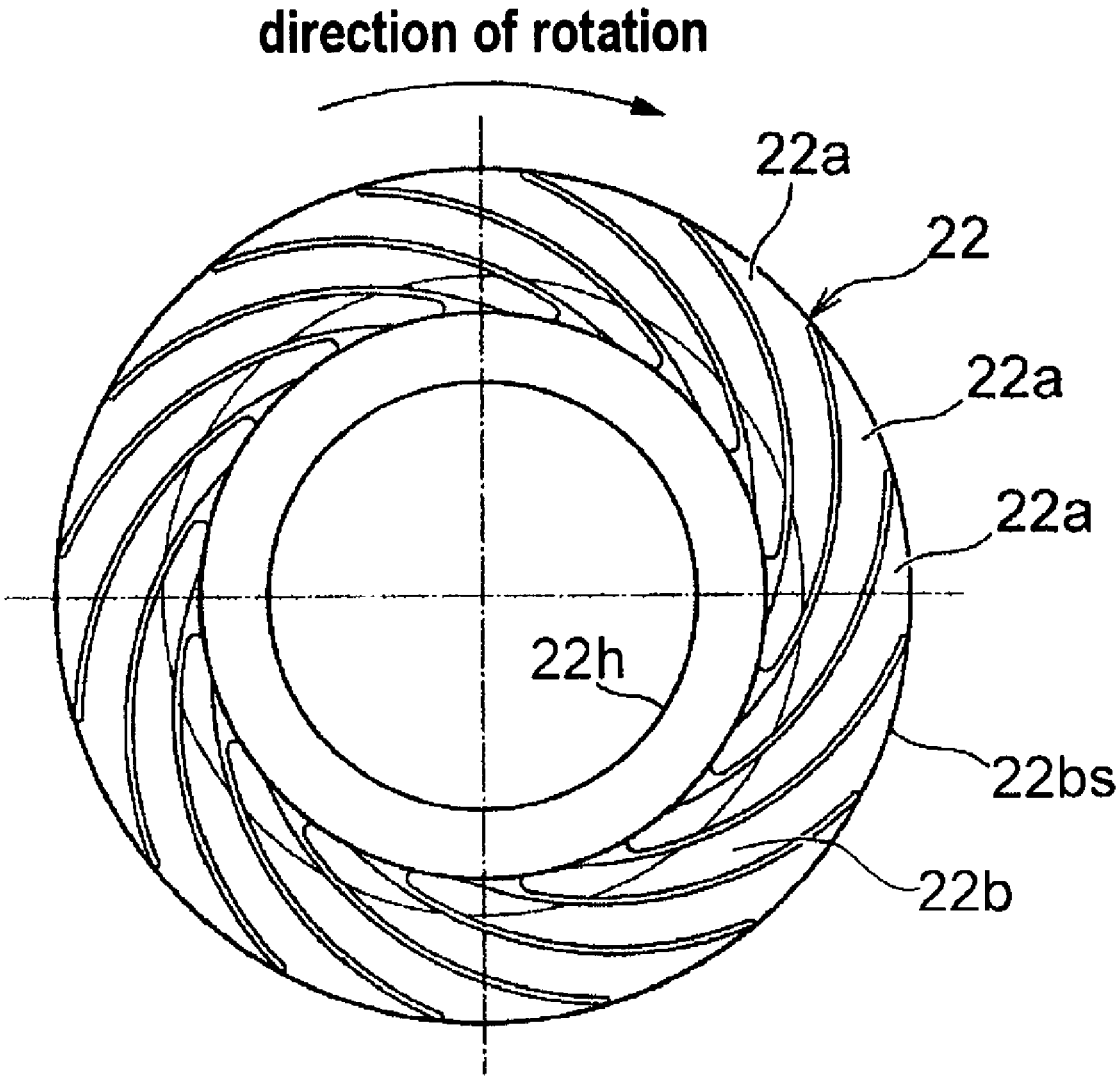
FIG. 26 is a plan view showing a centrifugal blade of a first centrifugal blade pumping section, and showing the uppermost stage turbine blade closest to the intake port of the casing.

FIG. 26 is a plan view showing the centrifugal blade 22 of the first centrifugal blade pumping section 21. FIG. 26 is a plan view of the uppermost stage centrifugal blade 22 closest to the intake port 5 of the casing 2, as viewed from the intake port side. The shape of cross section of the centrifugal blade 22 is the same as the shape of cross section of the spacer-equipped blade member 32 comprising a circular disk-shaped blade portion having a centrifugal blade element and a cylindrical spacer which are integrally formed as shown in FIG. 24A. Thus, the shape of cross section of the centrifugal blade 22 is not shown in the drawing. The centrifugal blade 22 serving as high-vacuum side centrifugal blade is composed of a spacer-equipped blade members 22*bs* comprising a circular disk-shaped blade portion 22*b* having a centrifugal blade element 22*a*, and a cylindrical spacer (not shown) which are integrally formed. The spacer-equipped blade member 22*bs* has a through hole 22*h*, and the main shaft 1 passes through the through hole 22*h*. The centrifugal blade 22 is rotated in a clockwise direction in FIG. 26.

The centrifugal blade element 22*a* comprises spiral centrifugal grooves as shown in FIG. 26. The spiral centrifugal grooves constituting the centrifugal blade element 22*a* extend in such a direction as to cause the gas to flow counter to the direction of rotation (in a direction opposite to the direction of rotation). Each of the spiral centrifugal grooves extends from a slightly outer side of the through hole 22*h* to an outer periphery of the through hole 22*h*. The other centrifugal blades 22 have the same configuration as the uppermost stage centrifugal blade 22. The number and shape of the centrifugal grooves, the outer diameter of the boss part, and the length of flow passages defined by the centrifugal grooves may be changed as needed.

Figure 27:
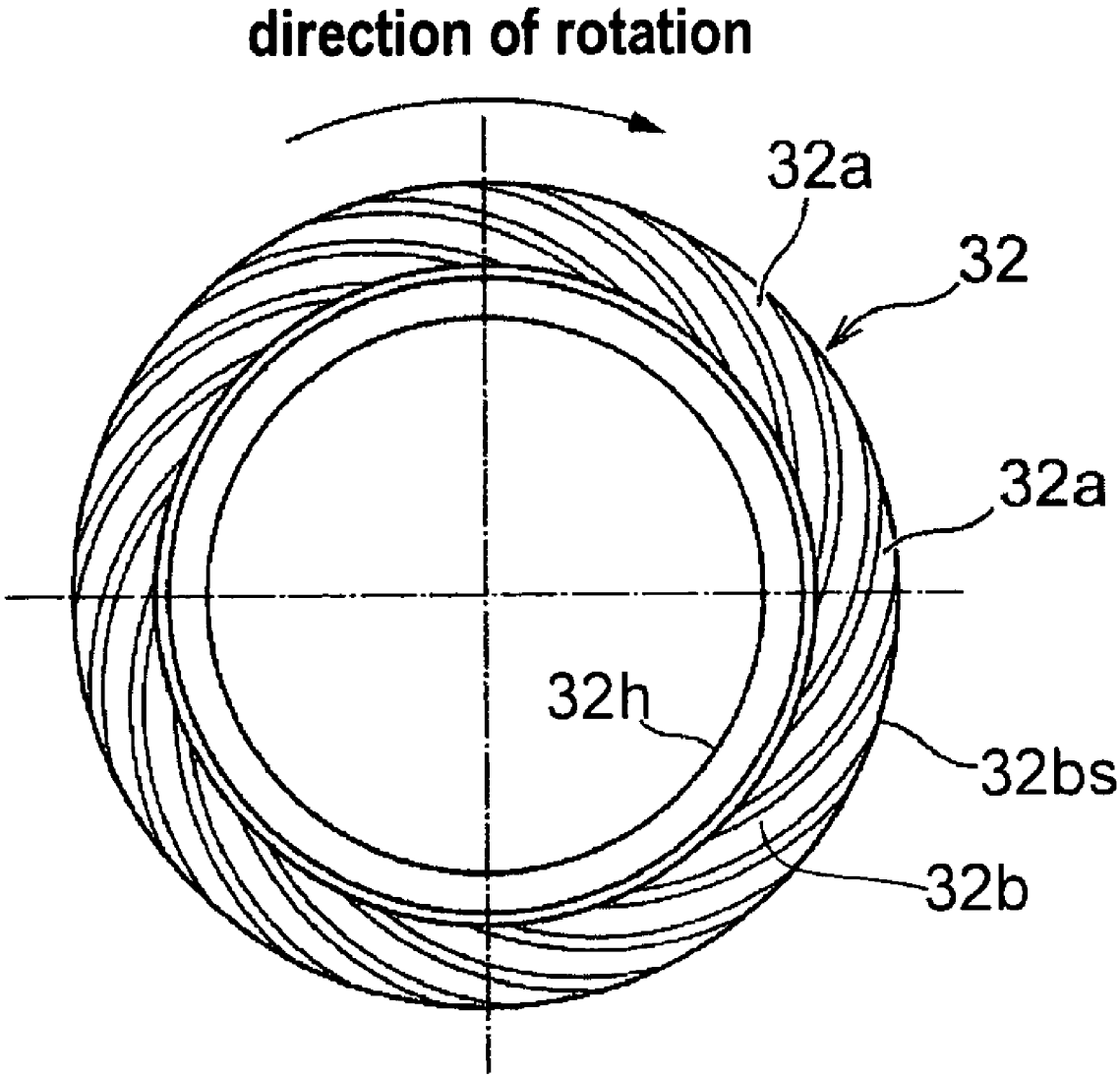
FIG. 27 is a plan view showing a centrifugal blade of a second centrifugal blade pumping section, and showing the uppermost stage turbine blade closest to the intake port of the casing.

FIG. 27 is a plan view showing the configuration of the centrifugal blade 32 of the second centrifugal blade pumping section 31. FIG. 27 is a plan view of the uppermost stage centrifugal blade 32 closest to the intake port 5 of the casing 2, as viewed from the intake port side. The shape of cross section of the centrifugal blade 32 is shown in FIG. 24A. The centrifugal blade 32 is composed of a spacer-equipped blade member 32*bs* comprising a circular disk-shaped blade portion 32*b* having a centrifugal blade element 32*a*, and a cylindrical spacer 32*s* which are integrally formed. The spacer-equipped blade member 32*bs* has a through hole 32*h*, and the main shaft 1 passes through the through hole 32*h*. The centrifugal blade 32 is rotated in a clockwise direction in FIG. 27.

The centrifugal blade element 32*a* comprises spiral centrifugal grooves as shown in FIG. 27. The spiral centrifugal grooves constituting the centrifugal blade element 32*a* extend in such a direction as to cause the gas to flow counter to the direction of rotation (in a direction opposite to the direction of rotation). Each of the spiral centrifugal grooves extends from a slightly outer side of the through hole 32*h* to an outer periphery of the through hole 32*h*. The other centrifugal blades 32 have the same configuration as the uppermost stage centrifugal blade 32. The number and shape of the centrifugal grooves, and the length of flow passages defined by the centrifugal grooves may be changed as needed.

In the case where the centrifugal blades 32 at the atmospheric pressure side shown in FIG. 27 is compared with the centrifugal blades 22 at the high-vacuum side shown in FIG. 26, the grooves of the centrifugal blade element 32*a* of the centrifugal blades 32 at the atmospheric pressure side are set to be shallow (or the height of projections is set to be low), and the grooves of the centrifugal blade element 22*a* of the centrifugal blades 22 at the high-vacuum side are set to be deep (or the height of projections is set to be high). Specifically, as vacuum is higher, the centrifugal grooves of the centrifugal blade element are deeper (or the height of projections is higher). In short, as the degree of vacuum is higher, the evacuation velocity of the centrifugal blade is higher.

Next, the bearing and motor section 50 will be described. As shown in FIG. 19, the bearing and motor section 50 comprises a motor 51 for rotating the main shaft 1, an upper radial magnetic bearing 53 and a lower radial magnetic bearing 54 for rotatably supporting the main shaft 1 in a radial direction, and an upper thrust magnetic bearing 56 for attracting the rotor in an axial direction. The motor 51 comprises a high-frequency motor. The upper radial magnetic bearing 53, the lower radial magnetic bearing 54 and the upper thrust magnetic bearing 56 comprise an active magnetic bearing. In order to prevent the rotor blade and the stator blade from being brought into contact with each other when an abnormality occurs in one of the magnetic bearings 53, 54, 56, an upper touchdown bearing 81 and a lower touchdown bearing 82 are provided to support the main shaft 1 in a radial direction and an axial direction. The upper thrust magnetic bearing 56 is configured to attract a target disk 58 by electromagnet. Further, in place of the upper thrust magnetic bearing 56 and the target disk 58, a thrust magnetic bearing 55 comprising an upper thrust magnetic bearing 56, a lower thrust magnetic bearing 57, and a target disk 58 may be provided in the same manner as the turbo vacuum pump shown in FIG. 12.

The evacuation action of the turbo vacuum pump shown in FIGS. 19 through 27 is the same as that of the turbo vacuum pump shown in FIGS. 1 through 10. The performance comparison based on blade clearance in the turbo vacuum pump is the same as the graph shown in FIG. 11.

The turbo vacuum pump according to the third embodiment of the present invention shown in FIGS. 19 through 27 has the following advantages:

(1) The circular disk-shaped blade portion and the cylindrical spacer which have heretofore been discrete members are integrally formed, and thus the number of parts can be decreased to lower the manufacturing cost. Further, since the circular disk-shaped blade portion and the cylindrical spacer are integrally formed, assembling error caused by stacking discrete components (parts) can be reduced.

(2) Because the surface on which the centrifugal blade element is formed is located at an end surface side of the integrally formed component, the accuracy of parallelism and flatness can be very high by lapping. Therefore, because the dimensional accuracy and geometric tolerance accuracy of the axial end surfaces of the centrifugal blade element is high, the clearance can be minute to improve the evacuation performance.

Although certain preferred embodiments of the present invention have been shown and described in detail, it should be understood that various changes and modifications may be made therein without departing from the scope of the appended claims.

What is claimed is:

1. A turbo vacuum pump comprising:

a casing;

a pumping section having rotor blades and stator blades which are disposed alternately in said casing;

a main shaft for supporting said rotor blades; and a bearing and motor section having a motor for rotating said main shaft and a bearing mechanism for supporting said main shaft rotatably;

wherein a gas bearing is used as a bearing for supporting said main shaft in a thrust direction, spiral grooves are formed in both surfaces of a stationary part of said gas bearing, and said stationary part having said spiral grooves is placed between an upper rotating part and a lower rotating part which are fixed to said main shaft; and wherein said upper rotating part has a first surface and a second surface opposite to said first surface, a centrifugal blade element for compressing and evacuating gas in a radial direction is formed on said first surface of said upper rotating part, and said second surface faces said spiral grooves of said stationary part.

2. The turbo vacuum pump according to claim 1, wherein centrifugal blade elements for compressing and evacuating gas in a radial direction are axially disposed in a multistage manner, and blade clearances of said centrifugal blade elements are arranged to be gradually larger from the discharge side to the intake side.

3. The turbo vacuum pump according to claim 1, wherein centrifugal blade elements for compressing and evacuating gas in a radial direction are axially disposed in a multistage manner, and an axial thickness of said stator blade is thicker than an axial thickness of said rotor blade having said centrifugal blade element by about 10 to 50% of blade clearance which is formed in an axial direction.

4. The turbo vacuum pump according to claim 1, wherein centrifugal blade grooves of a centrifugal blade element for compressing and evacuating gas in a radial direction are formed in both of a surface for forming minute axial clearance and its opposite surface of said rotor blade.

5. The turbo vacuum pump according to claim 1, wherein an elastic deformation structure is provided as at least a part of components for fastening multistage centrifugal blade elements in an axial direction.

6. A turbo vacuum pump comprising:

a casing;

a pumping section having rotor blades and stator blades which are disposed alternately in said casing;

a main shaft for supporting said rotor blades; and a bearing and motor section having a motor for rotating said main shaft and a bearing mechanism for supporting said main shaft rotatably;

wherein a gas bearing is used as a bearing for supporting said main shaft in a thrust direction, spiral grooves are formed in both surfaces of a stationary part of said gas bearing, and said stationary part having said spiral grooves is placed between an upper rotating part and a lower rotating part which are fixed to said main shaft; and wherein a spacer is provided between said lower rotating part and an end face of said main shaft.

7. The turbo vacuum pump according to claim 6, wherein the coefficients of linear expansion of said main shaft, said lower rotating part of said gas bearing and said spacer are taken as λsf, λd1, λsp, respectively, and a material of said spacer is set to be λsf>λsp≧λd1.

8. A turbo vacuum pump comprising:

a casing;

a pumping section having rotor blades and stator blades which are disposed alternately in said casing;

a main shaft for supporting said rotor blades; and a bearing and motor section having a motor for rotating said main shaft and a bearing mechanism for supporting said main shaft rotatably;

wherein a gas bearing is used as a bearing for supporting said main shaft in a thrust direction, spiral grooves are formed in both surfaces of a rotating part of said gas bearing fixed to said main shaft, and said rotating part having said spiral grooves is placed between an upper stationary part and a lower stationary part; and wherein a spacer is provided between said rotating part having said spiral grooves and an end face of said main shaft.

9. The turbo vacuum pump according to claim 8, wherein the coefficients of linear expansion of said main shaft, said rotating part of said gas bearing and said spacer are taken as λsf, λd2, λsp, respectively, and a material of said spacer is set to be λsf>λsp≧λd2.

10. A turbo vacuum pump comprising:

a casing;

a pumping section having rotor blades and stator blades which are disposed alternately in said casing;

a main shaft for supporting said rotor blades; and a bearing and motor section having a motor for rotating said main shaft and a bearing mechanism for supporting said main shaft rotatably;

wherein a gas bearing is used as a bearing for supporting said main shaft in a thrust direction, spiral grooves are formed in both surfaces of a stationary part of said gas bearing, and said stationary part having said spiral grooves is placed between an upper rotating part and a lower rotating part which are fixed to said main shaft; and wherein an outer diameter of said main shaft is getting gradually smaller from the intake side to the downstream side.

11. The turbo vacuum pump according to claim 10, wherein said main shaft is set to be a tapered shape so that said outer diameter of said main shaft is getting gradually smaller from the intake side to the downstream side.

12. The turbo vacuum pump according to claim 10, wherein said main shaft is set to be a step-like shape so that said outer diameter of said main shaft is getting gradually smaller from the intake side to the downstream side.

13. A turbo vacuum pump comprising:

a casing;

a pumping section having rotor blades and stator blades which are disposed alternately in said casing;

a main shaft for supporting said rotor blades; and a bearing and motor section having a motor for rotating said main shaft and a bearing mechanism for supporting said main shaft rotatably;

wherein a gas bearing is used as a bearing for supporting said main shaft in a thrust direction, spiral grooves are formed in both surfaces of a rotating part of said gas bearing fixed to said main shaft, and said rotating part having said spiral grooves is placed between an upper stationary part and a lower stationary part; and wherein an outer diameter of said main shaft is getting gradually smaller from the intake side to the downstream side.

14. The turbo vacuum pump according to claim 13, wherein said main shaft is set to be a tapered shape so that said outer diameter of said main shaft is getting gradually smaller from the intake side to the downstream side.

15. The turbo vacuum pump according to claim 13, wherein said main shaft is set to be a step-like shape so that said outer diameter of said main shaft is getting gradually smaller from the intake side to the downstream side.

16. A turbo vacuum pump comprising:

a casing;

a pumping section having rotor blades and stator blades which are disposed alternately in said casing;

a main shaft for supporting said rotor blades; and a bearing and motor section having a motor for rotating said main shaft and a bearing mechanism for supporting said main shaft rotatably;

wherein a gas bearing is used as a bearing for supporting said main shaft in a thrust direction, spiral grooves are formed in both surfaces of a stationary part of said gas bearing, and said stationary part having said spiral grooves is placed between an upper rotating part and a lower rotating part which are fixed to said main shaft; and wherein at least one of said rotor blade and said stator blade comprises a spacer-equipped blade member comprising a circular disk-shaped blade portion and a cylindrical spacer extending from said circular disk-shaped blade portion which are integrally formed, and said spacer-equipped blade members are stacked in a multistage manner to construct said pumping section.

17. The turbo vacuum pump according to claim 16, wherein said circular disk-shaped blade portion has a centrifugal blade element for compressing and evacuating gas in a radial direction, and said spacer-equipped blade member comprises an integrally formed component so that said centrifugal blade element is located at an end surface side of said integrally formed component.

18. The turbo vacuum pump according to claim 16, wherein said spacer-equipped blade member constitutes said rotor blade, said cylindrical spacer extends downwardly from an inner circumferential side of said circular disk-shaped blade portion, and a centrifugal blade element for compressing and evacuating gas in a radial direction is formed on an upper end surface of said circular disk-shaped blade portion.

19. The turbo vacuum pump according to claim 16, wherein said spacer-equipped blade member constitutes said stator blade, said cylindrical spacer extends upwardly from an outer circumferential side of said circular disk-shaped blade portion, and a blade evacuation surface is formed at a lower end of said circular disk-shaped blade portion.

20. A turbo vacuum pump comprising:

a casing;

a pumping section having rotor blades and stator blades which are disposed alternately in said casing;

a main shaft for supporting said rotor blades; and a bearing and motor section having a motor for rotating said main shaft and a bearing mechanism for supporting said main shaft rotatably;

wherein a gas bearing is used as a bearing for supporting said main shaft in a thrust direction, spiral grooves are formed in both surfaces of a rotating part of said gas bearing fixed to said main shaft, and said rotating part having said spiral grooves is placed between an upper stationary part and a lower stationary part; and wherein at least one of said rotor blade and said stator blade comprises a spacer-equipped blade member comprising a circular disk-shaped blade portion and a cylindrical spacer extending from said circular disk-shaped blade portion which are integrally formed, and said spacer-equipped blade members are stacked in a multistage manner to construct said pumping section.

21. The turbo vacuum pump according to claim 20, wherein said circular disk-shaped blade portion has a centrifugal blade element for compressing and evacuating gas in a radial direction, and said spacer-equipped blade member comprises an integrally formed component so that said centrifugal blade element is located at an end surface side of said integrally formed component.

22. The turbo vacuum pump according to claim 20, wherein said spacer-equipped blade member constitutes said rotor blade, said cylindrical spacer extends downwardly from an inner circumferential side of said circular disk-shaped blade portion, and a centrifugal blade element for compressing and evacuating gas in a radial direction is formed on an upper end surface of said circular disk-shaped blade portion.

23. The turbo vacuum pump according to claim 20, wherein said spacer-equipped blade member constitutes said stator blade, said cylindrical spacer extends upwardly from an outer circumferential side of said circular disk-shaped blade portion, and a blade evacuation surface is formed at a lower end of said circular disk-shaped blade portion.

* * * * *